United States Patent [19]

Norminton

[11] Patent Number: 4,597,352

[45] Date of Patent: Jul. 1, 1986

[54] COMPACT TOWING SYSTEM FOR UNDERWATER BODIES

[76] Inventor: Robert S. Norminton, R.R. 3, 10770 Willoughby Drive, Niagara Falls, Ontario, Canada, L2E 6S6

[21] Appl. No.: 526,537

[22] Filed: Aug. 25, 1983

[51] Int. Cl.[4] ..... B63B 21/66

[52] U.S. Cl. ..... 114/254; 114/268

[58] Field of Search ..... 114/210, 242, 243, 244, 114/253, 254, 268, 259; 212/150, 190, 192, 193, 205-221, 223-228, 260, 261; 254/413, 415

[56] References Cited

U.S. PATENT DOCUMENTS

| | | | |
|---|---|---|---|
| 156,028 | 10/1874 | Lewis | 212/228 |
| 1,388,831 | 8/1921 | Broady | 212/260 |
| 2,780,196 | 2/1957 | Jareckie | 114/254 |
| 3,194,179 | 7/1965 | Scherer | 212/224 |
| 3,269,560 | 8/1966 | Knight | 212/150 |
| 3,390,657 | 7/1968 | Schneider | 114/268 |
| 3,494,443 | 2/1970 | Huffhines | 212/193 |
| 3,516,555 | 6/1970 | Robertson et al. | 212/224 |
| 3,853,209 | 12/1974 | Bond | 212/216 |
| 3,955,522 | 5/1976 | Gaudiano et al. | 114/259 |
| 3,993,011 | 11/1976 | Garland | 114/210 |
| 4,080,920 | 3/1978 | Berthet et al. | 114/254 |
| 4,317,524 | 3/1982 | Andersson | 212/261 |
| 4,325,537 | 4/1982 | Winter et al. | 254/413 |

FOREIGN PATENT DOCUMENTS

| | | | |
|---|---|---|---|
| 655052 | 1/1963 | Canada | 114/254 |
| 671172 | 9/1963 | Canada | 114/254 |
| 692070 | 8/1964 | Canada | 114/254 |
| 707634 | 4/1965 | Canada | 114/254 |
| 870369 | 5/1971 | Canada | 114/254 |
| 879530 | 8/1971 | Canada | 114/254 |
| 902577 | 6/1972 | Canada | 114/254 |
| 923378 | 3/1973 | Canada | 114/254 |
| 949547 | 6/1974 | Canada | 114/254 |
| 1093061 | 1/1981 | Canada | 114/254 |
| 1111829 | 11/1981 | Canada | 114/254 |
| 1120790 | 3/1982 | Canada | 114/254 |

*Primary Examiner*—Galen L. Barefoot
*Assistant Examiner*—Stephen P. Avila
*Attorney, Agent, or Firm*—Birch, Stewart, Kolasch & Birch

[57] ABSTRACT

A compact towing system which is adapted to be mounted on a ship for towing an underwater towed body using faired tow cable is provided herein. It includes an improvement in the combination of the following inter-related elements: (a) a trucked gantry; (b) a lower saddle; (c) a winch drum; (d) a boom; (e) a pivotable deflection sheave mounted inside the boom; and (f) a fairlead sheave and saddle assembly. Such assembly is mounted on a driven carriage. The improvement comprises structure and controls for driving the trucked gantry in synchronism with the winch drum. The driving of the trucked gantry (a) fore and aft is so related to the winding and unwinding of cable from the winch drum (b) that, as the trucked gantry traverses between a forward stow position and an aft full cable-out position, a zero degree fleet angle is obtained and maintained between the tow cable and the winch drum. Structure and controls are also provided for driving the driven carriage to traverse the carriage along the boom only during launch and recovery in synchronism with the winch drum so that, as the cable unwinds, the carriage is driven towards the outer end of the boom, in which position the fairlead sheave and saddle assembly overhangs the outer end of the boom. As the cable winds, the carriage is driven towards the inner end of the boom, in which position the fairlead sheave and saddle assembly lies along the boom. Thus, in operation the cable passes from the winch drum through a fairing training device, through the hollow boom pivot, around the deflection sheave, along the boom, through the fairlead sheave which is mounted on the driven carriage, and then to the towed body.

140 Claims, 45 Drawing Figures

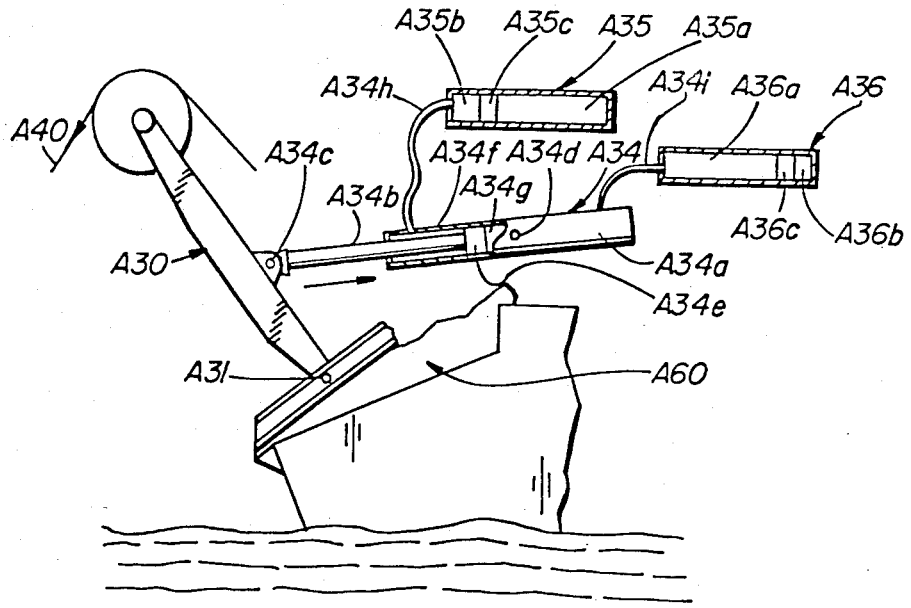
FIG. A PRIOR ART
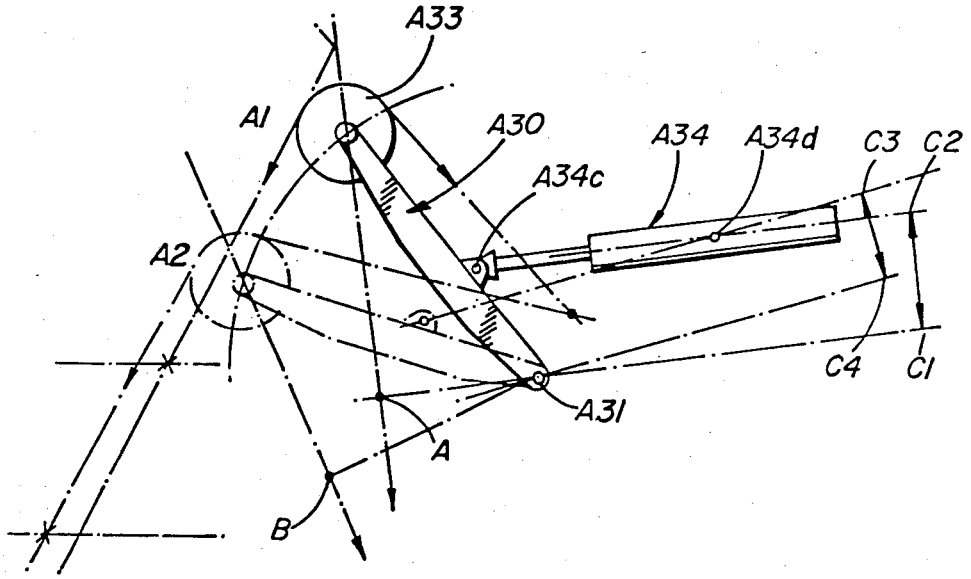
FIG. B PRIOR ART

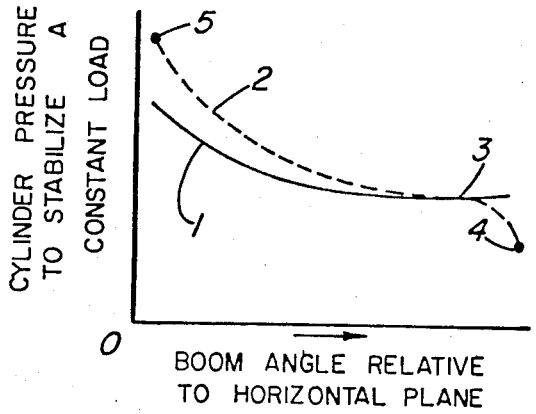
FIG. C
PRIOR ART
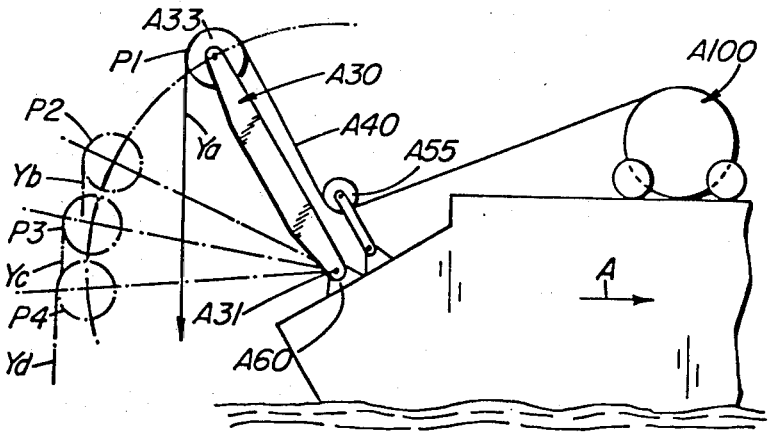
FIG. D
PRIOR ART
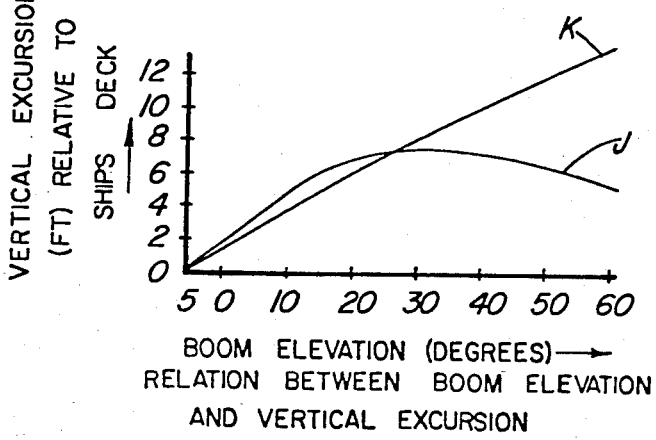
FIG. E
PRIOR ART

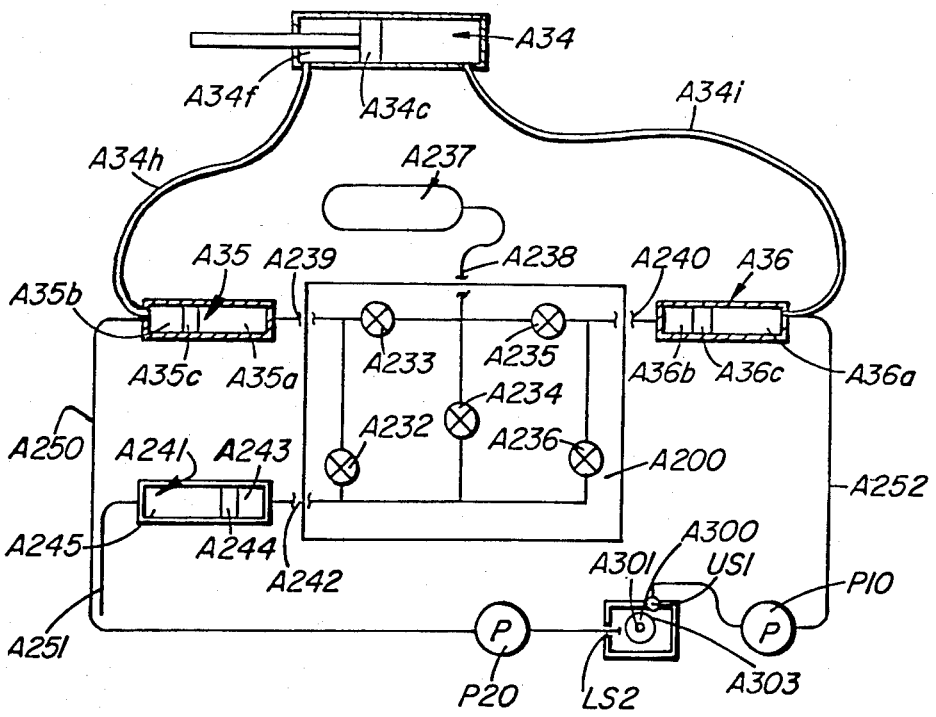
FIG. F
PRIOR ART
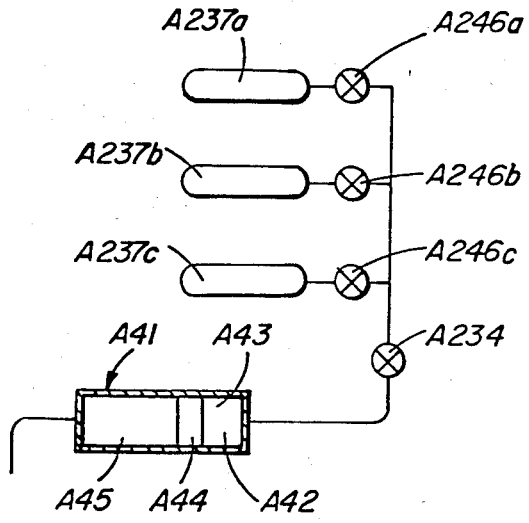
FIG. G
PRIOR ART

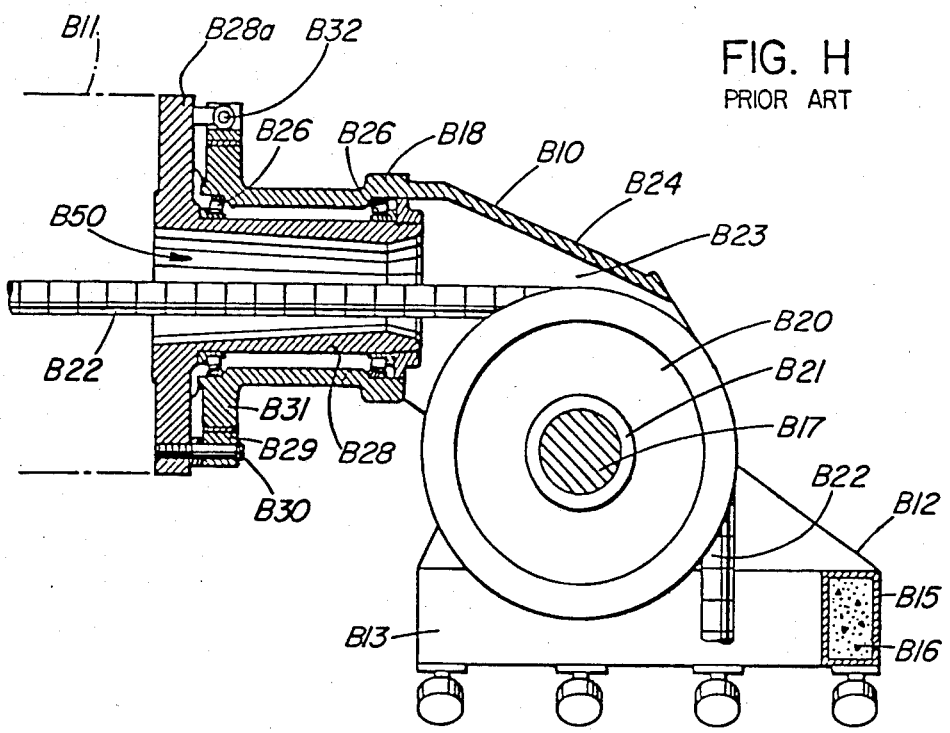
FIG. H
PRIOR ART
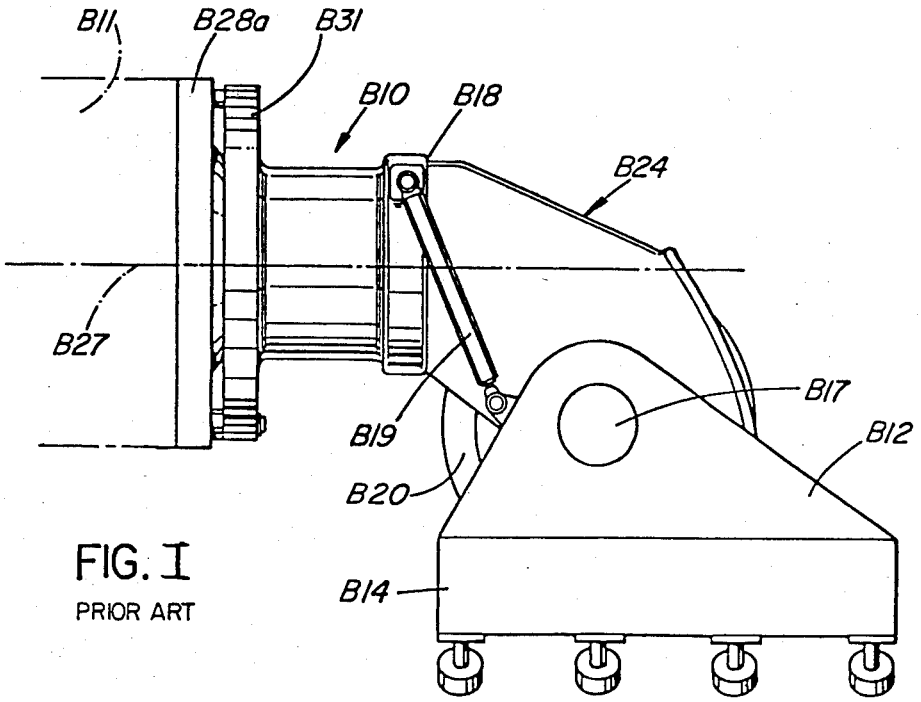
FIG. I
PRIOR ART

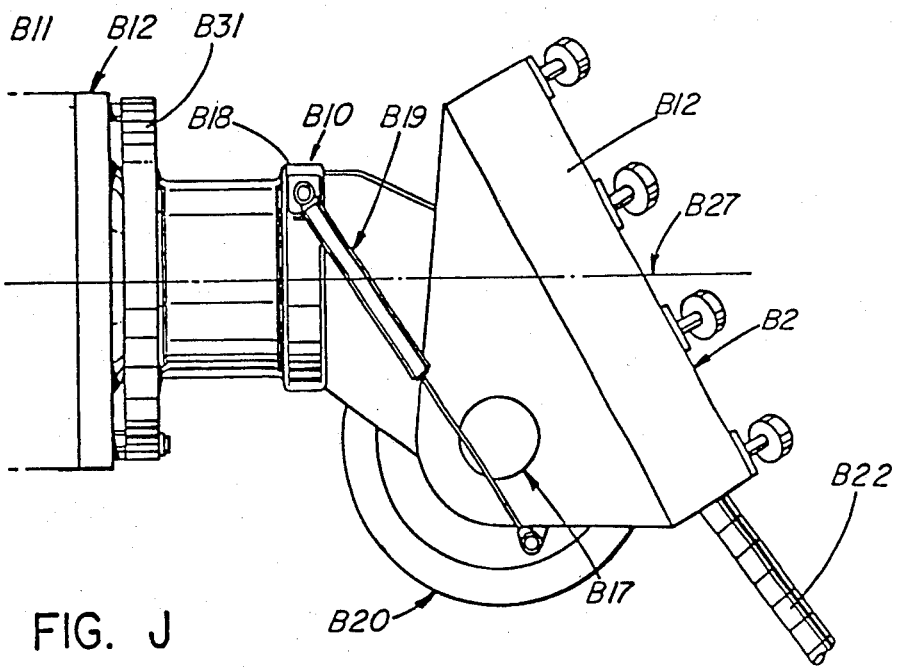
FIG. J
PRIOR ART
FIG. K
PRIOR ART
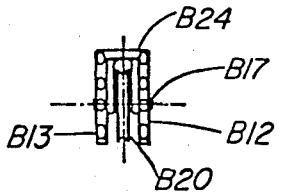
FIG. L
PRIOR ART
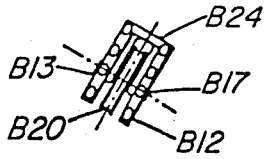
FIG. M
PRIOR ART
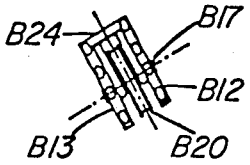

FIG. N
PRIOR ART
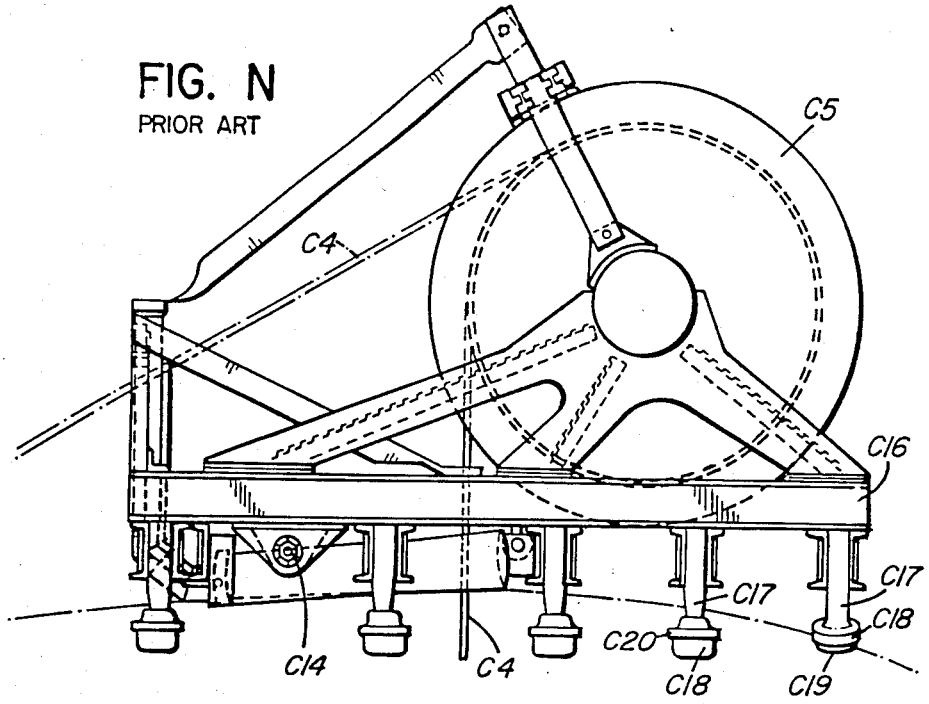
FIG. O
PRIOR ART
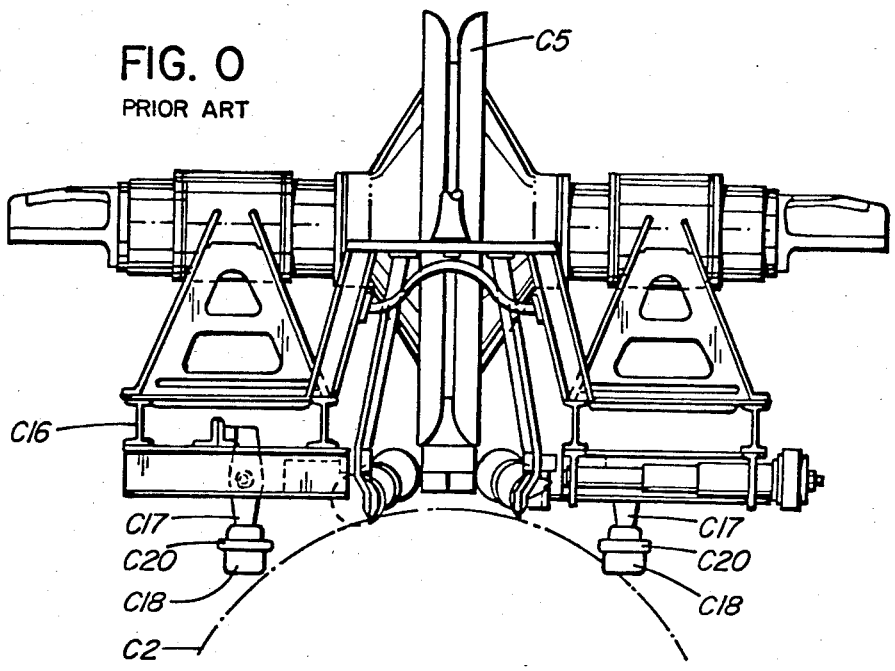

FIG. P
PRIOR ART
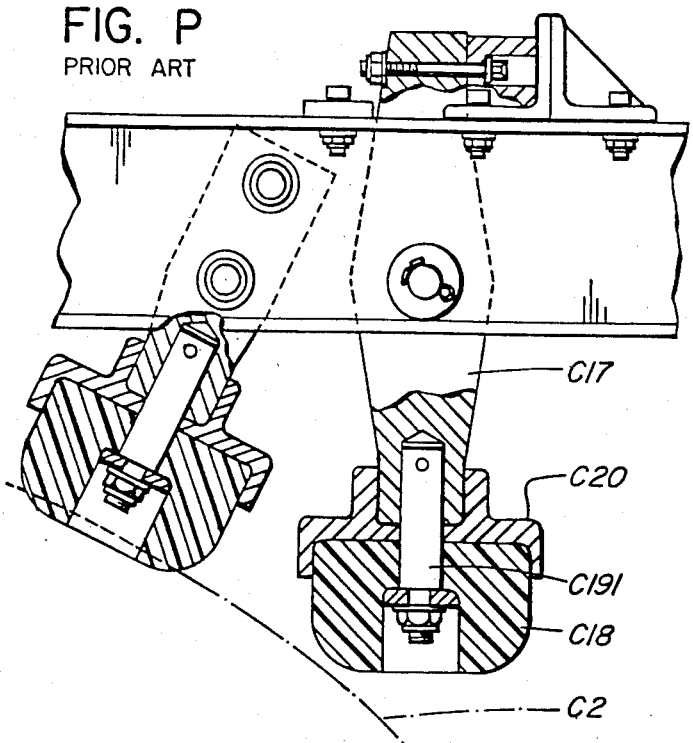
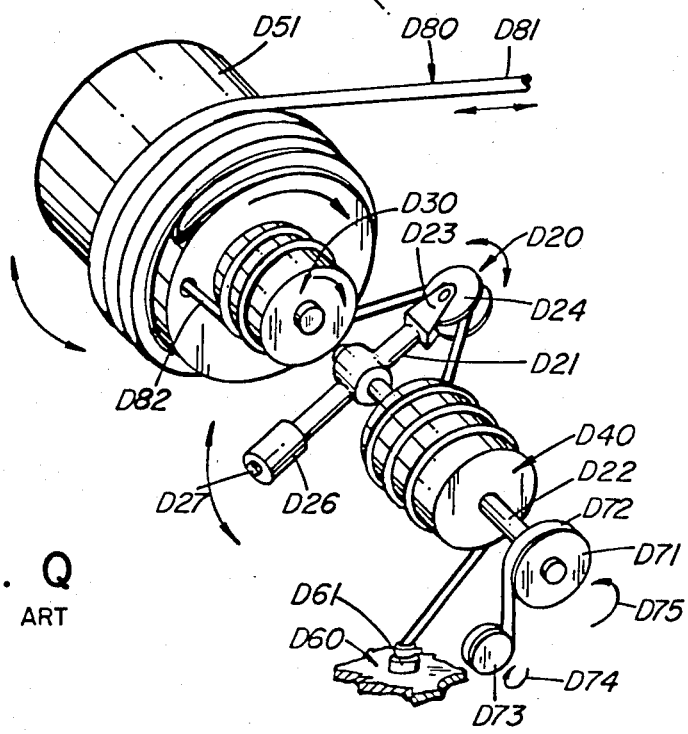
FIG. Q
PRIOR ART

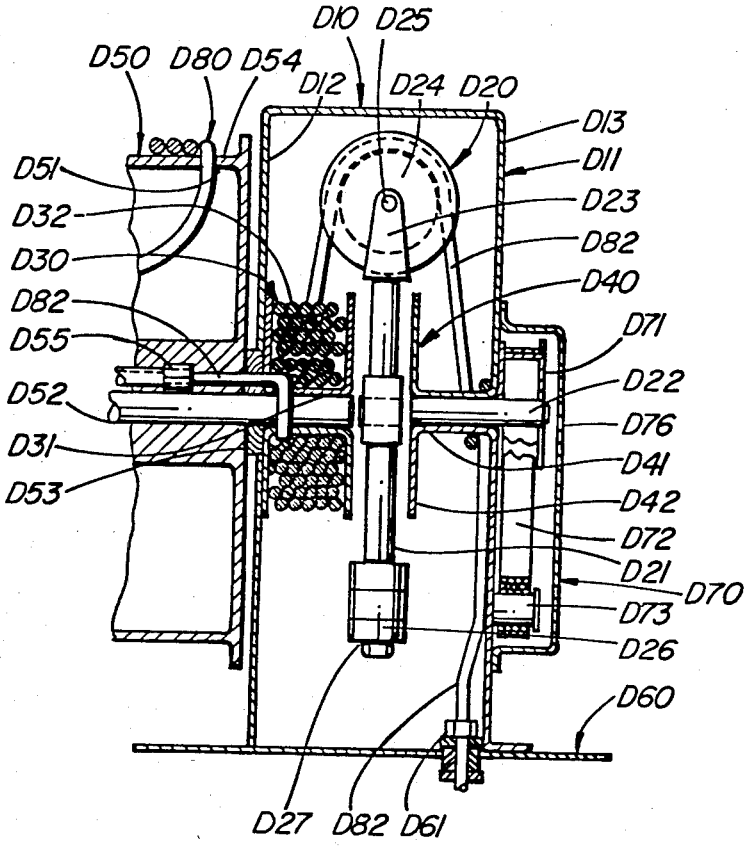
FIG. R
PRIOR ART

FIG. 12
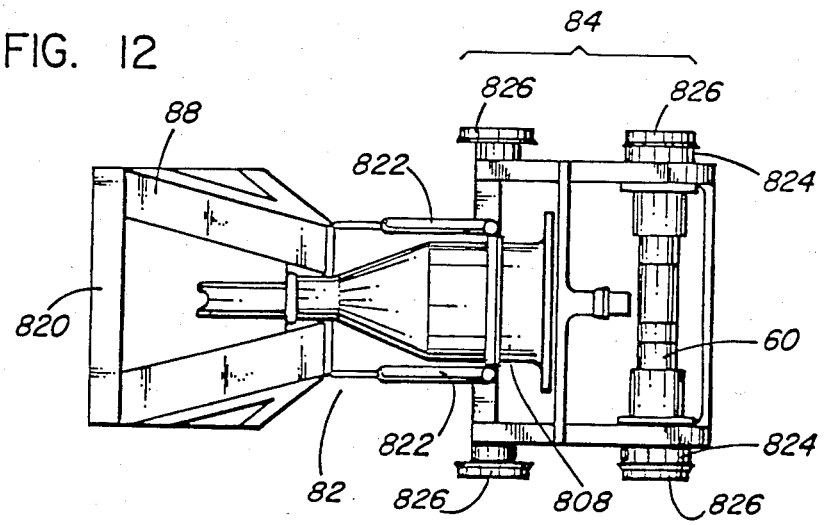
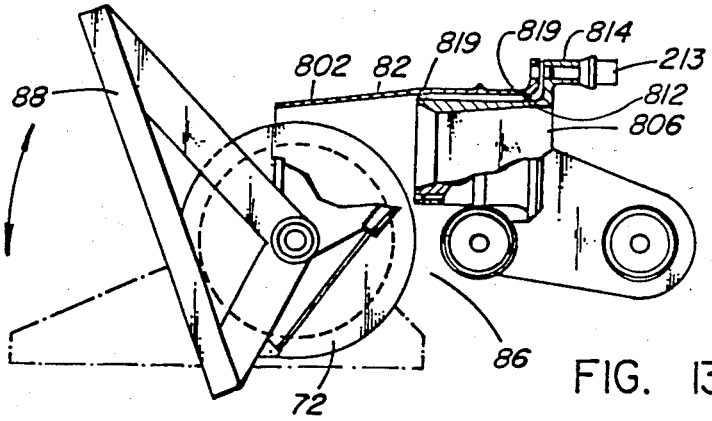
FIG. 13
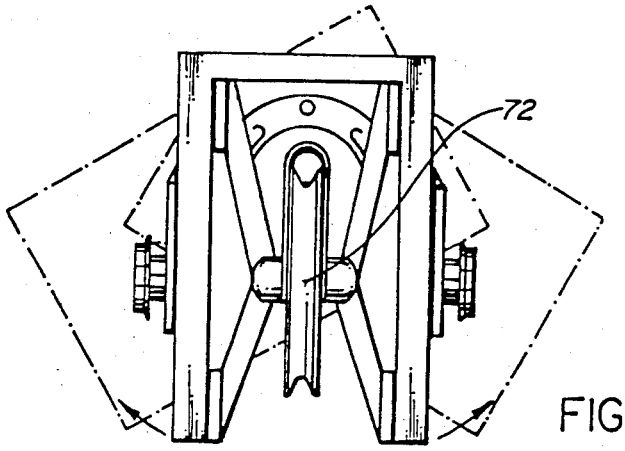
FIG. 14

COMPACT TOWING SYSTEM FOR UNDERWATER BODIES

BACKGROUND OF THE INVENTION (i) Field of the Invention

This invention relates to systems for launching, towing and recovering an oceanographic towed body. The invention relates generally to a towing system wherein an oceanographic body is towed behind a vessel. The system normally includes a type of shock-absorbing system for the tow line which is not harmful to such tow line; means for accommodating abnormal or erratic tow line behaviour without wrecking the system structure or harming the tow line; means for keeping the fleet angle near zero during winding the cable onto and off the winch during paying out and winding in of the towing cable; means for training the fairings surrounding the tow cable as the cable is wound onto the winch drum to prevent damage or destruction of such fairings; and apparatus for launching and recovering the towed body without resorting to mechanical interlocking between the body and a member engageable with the body during launching and recovering. By "fleet angle" is meant the angle between the cable run immediately prior to reaching the winch drum and a theoretical line drawn at right angles to the winch drum axle when viewed normal to a plane encompassing both cable run and winch drum axle.

The underwater towed body with which the present invention is used is an underwater SONAR (abbreviated from "Sound Navigation and Ranging") which is finding ever-increasing use in the fields of navigation, mapping, depth finding, fish finding, for detection of wrecks and in a military use, in the detection of enemy vessels. The system with which the present invention is used is a variable depth system, wherein an underwater sound transducer or array is mounted on a body towed from a vessel.

In a variable depth sonar, particularly as used in military applications, an array (usually cylindrical) of underwater sound transducers is housed within a streamlined body which is towed from the surface ship via a faired cable. This cable has an internal core of conductors for transmitting signals to and from the ship from and to the array, and outer layers of armour to withstand towing tensions. Mounted on the ship is means for mechanically launching and retrieving the body, and for shortening and lengthening the amount of cable out.

With respect to the problems of launching and recovering, in the towing system as described, it is necessary to make provision for launching the body prior to towing, and retrieving the body at the conclusion of towing, both in a manner to prevent damage to the towing cable and the object being towed. The launch operation comprises lifting the sonar body from a stowed position on or above the deck of the ship, deploying it over the stern until it is largely immersed in the water, then releasing it to stream aft below the surface. The recovery operation comprises the reeling in of the towed sonar body until it is captured in the launch and retrieval mechanism, then deploying it aboard by operating the hoist.

(ii) Description of the Prior Art

Various means have been developed to launch and retrieve a towed body. One means in common use is described in Canadian Pat. No. 879,530 issued Aug. 31, 1971 to R. L. I. Fjarlie et al. This means utilizes a saddle to hold the body captured in compressive contact against the underside of the saddle during launch and recovery, a boom pivoting at its inboard end from a hoist frame mounted on the deck of the ship adapted for supporting the saddle and a towing sheave at its outboard end, a pair of pantograph arms to hold the saddle level during launch and recovery, and hydraulic cylinders mounted on the hoist frame and attached to the boom. Hydraulic pressure introduced into either the head or rod ends of the cylinder is used to drive the boom out for launch, or to drive it in for body recovery. Boom motion is in the form of a long overhead arc in a vertical plane parallel to the fore and aft centreline of the ship.

Somewhat different is the method utilized in Canadian Pat. No. 1,005,702 issued Feb. 22, 1977 to A. Kemeny, wherein the boom is supported at its inboard end on a rotary actuator which replaces the cylinders in Canadian Pat. No. 879,530. In addition, a system of cables and sheaves replaces the pantograph arms to hold the saddle level during launch and recovery. Pressure within the rotary actuator is used to drive the boom out for launch and in for recovery. Like Canadian Pat. No. 879,530, boom motion is in the form of a long overhead arc in a vertical plane more or less parallel with the centreline of the ship.

In both of the foregoing patents, the body is held level in smooth seas during launch and recovery.

Still another method is described in Canadian Pat. No. 870,369 issued May 11, 1971 to K. Gardner. With this method, the body is actually inverted during recovery so that it is held upside down in the saddle with the nose facing aft in the inboard stowed position. But like Canadian Pat. Nos. 879,530 and 1,005,702, the boom motion in Canadian Pat. No. 870,369 is also in the form of a long overhead arc in a vertical plane more or less parallel with the centreline of the ship.

A difficulty arises when attempts are made to fit the foregoing equipment into the restricted stern spaces of the smaller naval frigates and patrol vessels, and this difficulty is aggravated by the tendency in recent designs of such vessels to place a helicopter landing deck or pad above the stern spaces. For structural and other reasons, it is usually not permissible to pierce this landing deck or pad to gain working clearances. This means, that if one uses a means as described in the above-identified Canadian Pat. Nos. 870,369, 879,530 and 1,005,702, then large sections of the stern near the waterline must be cut into to gain working clearances below the helicopter deck or pad. Since cutting large sections of the stern out is equally unacceptable, a compromise in sonar performance usually has to be made in smaller vessels in that only smaller, lower range transducer arrays, bodies and handling equipment can be accommodated.

Thus, whereas there is room for shock absorbing over a limited vertical arc off the stern, the presence of the helicopter deck above prevents the boom being rotated forward past the vertical position to and from an inboard stow position.

A solution to this problem may be found in Canadian Pat. No. 1,120,790 issued Mar. 30, 1982 to Robert S. Norminton and assigned to Fleet Industries, a Division of Ronyx Corporation Limited. This invention sets forth an improvement in a system for launching, towing and recovering a towed body from a surface vessel, such system including a hoist sub-assembly and a boom sub-assembly to which boom bobbing means are provided for resiliently applying a torque to the boom member about the pivotal connection thereof to the vehicle commensurate with, and in response to changes in, a load applied to and/or the moving moment of, the assembled boom members, the improvement comprising: a boom subassembly comprising an inner boom and an outer boom, the outer boom being telescopable with respect to the inner boom, and boom telescoping means for resiliently extending and retracting the boom in response to changes in a load applied to the towing cable.

By one embodiment of that invention, the boom subassembly includes an inner boom and an outer boom. The outer boom may include wheels or rollers bearing on, and held captive by, the main members of the inner boom. On the other hand, rollers may be attached to the inner boom and be held captive by the main members of the outer boom. The outer boom is connected to the inner boom by one or more hydraulic cylinders. By introducing fluid into either the head or rod ends of these cylinders, the outer boom is made to telescope outward from the inner boom for normal towing, or to collapse into the inner boom, thereby creating a compact stowed combination of boom and towed body. The inner boom is connected to the turntable through a rotary actuator, and the combination of inner boom and outer boom is rotated in the vertical plane (i.e., either raised or lowered) by introducing fluid under pressure to this actuator.

The operation is as follows: The boom is lowered to put the saddle in the water to recover the body. The boom is then raised and collapsed (telescoped inward) for stowing the body. The boom (and indeed the entire hoist) is rotated 90° to bring the body athwartships to the stowed position. The boom is then lowered over a slight arc to deposit the body into a support attached to the ship. The launch process is the reverse of that described above.

The telescopic boom is an essential part of the launch and recovery system. Its use is essential in order that everything is collapsed into a stowed length which is less than the beam of the stern transom.

While the above-described invention may solve the problem of lack of space, it suffers from the drawback that the turntable-mounted winch is, of necessity, mounted toward the corner of the stern, well away from the centreline of the ship. This results in off-centre towing, and at high speeds this may create problems in steering the ship.

With respect to the problems of shock absorbing, the main hazard involved in towing any device of substantial mass from a ship at sea is that of varying cable tensions due to in or out of phase undulations and speeds between the towing vessel and the towed mass. In the extreme, though not uncommon case, the towing cable is prone to falling slack then being followed by a snapping-to-taut condition. The transient cable load, at the instant the cable becomes taut, is high by several magnitudes when compared with the nominal towing load. Cable failures may result from such a situation.

When two interconnected masses are horizontally separated, one from the other, e.g., a tug pulling a ship, spring can be put into the tow line by the expedient of paying out a great deal of tow line, which for example, may be a cable. The weight of the tow line curves the span into a horizontal catenary curve and this together with an acceptable strain within the cable provides such a spring. In towing submerged massive bodies, for example, a sonar towed body, the problem of absorbing shock loads becomes much more difficult. With a submerged sonar body, the tow line has a tendency to be relatively straight and thus variable loads cause a corresponding variable strain in the tow line. In towing a submerged sonar body, from a hydrodynamic viewpoint, it is desirable to have low drag forces on the towing cable, and this may at least be partially achieved by use of fairing elements on the cable. The result of low drag characteristics and towing a submerged sonar body is that the towing cable extends more directly vertical along a straight line than otherwise. In a towing system of the latter type, it is difficult and often impossible to obtain sufficient internal spring within the cable itself to damp out transient loads. This is particularly so at slow ship speeds (in which case the cable more clearly approaches a vertical attitude) i.e., the slower the towing speed the lesser the internal spring and thus the more critical the problem. Transient loads in such a system follow the undulations of the floating vessel. On rough water, the intensity of the transient loads can be severe and particularly because of a snapping action occurring in the tow line resulting from the two bodies moving relative to one another at different speeds.

These effects are countered by providing a means to compensate for the motion of the vessel by allowing some of the tow cable to pay out while the stern of the vessel is rising and by causing some of it to reel in while the stern is falling. The methods by which this is done may be active, passive, or a combination of the two, and will be referred to here as "shock absorbing systems". A passive system is a simpler system and uses stored energy in the form of gas and mechanical springs. A passive system described in the aforementioned Canadian Pat. No. 879,530 utilizes gas-oil springs acting on the overboarding cylinders of the boom to obtain a "boom bobbing" type of shock absorption. This patent is described more fully later in the text.

The foregoing system is usually termed a "boom bobbing" system. It has the advantage that there is little or no cable excursion over the towing sheave during shock absorbing; and the disadvantages that in the presence of an overhead helicopter landing deck that there is insufficient room for boom travel, both for significant cable tension attenuation during shock absorbing, and for launch and recovery; and that of necessity the placement of the cylinders in such that response is non-linear and the mechanical advantage is poor.

Another suggestion is provided in U.S. Pat. No. 3,604,387 issued Sept. 4, 1971 to N. E. Hale, which provides a cable tensioning device which consists of another sheave carried on a pivotable arm which is moved towards and away from the winch by a piston and cylinder connected to an accumulator which maintains more or less constant pressure on the arm and thereby moves it in response to the increase and decrease in the tension of the cable when the acoustic body is towed. This suggestion suffers from the deficiency that it requires careful selection of various attachment points in the system to maintain the torque about the fulcrum constant, and also that it is prone to induce premature cable fatigue because of the back-and-forth cable excursions through the sheave.

The problem of providing shock absorbing in confined spaces was addressed in the aforementioned Canadian Pat. No. 1,120,790. This too describes a passive system.

By one embodiment of that invention, the boom subassembly includes an inner boom and an outer boom. The outer boom may include wheels or rollers bearing on, and held captive by, the main members of the inner boom. On the other hand, rollers may be attached to the inner boom and be held captive by the main members of the outer boom. The outer boom is connected to the inner boom by one or more hydraulic cylinders. By introducing fluid into either the head or rod ends of these cylinders, the outer boom is made to telescope outward from the inner boom for normal towing, or to collapse into the inner boom, thereby creating a compact stowed combination of boom and towed body. The inner boom is connected to the turntable through a rotary actuator, and the combination of inner boom and outer boom is rotated in the vertical plane (i.e., either raised or lowered) by introducing a fluid under pressure to this actuator.

In another embodiment of that invention, two shock absorbing/motion attenuating systems are used, each being capable of being used on its own, or being used together. Both systems may be connected to a common gas-oil spring system, but it is preferred that a separate such gas-oil system be used for each. One system is connected to the above-described rotary actuator connecting inner boom and turntable. The other system is connected to the cylinders connecting inner and outer booms. The primary system proposed here uses gas-oil springs connected to the rotary actuator of the inner boom to produce "boom bobbing" similar to, but on a smaller scale than, that described in the form in the above-identified Canadian Pat. No. 1,010,308. The secondary shock absorbing/motion attenuating system proposed here also utilizes gas-oil springs connected to the hydraulic cylinders connecting the inner and outer booms. Cable excursions into and out of the water are caused by collapsing the outer boom into the inner boom and by telescoping the outer boom from out of the inner under the action of hydraulic fluid transfer arising from the response of the gas-oil spring to variations in tow cable tension. This auxiliary system shock absorbing/motion attenuating is intended to supplement the main boom bobbing system at low speeds of the towing vessel, under which conditions telescoping the inner and outer booms will not cause undesirable surge of the towed body.

The main disadvantage with the combined shock absorbing system as described in Canadian Pat. No. 1,120,790 is that the auxiliary system utilizing the telescopic boom (not the boom bobbing system) suffers the same drawbacks as U.S. Pat. No. 3,604,387 in that it is prone to induce premature cable fatigue because of the back-and-forth excursion of the cable through the towing sheave.

With respect to the problems of tow-off, it is always desirable, when towing an underwater body in a straight line, that the body, cable and ship lie in the same vertical plane. This does not usually occur in practice. While fairings are often used on the two cable, instabilities, wake disturbances, cross currents or other effects may cause the cable to tow off to one side. When the ship is turning, the cable always tows off. Tow-off is usually measured as the angle the cable projected onto a vertical plane makes with a vertical line when viewed looking aft from the deck of the ship. When the ship is steaming in a straight line, mild two-off, that is, an angle of 10 or 15 degrees of the vertical as defined above, is usually acceptable. Tow-off above 15 degrees is somewhat objectionable because body depth is sacrificed, and the body itself may be out of position. This is important because while the sonar array within the body will signal the position of the target with respect to the body, if the position of the body with respect to the ship is not known, then neither is the position of the target with respect to the ship. Severe tow-off of 30 degrees or more is most objectionable, particularly if the ship is rolling in heavy seas, as this may cause the cable to bear heavily against the towing structure (saddle or boom), resulting in wracking of the structure and possible severe damage to the cable. Various means have been adopted to protect the cable, e.g., guide plates, as presently used on the AN/SQA 502 variable depth sonar currently in use in the Maritime Command of the Canadian Armed Forces; cable guide assemblies, as taught in Canadian Pat. No. 1,005,702 issued Feb. 22, 1977 to A. Kemeny, assigned to Ronyx Corporation Limited; and floating roller boxes, as taught in Canadian Pat. No. 923,378 issued Mar. 27, 1973 to N. E. Hale, granted to Fathom Oceanology Limited. All of these devices protect the fairings and cable to a greater or lesser degree, but do nothing to relieve wracking of the towing structure. Canadian Pat. No. 1,093,061, issued Jan. 6, 1981 to R. S. Norminton, assigned to Ronyx Corporation Limited, describes a fairlead sheave and saddle assembly which completely protects the cable and fairings, and relieves much of the towing structure from the wracking associated with tow-off forces. Details of this patent will be discussed more fully hereinafter.

With respect to the problems of fleet angle and fairing training, it is recognized that, in winch applications, it becomes necessary to reduce the fleet angle in order to obtain a proper laying of adjacent turns of cable upon the winch drum. For accurate reeling of cable, the cable should approach the drum at right angles which is to say, the fleet angle should be as close to zero as practicable.

Numerous methods of achieving a fleet angle as close to zero as practicable exist in mechanisms known as level winders. These in general comprise a travelling guide which moves laterally relative to the cable, i.e., in a direction parallel to the winch drum pivot axis, one pitch (distance between turns) for every revolution of the winch drum and through which the cable must pass prior to reaching the winch. Typical examples of movable guides for reducing the fleet angle are found in the structures illustrated in Canadian Pat. Nos. 692,070 and 707,634 issued, respectively, Aug. 4, 1964 and Apr. 13, 1965.

In towed sonar hoist systems, faired cables are generally employed and a fully reeled cable generally comprises a single layer upon the winch drum. In the case of towed sonar cables, the problem of spooling becomes more tenuous on account of the fairing that it carries for hydrodynamic anti-drag purposes.

Prior attempts have also been made to eliminate the cable guides in which case it has been proposed to move the winch drum during winding in the cable as exemplified by Canadian Pat. No. 655,052 issued Jan. 1, 1963 to Spider Staging, Incorporated. In the patented device, movement of the winch drum is responsive to tension applied to the cable, and, accordingly, the fleet angle in such structure will vary proportionally to changes in load. Such an arrangement is satisfactory where the cable is subjected to substantially contant loads. It is, however, unsatisfactory where the tension varies considerably in the cable, say, from winding in at one time to the tension in the same cable when being wound in at another time, and also where there is considerable variation in the tension in the cable during a winding operation.

Another successful means of keeping the fleet angle as close as possible to zero is taught in Canadian Pat. No. 1,005,702. By means of a careful orientation of the winch drum relative to the boom sheave throughout its travel and by means of limiting the width of the winch drum and by means of offsetting the boom assembly between 2° and 3°, preferably by 2°30′, the necessity of using any separate spooling apparatus is avoided. Consequently, from the extremes of having the boom fully extended with all cable either in or out, to bringing the boom fully inboard with all cable wound on the drum, the fleet angle is less than the critical 3° figure. This means that separate cable spooling is unnecessary and that the cable will wind onto the winch drum without further complication.

In many instances, experience has taught that the critical fleet angle is less than 3°, as low as 1½° or even less. This may be achieved through the use of level winders, which are troublesome and space consuming, or by one varient of Canadian Pat. No. 1,111,829 issued Nov. 3, 1981 to R. S. Norminton, assigned to Ronyx Corporation Limited, wherein the winch base is mounted on rollers and the entire winch translates linearly to minimize fleet angle.

Closely associated with the problem of fleet angle is the problem of fairing training. For while it is necessary to have a low fleet angle to ensure the faired cable winds onto and into the drum grooves properly without jumping, it is also necessary that the freely swivelling fairings remain upright as they are wound on in order that fairings in adjacent turns clash and damage or destroy one another. The problem of providing a fairing training device in conventional towing systems is made even more diffeicult by the fact that the cable never contacts the drum at the same angular positions. A look at FIG. D, included here from aforementioned Canadian Pat. No. 879,530 will confirm this. A line struck from the top of the towing sheave to the drum for every boom position shown will contact the drum at a different tangent point. This means that any fairing training device, in addition to fleeting across the face of the drum, must also follow around the drum.

With respect to the problems of storage of long tow cables, in towed sonar hoist systems, faired cables are generally employed and a fully reeled cable generally comprises a single layer upon the winch drum. In the case of towed sonar cables, the problem of spooling becomes more tenuous on account of the fairing that it carries for hydrodynamic anti-drag purposes.

The tailpieces of the segmented fairings are almost always made of light-weight plastic, and it is not possible to spool the cable in multiple layers onto a drum without crushing the fairings in all but the top layer. This means that, in usual practice, only single-layer winding could be used with a segmented fairing cable. If the cable is very long, the winding drum may be huge. This would cause topside weight and space problems, fleet angle problems and might necessitate the use of extra power.

A number of methods of circumventing these problems have een proposed in the past. For example, U.S. Pat. Nos. 2,397,957 issued Apr. 9, 1946 to H. B. Freeman; 2,401,783 issued June 11, 1946 to K. W. Wilcoxon; 3,209,718 issued Oct. 5, 1965 to R. L. Rather et al; and 3,241,513 issued Mar. 22, 1966 to R. L. Rather et al, all attempt to solve the problem by the use of removable fairings. With such fairings, the base cable can be spooled as a multi-layer onto a storage drum. However, a major disadvantage is that time is consumed stripping the fairings on cable recovery and installing the fairings during cable payout. This could be particularly difficult in high sea states. A problem also arises in storing the removed fairings without damage.

Canadian Pat. No. 902,577 issued June 13, 1972 to N. E. Hale proposed to solve the problem by using multiple concentric drums. However, there are many disadvantages inherent in a drum of this construction. Firstly, the outer drums must be slotted across the face of the shell and this may severly weaken the drums. Secondly, the cable or fairings or both may be severely damaged at the points of inflection in bridging the shell gaps. Thirdly, in one embodiment, one drum is connected to the other by short-stroke hydraulic cylinders connected up to a manifold system with quick-release connections. Frequent use of this method aboard ship will result in hydraulic spills, and contamination being introduced into the hydraulic system. In another embodiment, the outer drum is given motive power by wedging up the tailpieces of the fairings into contact with the roof of an access chamber in the outer drum. This may damage and crush the fairings.

It has also been suggested to use two concentric drums with unbroken shell faces which screw into one another. The major disadvantage of such proposal was that with all the cable paid out, the drums must be completely unscrewed, and in this condition they take up as much space and weight as the one single layer drum previously referred to and with a great increase in complexity.

Another proposal is shown in Canadian Pat. No. 671,172 issued Sept. 24, 1963 to Nautec Corporation which provided a level winding device disposed at right angles to a cable storage drum. A key feature of this invention was the use of pressure rollers to exert a squeezing force on the cable. It is virtually impossible to exert such a force on cable enclosed with segmental fairings for the purpose of gaining traction. In addition, such squeezing force might damage the fairings, which are somewhat fragile.

Yet another proposal was shown in Canadian Pat. No. 949,547 issued June 18, 1974 to American Chain and Cable Co. Inc. which provided a cable trained over a double capstan, with its other end extending through a guide into a cylindrical container disposed at right angles to the capstan. Key features of this proposal were the use of separate traction and storage drums. The storage drum and its drive alone would take up as much space as a single simple powered drum used for both power and storage. In other words, and aside from other drawbacks, as a means of spooling extra long lengths of segmentally faired cable (all in one single layer), the traction winch with separate storage drum is the most space-consuming solution of all, and there would be no room for it aboard most naval vessels.

A solution to the problem of storing very long lengths of faired tow cable without putting the cable itself at risk was taught in U.S. Pat. No. 4,312,496 issued Jan. 26, 1982 to R. S. Norminton, assigned to Fleet Industries. By such invention, a compound drum hoist was provided comprising: (a) a first cable-spooling drum rotatably and drivingly mounted on a first shaft; (b) a second cable-spooling drum nested within the first drum, and rotatably mounted on a second shaft disposed at an angle of 90°±30° but preferably at right angles to the first shaft; (c) means for rotating the second drum while keeping the first drum stationary, thereby to spool faired cable onto the second drum; and (d) means for substantially simultaneously rotating the first drum along with the second drum, thereby to spool faired cable onto the first drum.

Experience has shown that use of such method will reduce space somewhat, but at the expense of increased winch complexity.

With respect to the problems of storage of spare cable, it has been found, in practice, that the tow cable progressively deteriorates in service due to the combined effects of fatigue and corrosion. It has also been found that this deterioration is worst at the attachment point of the towed body to the tow cable. It is common practice when this happens to shorten the cable by cutting off a length of deteriorated end, reterminating it and re-attaching it to the towed body. However, only a few shortenings and reterminations can be made before the cable becomes too short to be serviceable. Accommodating extra cable on the deck handling equipment to allow a greater number of shortenings is space consuming, further aggravating the problem of shortage of space.

By the invention provided by Canadian Pat. No. 1,111,829 issued Nov. 3, 1981 to Robert S. Norminton, and assigned to Fleet Industries, a Division of Ronyx Corporation Limited, an improved hoist drum assembly was provided which included means for storing large excesses of faired towing cable for multiplicity of shortenings and reterminations, required to extend service life, which included a cable winder assembly associated therewith, and which included means for controlling the fleet angle of the cable as it is wound thereon. An improvement is provided in a system for launching, towing and recovering a towed body from a towing surface vessel using faired towing cable, the system including a hoist sub-assembly and a boom sub-assembly, the improvement comprising: a main winch drum in the hoist sub-assembly for storing live turns of the faired towing cable wound in a single layer in a first direction, which faired cable is adapted to be wound on and unwound off the main winch drum, the main winch drum including a slot magazine recessed into the interior thereof at one end therefor for storing dead, unfaired towing cable wound in multilayers in the same first direction thereof; the main winch drum including a single cable clamp completely inboard of all turns of the faired and unfaired cable and near the inboard end of the cable.

Thus, by an embodiment of that invention, the hoist sub-assembly includes a winch drum with a special annular and radial slot magazine at one end. This annular and radial magazine allows for spooling of a large excess of unfaired cable in several layers and takes up no more room than would be required by the normal number of "dead" turns left on a conventional drum for safety when all the faired cable has been paid out. The dead turns are wound on the slot magazine before the live faired turns have been wound on the winch drum. This annular and radial slot magazine allows for a multiplicity of shortenings and reterminations at the towed body and a significant prolongation of cable service life over that currently obtained. As the cable is shortened dead turns may be transferred to active turns witout release of either cable load or cable clamp during which filler pieces are introduced into the slot beneath the reduced number of layers.

With respect to the problems of cable tension measurement, it has long been wished that a continuous monitoring of cable tension could be obtained. This is particularly true in high sea states. to detect the onset of dangerous towing conditions. All AN/SQS-505 towed bodies currently in use in Maritime Command of the Canadian Armed Forces are now equipped with strain-gauged tow points, but the tension so measured is the lowest in the tow cable. Tension increases progressively up the cable, and is highest at the towing sheave at the ship. Since cable tensions at body and ship may change constantly one with respect to the other, ship-end tension cannot be considered to be some constant multiple of body-end tension. Ship-end tension cannot be measured directly at the cable, because no method has as yet been devised to grip the electromechanical cable without damaging or destroying the crush-sensitive electrical core. It cannot be measured accurately at the winch by means of pressure gauges or transducers, because they are too many frictional losses between winch or winch motor and towing sheave. In the system disclosed by Canadian Pat. No. 879,530, tension can be measured with great difficulty and complexity by strain-gauging the towing sheave shaft, boom or deflection roller. The complexity arises because strains so measured represent the vector sum of tensions around a sheave. As the angle of cable wrap changes, so does the vector sum even though the cable tension itself does not. The angle of cable wrap and the tension are forever changing with a boom-bobbing type of shock-absorbing system. Thus, any method of measuring cable tension on a system similar to that in Canadian Pat. No. 879,530 must measure vector sum of tensions around a-sheave, angle of wrap, and possibly boom angle as well, electronically combining and processing all these output signals to arrive at a final true cable tension.

Cable tension at the ship becomes of primary importance when it is used as a primary reference signal for active or partially active shock-absorbing means. It is possible to use acceleration methods instead, but accelerometer signals must be further processed to be useful. Since the purpose of shock absorbing is to attenuate cable tension variations, it is far better to use cable tension directly as a primary reference signal for a closed loop feedback servo type of active or partially active shock-absorbing system.

SUMMARY OF THE INVENTION (i) Aims of the Invention

In the light of these problems, therefore, objects of aspects of the present invention include the solving of the following problems:

(a) compactly spooling enormous lengths of faired cable in a minimum space;

(b) attaining near zero fleet angle;

(c) providing a simple and effective fairing training device;

(d) providing shock-absorbing with zero cable excursion over the sheaves;

(e) obtaining cable tension at the ship independent of cable wrap angles around the towing sheave, which provides a viable direct primary reference for active or partially active shock-absorbing; and (g) accommodation of high tow-off angles without any risk of cable damage.

(ii) Statements of the Invention

By one embodiment of this invention, a compact towing system is provided which is adapted to be mounted on a ship for towing an underwater towed body using faired tow cable, comprising: (a) a trucked gantry adapted to be driven in a fore and aft direction; (b) a lower saddle adapted to be disposed inside the confines of the trucked gantry when the gantry is driven aft; (c) a winch drum with fixed foundations and with the centreline thereof extending approximately fore and aft along the ship; (d) a boom having an inner end and an outer end, the inner end being hinged on a hollow pivot on the trucked gantry; (e) a pivotable deflection sheave mounted inside the boom, the pitch radius of the sheave being tangent to the centreline of the hollow pivot; (f) a fairlead sheave and saddle assembly, the assembly being mounted on a carriage which is adapted to be driven along the boom; (g) means for driving the trucked gantry in synchronism with the winch drum, the driving of the trucked gantry (a) fore and aft being so related to the winding and unwinding of cable from the winch drum (b) that, as the trucked gantry traverses between a forward stow position and an aft full cable-out position, a zero degree fleet angle is obtained and maintained between the two cable and the winch drum; (h) means for driving the driven carriage to traverse the carriage along the boom only during launch and recovery in synchronism with the winch drum so that, as the cable unwinds, the carriage is driven towards the outer end of the boom, so that the fairlead sheave and saddle assembly overhangs the outer end of the boom, and as the cable winds, the carriage is driven towards the inner end of the boom, so that the fairlead sheave and saddle assembly lines along the boom; whereby, in operation, the cable passes from the winch drum, through a fairing training device, through the hollow boom pivot, around the deflection sheave, along the boom, through the fairlead sheave which is mounted on the driven carriage. and thence to the towed body.

In such compact towing system, the trucked gantry comprises a rectangular chassis having means on which the wheels are mounted, and a pair of upright, spaced-apart arms, the arms having aligned apertures therethrough; and the boom comprises an inner boom and an outer boom assembly.

In such compact towing system the trucked gantry comprises a rectangular chassis having means on which the wheels are mounted, and a pair of upright, spaced-apart amrs, the arms having aligned apertures therethrough; and wherein the boom comprises a single, unitary boom, the inboard end thereof being pivotally mounted to the trucked gantry through a pair of spaced-apart boom pivot stub shafts, at least the shaft closest to the drum being hollow.

In such compact towing system, the boom has an inner end and an outer end, the inner end being hinged on a hollow pivot and a fairlead sheave and saddle assembly, the assembly being mounted on a carriage which is adapted to be driven along the boom.

In such compact towing system, the trucked gantry comprises a rectangular chassis having means on which are mounted, and a pair of upright, spaced-apart arms, the arms having aligned apertures therethrough; wherein the lower saddle has an arcuate shape in side elevations, and a curved lower surface in cross-section; and wherein the winch drum comprises a hollow drum provided with a plurality of internal stiffening rings to prevent buckling.

In such compact towing system, the pivotable deflection sheave is mounted on a tilting carriage, which itself is mounted on a boom pivot, the tilting carriage being disposed transverse to the boom pivot.

(iii) Other Features of the Invention

By one feature of this invention, the trucked gantry comprises a rectangular chassis having means on which wheels are mounted, and a pair of upright, spaced-apart arms, the arms having aligned apertures therethrough.

By another feature of this invention, the means is provided with a pair of fore and rear pivotally mounted bogey arms, each bogey arm having a fore and an aft free-wheeling wheel mounted thereon.

By yet another feature of this invention, the aft end of the trucked gantry is provided with aligned pivot apertures.

By a further feature of this invention, the fore and aft portions at each side of the trucked gantry are provided with free-wheeling bumper wheels.

By a still further feature of this invention, the upright space-apart arms are provided, in each aperture with hollow pivot stub shafts, located within pivot bushings.

By yet a further feature of this invention, the trucked gantry runs on tracks mounted on a deck of the ship on either side of the lower saddle.

By one feature of this invention, the wheels are captured above and below on hardened inserts within the tracks.

By another feature of this invention, the trucked gantry is driven by driven longitudinally extending, parallel, spaced-apart threaded screws engaging associated threads on the trucked gantry.

By yet another feature of this invention, the screws are driven by a roller chain entraining tooghed wheels on one screw on the winch drum, the other screw being driven by an auxiliary roller chain entraining respective toothed wheels on the screws.

By a further feature of this invention, one end of the screws is supported on bearing pillow blocks, and the other end of each of the screws is supported in roller bearing pillow blocks, preferably on a deck of the ship.

By a still further feature of this invention, the bearing pillow blocks are attached to the sides of the lower saddle, and the roller bearing pillow blocks are on a deck of the ship.

By yet a further feature of this invention, the lower saddle has an arcuate shape in side elevation, and has a curved lower surface in cross section.

By one feature of this invention, the winch drum comprises a hollow drum provided with a plurality of internal stiffening rings to prevent buckling.

By another feature of this invention, the winch drum is supported on rollers and is driven by an internal gear drive or by an external gear drive.

By yet another feature of this invention, the internal gear drive includes an internal spur gear secured to one stiffening ring, a hydraulic drive motor driving a spur pinion meshing with the internal spur gear, and a brake assembly.

By a further feature of this invention, the winch drum includes an internal storage drum magazine.

By a still further feature of this invention, the driving of the trucked gantry fore and aft is so related to the winding and unwinding of cable from the winch drum that, as the trucked gantry transverses between a forward stow position and an aft full cable-out position, a zero degree fleet angle is obtained and maintained between the tow cable and the winch drum.

By yet a further feature of this invention, the boom comprises an inner boom and an outer folding boom assembly.

By one feature of this invention, the inner boom comprises a pair of spaced-apart main frames, reinforced by an upper longitudinal trussworks interconnected to one another by transverse interconnecting arms.

By another feature of this invention, the outer boom comprises a pair of transversely spaced-apart, longitudinally extending ways, the ways being interconnected to a longitudinal bracing assembly and to a transverse bracing arm, the ways being spanned by a fairlead carriage drive.

By yet another feature of this invention, the spaced-apart aligned gear racks are set into the main frames and the ways respectively.

By a further feature of this invention, the inner boom is pivotally mounted to the trucked gantry through a pair of spaced-apart boom pivot stub shafts associated with the trucked gantry, at least the shaft closest to the drum being hollow.

By a still further feature of this invention, the pivot stub shafts are located within pivot bushings in aligned pivot apertures in upright spaced-apart arms on the trucked gantry.

By yet a further feature of this invention, the inner boom is driven to pivot about the boom pivot stub shaft by means of a pair of boom actuation hydraulic cylinders spanning the space between the aft end of the trucked gantry and the inner boom.

By one feature of this invention, the outer boom is driven to fold with respect to the inner boom means of at least one boom folding hydraulic cylinder disposed between the aft end of the inner boom and the fore end of the outer folding boom.

By another feature of this invention, the boom comprises a single, unitary boom, the inboard end thereof being pivotally mounted to the trucked gantry through a pair of spaced-apart boom pivot stub shafts, associated with the trucked gantry, at least the shaft closest to the drum being hollow.

By yet another feature of this invention, the stub shafts are located with pivot bushings in aligned pivot apertures in upright spaced-apart arms on the trucked gantry.

By a further feature of this invention, both the inboard section of the boom and the outboard section of the boom comprise a pair of spaced-apart main frames, reinforced by an upper longitudinal trussworks interconnected to one another by transverse interconnecting arms, the outboard section of the boom also including a pair of transversely spaced-apart, longitudinally extending ways, the ways being interconnected to a longitudinal bracing assembly and to a transverse bracing arm, the ways being spanned by a fairlead carriage drive.

By a still further feature of this invention, the spaced-apart aligned gear racks are set into the main frames.

By yet a further feature of this invention, the boom is driven to pivot about the pivot stub shafts by means of a pair of boom actuation hydraulic cylinders spanning the space between the aft end of the trucked gantry and the inboard section of the boom.

By one feature of this invention, the pivotable deflection sheave is supported by a tilting carriage assembly, the assembly being mounted on the boom pivot and being disposed transverse to the boom pivot.

By aother feature of this invention, the deflection sheave includes a strain gauge assembly associated therewith.

By yet another feature of this invention, the tilting carriage assembly comprises a pair of pivoting clevises, mounted on the boom pivot stub shaft, a pair of links straddling the deflection sheave and pivoted at one end to an associated pivoting clevis and at the other end to the deflecting sheave shaft or bearing, and a strain gauge associated with each link.

By a further feature of this invention, the towing sheave of the sheave and saddle assembly comprises a hood partially housed free-wheeling sheave, thereby to provide a circular throat for the passage of faired cable therethrough, and means mounting the forward end of the hood on the frame of the carriage.

By a still further feature of this invention, the system includes a hydraulically-actuated fairlead locking pin for selective prevention of swivelling of the hood.

By yet a further feature of this invention, the saddle of the sheave and saddle assembly comprises a hydraulically pivoted, open forethroat saddle having an aft cross-member ballasted with high density material.

By one feature of this invention, the towing sheave of the sheave and saddle assembly comprises a hood partially housed free-wheeling sheave, thereby to provide a circular throat for the passage of faired cable therethrough, and means mounting the forward end of the hood on the frame of the carriage, including a hydraulically-actuated fairland locking pin for selective prevention of swivelling of the hood; the saddle assembly of the towing sheave and saddle assembly comprising a hydraulically pivoted, open forethroat saddle having an aft cross-member ballasted with high density material.

By another feature of this invention, the hood acts as an anti-jump device; the tow sheave is adapted freely to pivot in the plane of the sterm of the ship; the pivoting hood is locked to prevent swivelling during launch and recovery; the faired cable passes through a mounting tube on the frame of the carriage and through the throat of the pivoting hood; and, during free fairleading, the saddle is tilted up until its raised centre of gravity reaches the point that weight distribution about the fore and aft throat of the hood is balanced.

By yet another feature of this invention, the carriage of the sheave and saddle assembly has a frame, on which is mounted free running wheels paired with drive gears meshing with spaced-apart gear racks on the boom.

By a further feature of this invention, the gears are driven by a carriage-mounted hydraulic motor and brake assembly.

By a still further feature of this invention, the drive from the hyraulic motor is from a constant speed hydraulic motor through speed reducers.

By yet a further feature of this invention, the towing sheave of the sheave and saddle assembly comprises a hood partially housed free-wheeling sheave, thereby to provide a circular throat for the passage of faired cable therethrough, and means mounting the forward end of the hood on the frame of the carriage, including a hydraulically-actuated fairlead locking pin for selected prevention of swivelling of the hood; the saddle assembly comprising a hydraulically pivoted, open forethroat saddle having an aft cross-member ballasted with high density material; the carriage having a frame, on which is mounted free running wheels and drive wheels secured to driven gears meshing with spaced-apart racks on the boom; the gears being driven by a carriage mounted hydraulic motor and brake assembly.

By one feature of this invention, the system includes means to traverse the carriage along the boom only during launch and recovery.

By another feature of this invention, the cable is directed through a horizontal opening in the fore-and-aft bulkhead of the ship the opening including a sliding curtain and a fairing training device comprising a scroll tube to catch tilted fairings and to hold them upright until they are captured against the grooves on the drum, the scroll tube being mounted on a framework, held and sliding within a fixed frame attached preferably to the fore on a aft bulkhead openings of the ship, the curtain each having one end anchored to the ends of the slip opening and the other end attached to the sliding training device, whereby as the training devices moves to one end of the slit the curtains at that end convolute into folds while the other curtain pulls out straight, and vice versa the curtains preferably being mounted on top and boom rollers.

By yet another feature of this invention, the boom is provided with a fully passive boom bobbing system.

By a further feature of this invention, the boom bobbing system comprises gas accumulators in parallel to the head ends of boom actuators through a throttling valve, and throttling means for providing progressive additional throttles above the plus 14 degree and below the minus 10 degree boom position.

By a still further feature of this invention, the throttling means comprises cushions in boom cylinders.

By yet a further feature of this invention, the throttling means comprises a deceleration valve which is cam-actuated from the boom pivot.

By one feature of this invention, the system includes a main hydraulic system to operate the winch and the fairlead sheave and saddle assembly.

By another feature of this invention, the system includes an auxiliary power unit to operate the boom.

By yet another feature of this invention, the auxiliary power unit is used in a system for passive shock absorption.

By a further feature of this invention, the auxiliary power unit is used in a system for active assist to passive shock absorption.

By one feature of this invention, the means is provided with a pair of fore and rear pivotally mounted bogey arms, each bogey arm having a fore and an aft free wheeling wheel mounted thereon.

By another feature of this invention, the means is provided with a pair of fore and rear pivotally mounted bogey arms, each bogey arm having a fore and aft free-wheeling wheel mounted thereon, and the aft end of the trucked gantry is provided with aligned apertures.

By yet another feature of this invention, the fore and aft portions at each side of the trucked gantry are provided with free-wheeling bumper wheels.

By a further feature of this invention, the upright spaced-apart arms are pvoided, in each aperture, with pivot stub shafts, located within pivot bushings, at least the shaft closest to the drum being hollow.

By still a further feature of this invention, the trucked gantry runs on a pair of spaced-apart, parallel tracks mounted on a deck of the ship.

By yet a further feature of this invention, the trucked gantry runs on a pair of spaced-apart, parallel tracks mounted on a deck of the ship; and the wheels are captured above and below on hardened inserts within the tracks.

By one feature of this invention, the trucked gantry runs on a pair of spaced-apart, parallel tracks mounted on a deck of the ship; and the trucked gantry is driven by driven, longitudinally-extending, parallel, spaced-apart threaded screws engaging associated threads on the trucked gantry.

By another feature of this invention, the trucked gantry runs on a pair of spaced-apart parallel tracks mounted on a deck of the ship; the trucked gantry is driven by driven, longitudinally extending, parallel, spaced-apart threaded screws engaging associated threads on the trucked gantry; and the screws are driven by a roller chain entraining toothed wheels on the screw, the other screw being driven by an auxiliary roller chain entraining respective toothed wheels on the screws.

By yet another feature of this invention, the trucked gantry runs on a pair of spaced-apart, parallel tracks mounted on a deck of the ship; the tracked gantry is driven by driven, longitudinally extending, parallel, spaced-apart threaded screws engaging associated threads on the trucked gantry; and one end of each of the screws is supported on bearing pillow blocks and the other end of each the screws is supported in roller bearing pillow blocks.

By a further feature of this invention, the inner boom is pivotally mounted to the trucked gantry through a pair of spaced-apart boom pivot stub shafts associated with the trucked gantry, at least the shaft closest to the drum being hollow.

By a still further feature of this invention, the pivot stub shafts are located with pivot bushings in aligned pivot apertures in upright spaced-apart arms on the trucked gantry.

By yet a further feature of this invention, the inner boom comprises a pair of spaced-apart main frames, reinforced by an upper longitudinal trussworks interconnected to one another by transverse interconnecting arms.

By one feature of this invention, the outer boom comprises a pair of transversely spaced-apart, longitudinally extending ways, the ways being interconnected to a longitudinal bracing assembly and to a transverse bracing arm, the ways being spanned by a fairlead carriage drive.

By another feature of this invention, spaced-apart aligned gear racks are set into the main frames and the ways respectively.

By yet another feature of this invention, the inner boom is driven to pivot about the boom pivot stub shaft by means of at least the pair of boom actuation hydraulic cylinders spanning the space between the aft end of the trucked gantry and the inner boom.

By a further feature of this invention, the outer boom is driven to fold with respect to the inner boom by means of at least one boom folding hydraulic cylinder disposed between the aft end of the inner boom and the fore end of the outer folding boom.

By a still further feature of this invention, both the inboard section of the boom and the outboard section of the boom comprises a pair of spaced-apart main frames, reinforced by an upper longitudinal trussworks interconnected to one another by transverse interconnecting arms and the outboard section of the boom also includes a pair of transversely spaced-apart, longitudinally extending ways, the ways being interconnected to a longitudinally bracing assembly and to a transverse bracing arm, the ways being spanned by a fairlead carriage drive.

By yet a further feature of this invention, spaced-apart aligned gear racks are set into the main frames.

By one feature of this invention, the boom is driven to pivot about the pivot stub shaft by means of at least one boom actuating hydraulic cylinder spanning the space between the aft end of the trucked gantry and the inboard section of the boom.

By one feature of this invention, the boom comprises an inner and an outer folding boom assembly.

By another feature of this invention, the inner boom comprises a pair of spaced-apart main frame, reinforced by an upper longitudinal trussworks being interconnected to one another by transverse interconnecting arms.

By yet another feature of this invention, the outer boom comprises a pair of transversely spaced-apart, longitudinally extending ways, the ways being interconnected to a longitudinal bracing assembly and to a transverse bracing arm, the ways being spanned by a fairlead carriage drive.

By a further feature of this invention, the spaced-apart aligned gear racks are set into the main frames and the ways respectively.

By a still further feature of this invention, the boom comprises a single, unitary boom, the inboard end thereof being pivotally mounted to the trucked gantry through a pair of spaced-apart boom pivot stub shafts, at least the shaft closest to the drum being hollow.

By yet a further feature of this invention, both the inboard section of the boom and the outboard section of the boom comprises a pair of spaced-apart main frames, reinforced by an upper longitudinal trussworks interconnected to one another by transverse interconnecting arms and the outboard section of the boom also includes a pair of transversely spaced-apart, longitudinally extending ways, the ways being interconnected to a longitudinal bracing assembly and to a transverse bracing arm, the ways being spanned by a fairland carriage drive.

By one feature of this invention, the towing sheave of the sheave and saddle assembly comprises a hood partially housed free-wheeling sheave, thereby to provide a circular throat for the passage of faired cable therethrough; and means mounting the forward end of the hood on the frame of the carriage.

By another feature of this invention, the towing sheave of the sheave and saddle assembly comprises a hood partially housed free-wheeling sheave, thereby to provide a circular throat for the passage of faired cable therethrough; and means mounting the forward end of the hood on the frame of the carriage; and further including a hydraulically-actuated fairlead locking pin for selective prevention of swivelling of the hood.

By yet another feature of this invention, the saddle of the sheave and saddle assembly comprises a hydraulically pivoted, open forethroat saddle having an aft cross-member ballasted with high density material.

By a further feature of this invention, the towing sheave of the sheave and saddle assembly comprises a hood partially housed free-wheeling sheave, thereby to provide a circular throat for the passage of faired cable therethrough, and means mounting the forward end of the hood on the frame of the carriage, the saddle of the sheave and saddle assembly comprising a hydraulically pivoted, open forethroat saddle having an aft cross-member ballasted with high density material; and further including a hydraulically-actuated fairlead locking pin for selective prevention of swivelling of the hood.

By a still further feature of this invention, the towing sheave of the sheave and saddle assembly comprises a hood partially housed free-wheeling sheave, thereby to provide a circular throat for the passage of faired cable therethrough, and means mounting the forward end of the hood on the frame of the carriage, the saddle of the sheave and saddle assembly comprising a hydraulically pivoted, open forethroat saddle having an aft cross-member ballasted with high density material and further including a hydraulically-actuated fairlead locking pin for selected prevention of swivelling of the hood, the hood acting an anti-jump device; the towing sheave being adapted freely to pivot in the plane of the sterm of the ship; the pivoting hood being locked to prevent swivelling during launch and recover; the faired cable passing through a mounting tube on the frame of the carriage and through the throat of the pivoting hood; and during free fairleading, the saddle being tilted up until its raised centre of gravity reaches the point that weight distribution about the fore and aft throat of the hood is balanced.

By yet a further feature of this invention, the carriage of the sheave and saddle assembly has a frame, on which is mounted free running wheels paired with gears meshing with the spaced-apart gear racks on the boom.

By one feature of this invention, the carriage of the sheave and saddle assembly has a frame, on which is mounted free running wheels paired with gears meshing with the spaced-apart gear racks on the boom; and the gears being driven by a carriage-mounted hydraulic motor and brake assembly.

By another feature of this invention, the carriage of the sheave and saddle assembly has a frame on which is mounted free running wheels paired with gears meshing with the spaced-apart gear racks on the boom; the gears being driven by a carriage mounted hydraulic motor and brake assembly; and further wherein the drive from the hydraulic motor is from a sonstant speed hydraulic motor through speed reducers.

By yet another feature of this invention, the towing sheave of the sheave and saddle assembly comprises a hood partially housed free-wheeling sheave, thereby to provide a circular throat for the passage of faired cable therethrough, and means mounting the forward end of the hood on the frame of the carriage; the saddle of the sheave and saddle assembly comprising a hydraulically pivoted, open forethroat saddle having an aft cross-member ballasted with high density material; further including a hydraulically-actuated fairlead locking pin for selected prevention of swivelling of the hood; the carriage of the assembly having a frame, on which is mounted free running wheels paired with gears meashing with the spaced-apart gear racks on the boom; and the gears being driven by a carriage-mounted hydraulic motor and brake assembly.

By a further feature of this invention, the towing sheave and saddle assembly comprises a hood partially housed free-wheeling wheave, thereby to provide a circular throat for the passage of faired cable therethrough, and means mounting the forward end of the hood on the frame of the carriage; the saddle of the sheave and saddle assembly comprises a hydraulically pivoted, open forethroat saddle having an aft cross-member ballasted with high density material, and further including a hydraulically-actuated fairlead locking pin for selected prevention of swivelling of the hood; the carriage of the assembly having a frame, on which is mounted free running wheels paired with gears meashing with the spaced-apart gear racks on the booom; the gears being driven by a carriage-mounted hydraulic motor and brake assembly; and further including means to traverse the carriage along the boom only during launch and recovery.

By one feature of this invention, the winch drum is supported on rollers and is driven by an internal gear drive.

By another feature of this invention, the winch drum is supported on rollers and is driven by an internal gear drive; the internal gear drive including an internal spur gear secured to one stiffening ring, a hydraulic drive motor driving a spur pinion meshing with the internal spur gear, and a brake assembly.

By yet another feature of this invention, the winch drum is driven using an external gear drive.

By a further feature of this invention, the winch drum includes an internal storage drum magazine.

By a still further feature of this invention, the means is provided with a pair of fore and rear pivotally mounted bogey arms, each bogey arm having a fore and an aft free-wheeling wheel mounted thereon.

By yet a further feature of this invention, the means is provided with a pair of fore and rear pivotally mounted bogey arms, each bogey arm having a fore and an aft free-wheeling wheel mounted thereon; and the fore and aft portions at each side of the trucked gantry being provided with free-wheeling bumper wheels.

By one feature of this invention, the trucked gantry runs on tracks mounted on a deck of the ship on either side of the lower saddle.

By another feature of this invention, the trucked gantry runs on tracks mounted on a deck of the ship on either side of the lower saddle; the trucked gantry being driven by driven longitudinally extending, parallel, spaced-apart threaded screws engaging associated threads on the trucked gantry.

By yet another feature of this invention, the trucked gantry runs on tracks mounted on a deck of the ship on either side of the lower saddle; the trucked gantry being driven longitudinally extending, parallel, spaced-apart threaded screws engaging associated threads on the trucked gantry; and the screws being driven by a roller chain entraining respective toothed wheels on one screw and on the winch drum, the other screws being driven by an auxiliary roller chain entraining respective toothed wheels on the screws.

By a further feature of this invention, the trucked gantry runs on tracks mounted on a deck of the ship on either side of the lower saddle; the trucked gantry being driven by driven longitudinally extending, parallel, spaced-apart threaded screws engaging associated threads on the trucked gantry; and one end of each of the screws being supported on bearing pillow blocks, attached to the sides of the lower saddle, and the other end of each of the screws being supported in roller bearing pillow blocks, on a deck of the ship.

By a still further feature of this invention, the driving of the trucked gantry fore and aft is so related to the winding and unwinding of cable from the winch drum that, as the trucked gantry traverses between a forward stow position and an aft full cable-out position, a zero degree fleet angle is obtained and maintained between the two cable and the winch drum.

By one feature of this invention, the boom comprises an inner boom and an outer folding boom assembly.

By another feature of this invention, the inner boom comprises a pair of spaced-apart main frames, reinforced by an upper longitudinal trussworks being interconnected to one another by transverse interconnecting arms.

By yet another feature of this invention, the outer boom comprises a pair of transversely spaced-apart, longitudinally extending ways, the ways being interconnected to a longitudinal bracing assembly and to a transverse bracing arm, the ways being spanned by a fairlead carriage drive.

By a further feature of this invention, the inner boom is pivotally mounted to the truck gantry through a pair of spaced-apart boom pivot stub shafts associated with the trucked gantry, at least the shaft closest to the drum being hollow.

By a still further feature of this invention, the pivot stub shafts are located within pivot bushings in aligned pivot apertures in upright spaced-apart rams on the trucked gantry.

By yet a further feature of this invention, the boom comprises a single, unitary boom, the inboard end thereof being pivotally mounted to the trucked gantry.

By one feature of this invention, both the inboard section of the boom and the outboard section of the boom comprise a pair of spaced-apart main frames, reinforced by an upper longitudinal trussworks interconnected to one another by transverse interconnecting arms, and the outboard section of the boom also including a pair of transversely spaced-apart, longitudinally extending ways, the ways being interconnected to a longitudinal bracing assembly and to a transverse bracing arm, the ways being spanned by a fairlead carriage drive.

By another feature of this invention, the boom comprises a single, unitary boom, the inboard end thereof being pivotally mounted to the trucked gantry through a pair of spaced-apart boom pivot stub shafts, associated with the trucked gantry, at least the shaft closest to the drum being hollow.

By yet a further feature of this invention, the stub shafts are located with pivot bushings in aligned pivot apertures in upright spaced-apart arms on the trucked gantry.

By a further feature of this invention, the inner boom is driven to pivot about the boom pivot stub shaft by means of a pair of boom actuated hydraulic cylinders spanning the space between the aft end of the trucked gantry and the inner boom.

By a still further feature of this invention, the outer boom is driven to fold with respect to the inner boom means of at least one boom folding hydraulic cylinder disposed between the aft end of the inner boom and the fore end of the outer folding boom.

By yet a further feature of this invention, the boom is driven to pivot about the pivot stub shaft by means of a pair of boom actuation hydraulic cylinders spanning the space between the aft end of the trucked gantry and the inboard section of the boom.

By one feature of this invention, the deflection sheave includes a strain gauge assembly associated therewith.

By another feature of this invention, the deflection sheave includes a strain gauge assembly associated therewith, and the tilting carriage assembly comprising a pair of pivoting clevises mounted on the boom pivot stub shaft, a pair of links straddling the deflection sheave and pivoted at one end each to an associated pivoting clevis and at the other end to the deflecting sheave shaft or bearing, and a strain gauge associated with each link.

By yet another feature of this invention, the boom is provided with a fully passive boom bobbing system.

By a further feature of this invention, the boom is provided with a fully passive boom bobbing system; wherein the boom bobbing system comprises gas accumulators in parallel to the head ends of boom actuators through a throttling valve; and including throttling means for providing progressive additional throttles above the plus 14 degree and below the minus 10 degree boom position.

By a still further feature of this invention, the boom is provided with a fully passive boom bobbing system; the boom bobbing system comprising gas accumulators in parallel to the head ends of the boom actuators through a throttling valve; including throttling means comprising cushions in boom cylinders for providing progressive additional throttles above the plus 14 degree and below the minus 10 degree boom position.

By yet a further feature of this invention, the boom is provided with a fully passive boom bobbing system; wherein the boom bobbing system comprises gas accumulators in parallel to the head ends of boom actuators through a throttling valve; and including throttling means comprising a deceleration valve, cam-actuated from the boom pivot for providing progressive additional throttles above the plus 14 and below the minus 10 degree boom position.

By one feature of this invention, the system includes an auxiliary power unit to operate the boom.

By another feature of this invention, the system includes an auxiliary power unit to operate the boom and the auxiliary power unit is used in a system for passive shock absorption.

By yet another feature of this invention, the system includes an auxiliary power unit to operate the boom and the auxiliary power unit is used in a system for active assist to passive shock absorption.

By a further feature of this invention, the system includes a main hydraulic system to operate the fairlead sheave and saddle assembly.

By a still further feature of this invention, the system includes a main hydraulic system to operate the winch.

BRIEF DESCRIPTION OF THE DRAWINGS

Many of the components used herein may take the form of well-known such components, as will be described with reference the accompanying drawings, in which:

FIGS. A–G relate to one form of a passive shock-absorbing system as described in Canadian Pat. No. 879,530 issued Aug. 31, 1971 to R.L.I. Fjarlie et al, assigned to her Majesty the Queen in right of Canada, with reference to the accompanying drawings in which:

FIG. A illustrates schematically, in side elevation, the relationship between a boom, an actuating hydraulic cylinder and high and low pressure accumulators;

FIG. B is a schematic illustration of the geometric relationship between a boom and its actuating cylinder;

FIG. C is a graph which includes a curve illustrating the cylinder pressure necessary to stabilize a constant boom load at various boom angles;

FIG. D is a view similar to FIG. B but illustrating a modification in the sheaving of the cable;

FIG. E is a graph illustrating the relationship of movement of the boom and the free end of the cable relating to the ship deck respectively for the arrangement in FIG. D;

FIG. F is a schematic representation of the basic element for effecting control of the shock absorber system; and FIG. G is a schematic representation of the pneumatic supply and control system.

Figure 1:
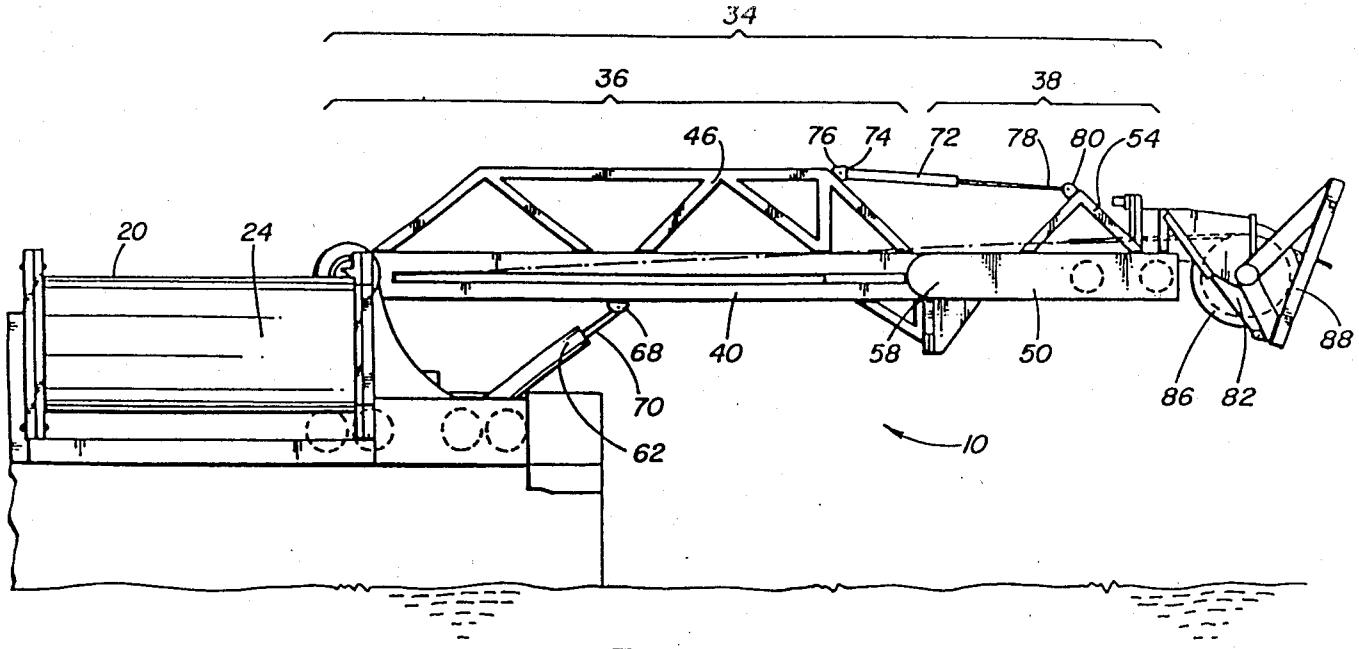

FIGS. H–M relate to an adaptation of the fairlead sheave and saddle described in Canadian Pat. No. 1,093,061 issued Jan. 6, 1981 to R. S. Norminton, assigned to Ronyx Corporation Limited with reference to the accompanying drawings in which:

FIG. H is a longitudinal cross-section through the fairlead and saddle in an aspect of the Norminton invention;

FIG. I is an outside longitudinal view similar to that shown in FIG. 1;

FIG. J is an outside longitudinal view showing the saddle and tow cable leaving the sheave in a normal towing situation; and FIGS. K, L and M show, schematically, aft views of the assembly in both pivoted and unpivoted positions during towing.

FIGS. N–P relate to an adaptation of the saddle described in Canadian Pat. No. 885,838, issued Nov. 16, 1971 to J. Meban, assigned to her Majesty the Queen in right of Canada with reference to the accompanying drawings in which:

FIG. N is a partial side elevational view of a towed body seated in a saddle constructed in accordance with the Meban invention;

FIG. O is an end elevational view of the saddle illustrated in FIG. N;

FIG. P is a diagrammatic illustration of the saddle.

FIGS. Q and R relate to a cable winder as taught in the aforesaid Canadian Pat. No. 856,639 with reference to the accompanying drawings, in which:

FIG. Q is a perspective view of a cable winder illustrating the main components in schematic form; and FIG. R is a partial sectional elevational view of the apparatus illustrated in FIG. Q, showing the condition when the main tow cable is largely reeled out.

Figure 2:
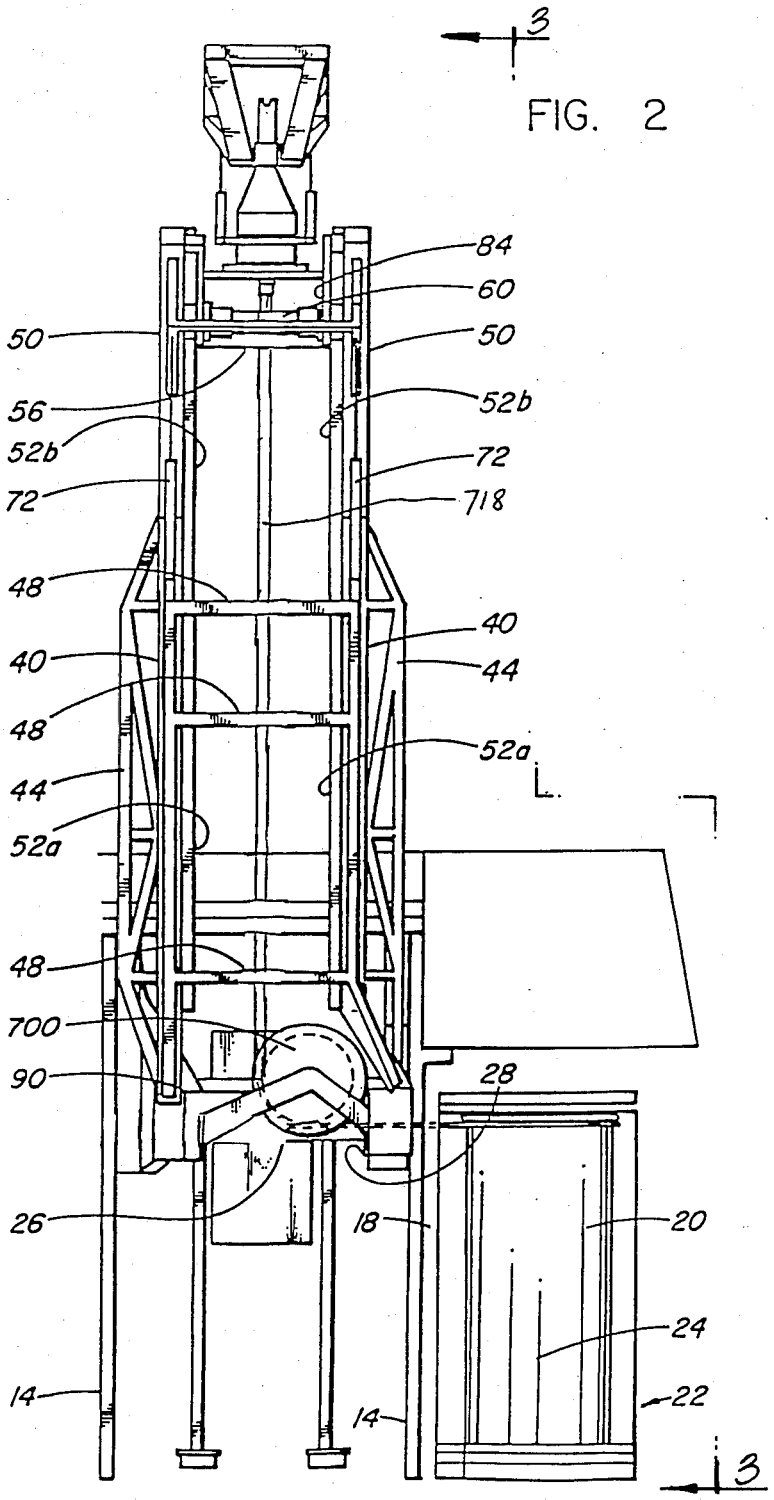
Figure 3:
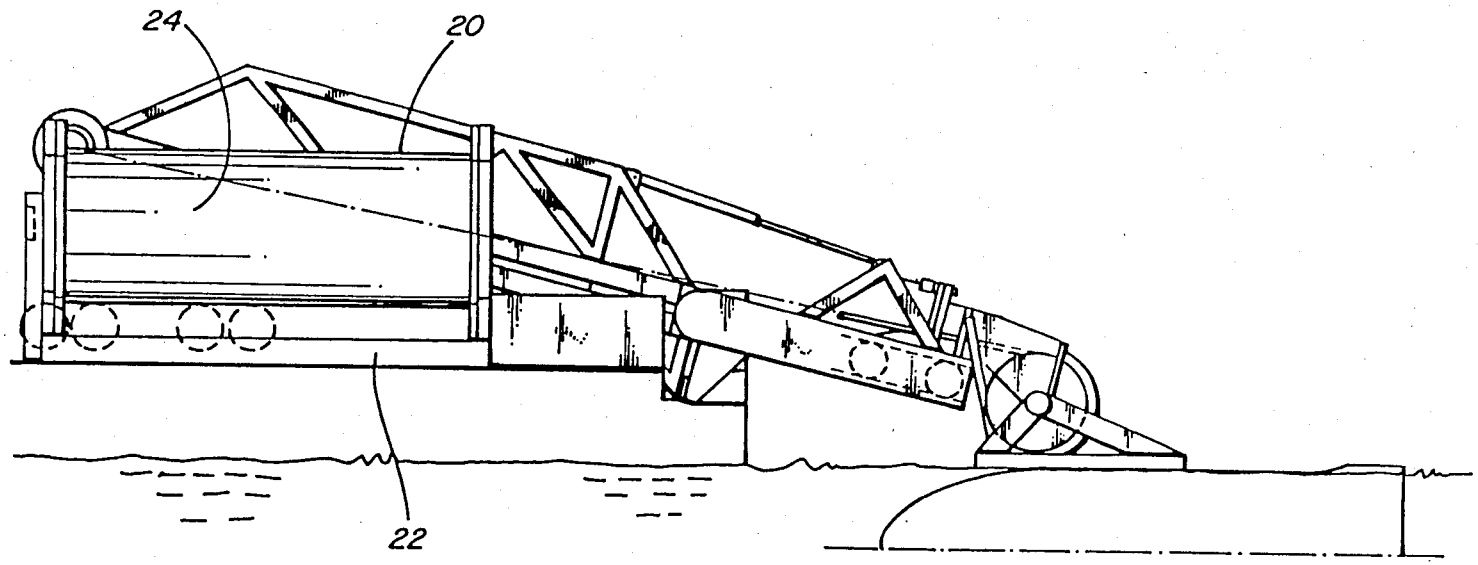
Figure 4:
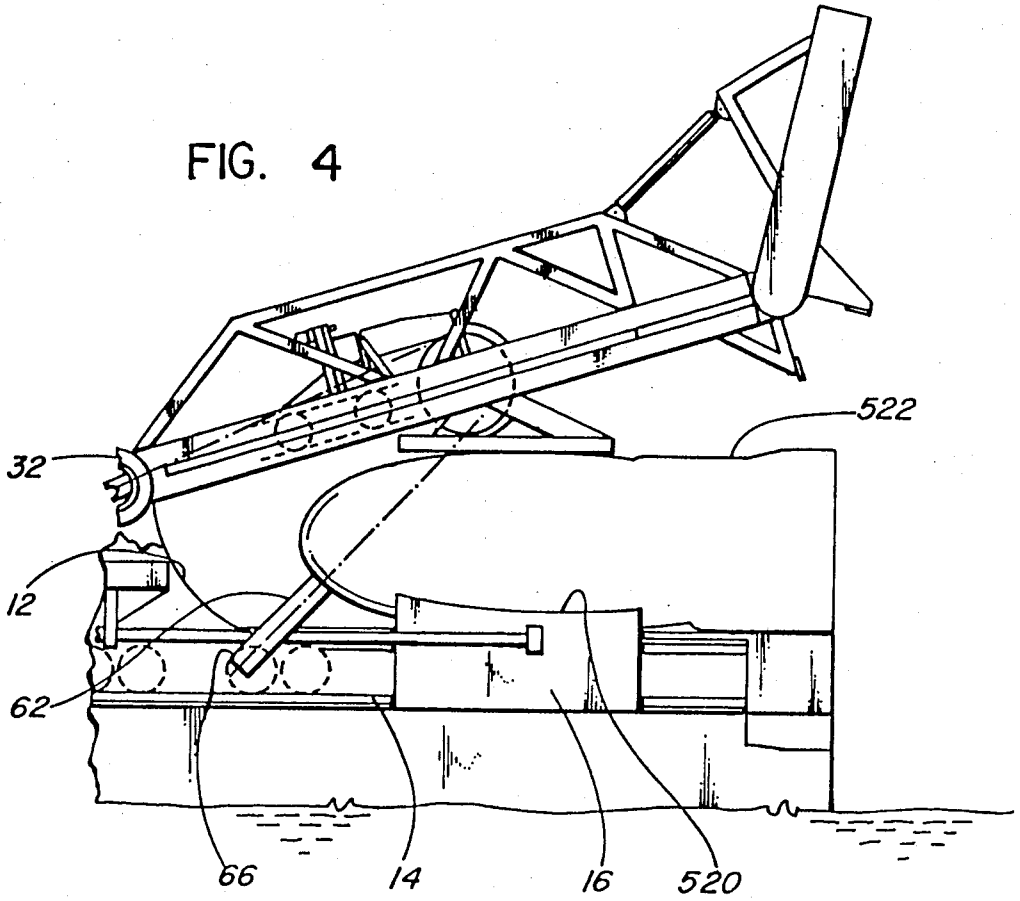
Figure 5:
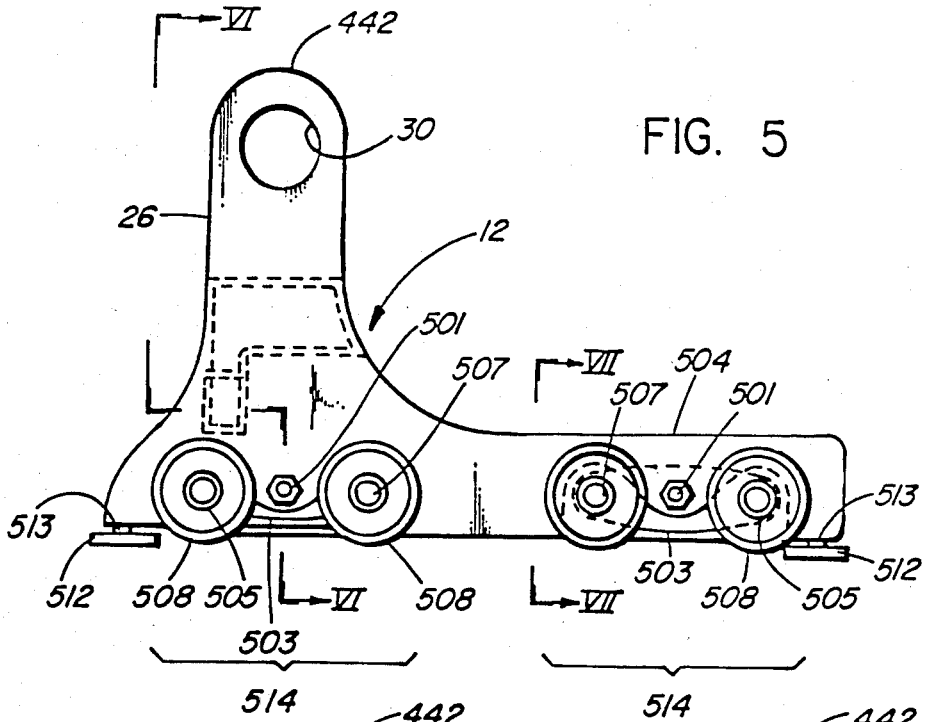
Figure 6:
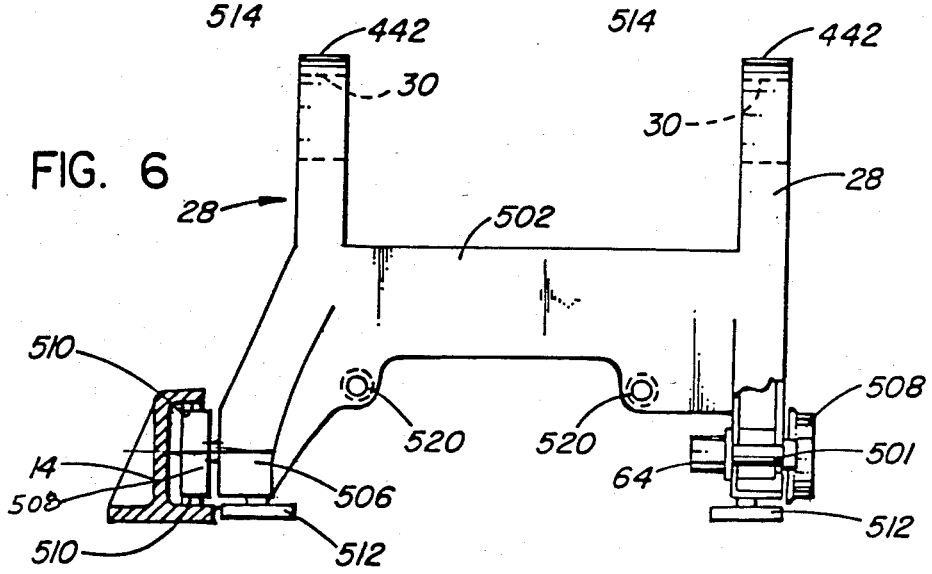
Figure 7:
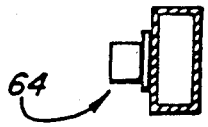
Figure 8:
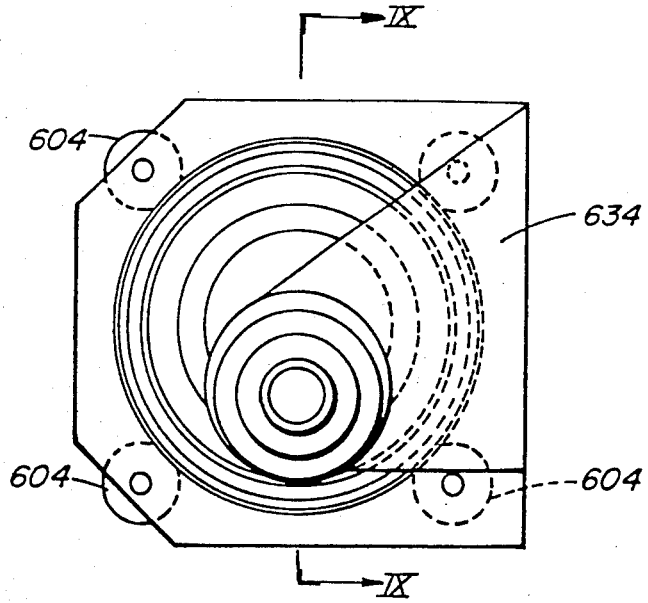
Figure 9B:
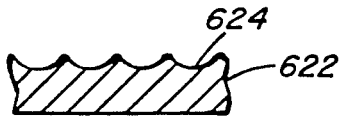
Figure 9A:
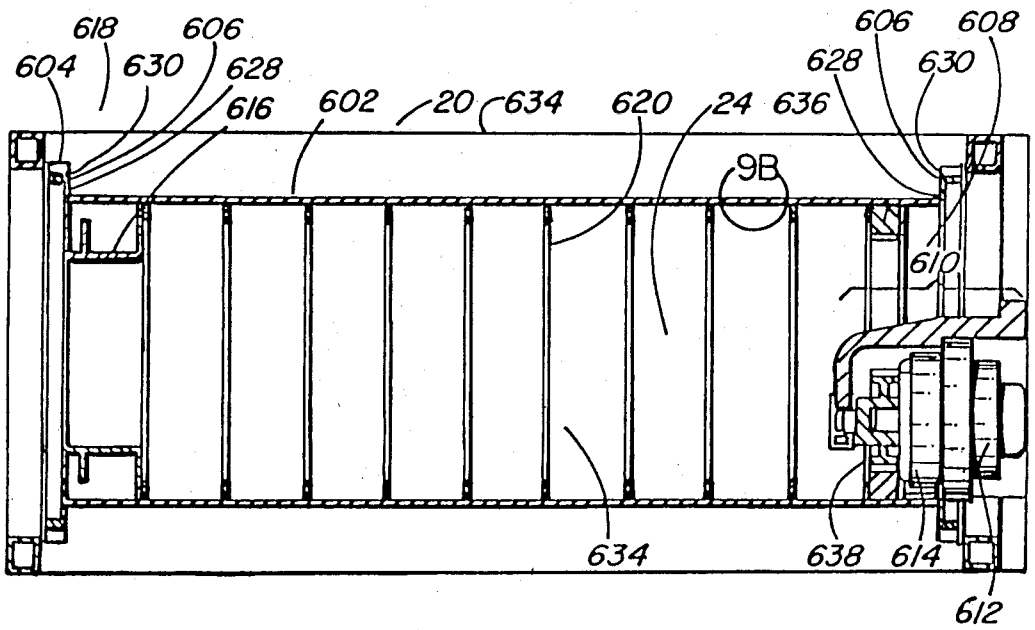
Figure 10:
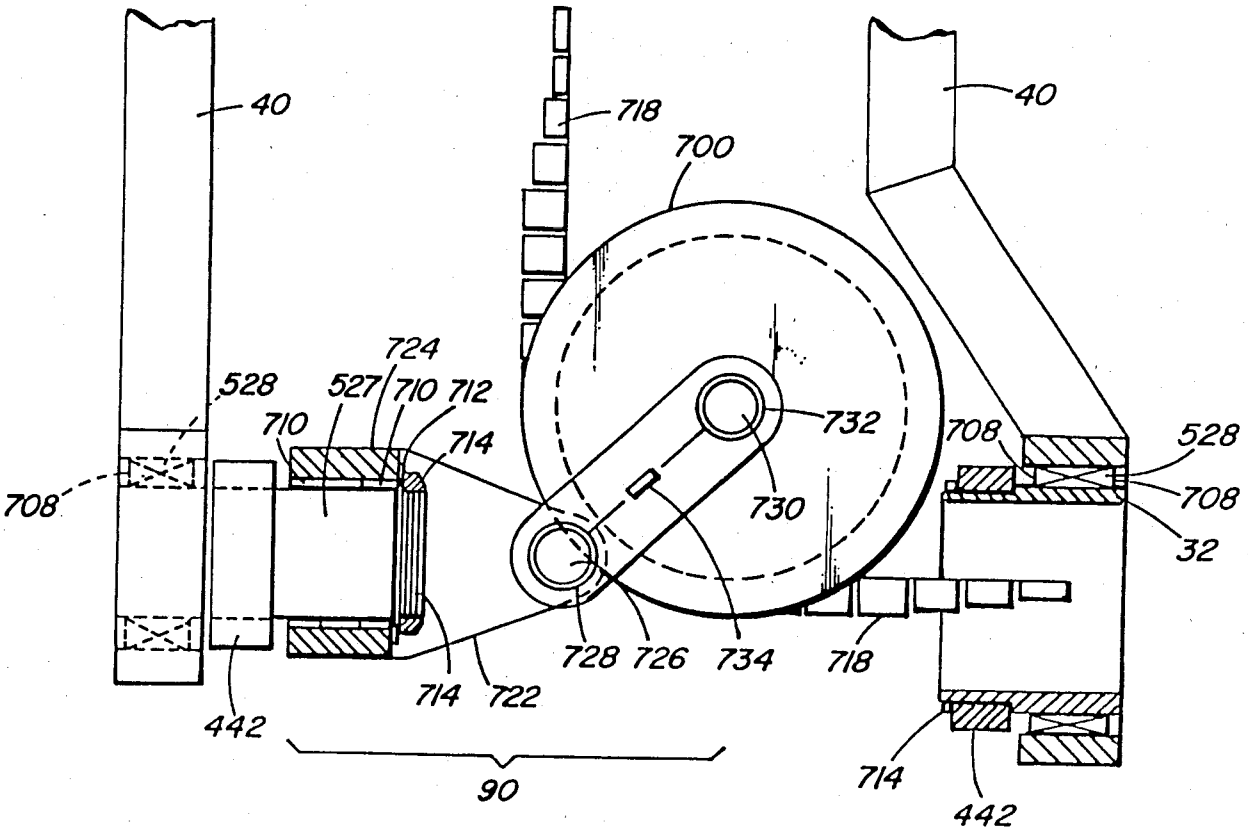
Figure 11:
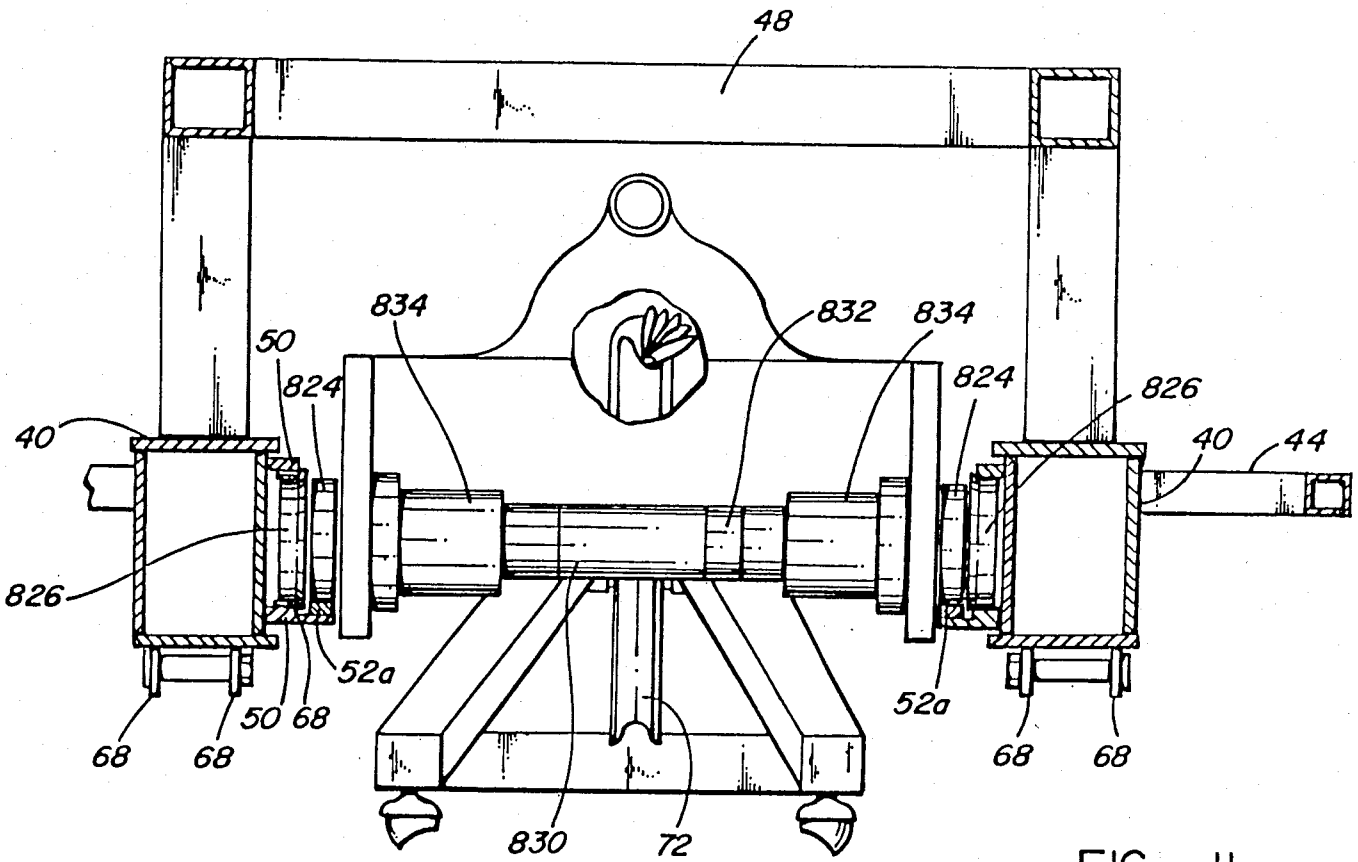
Figure 15:
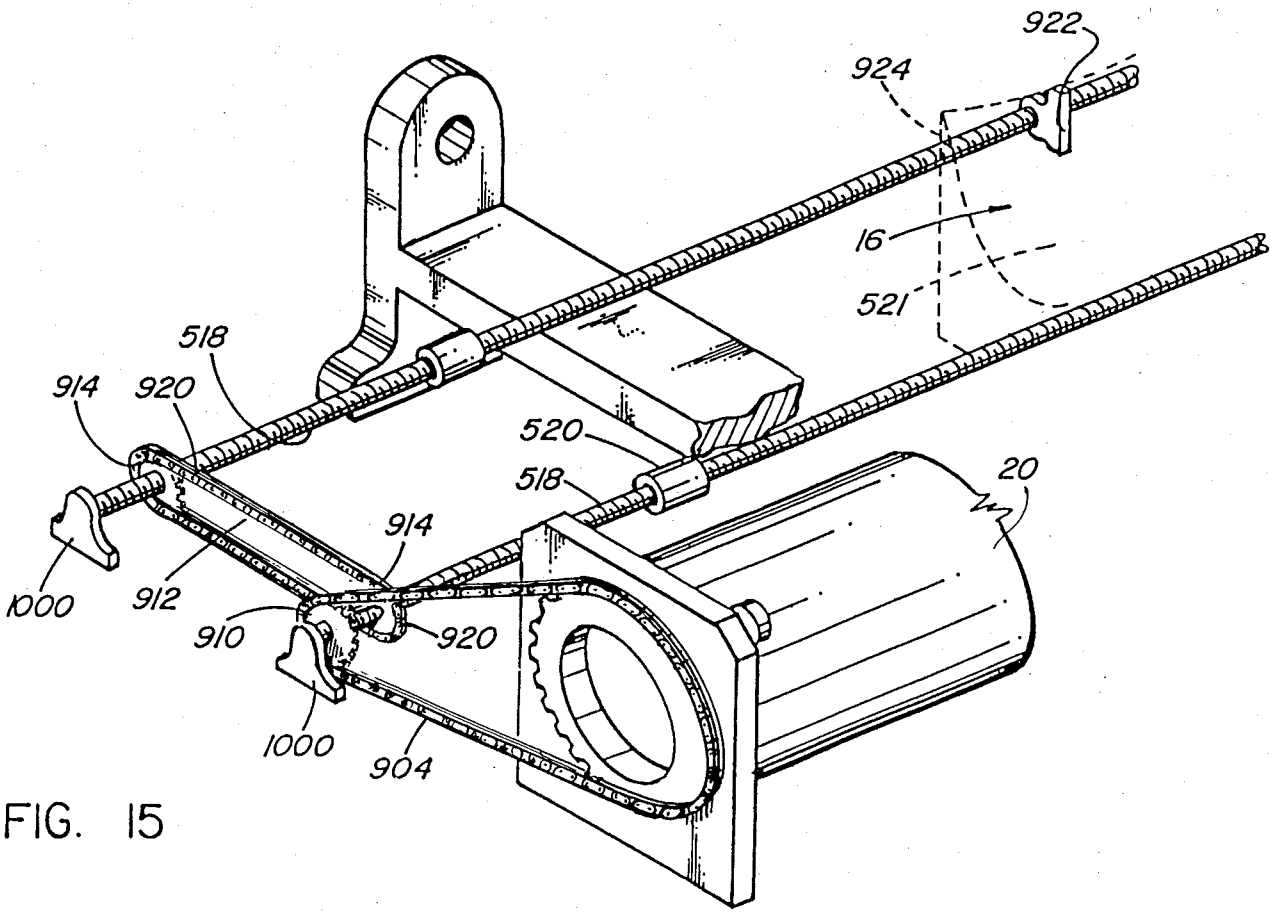
Figure 16:
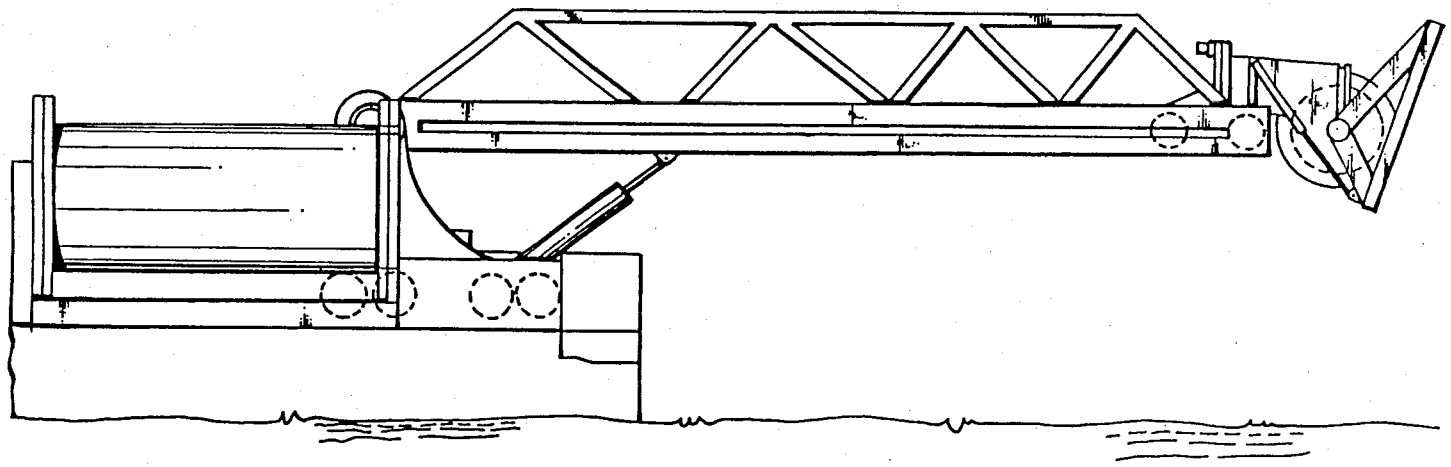
Figure 17:
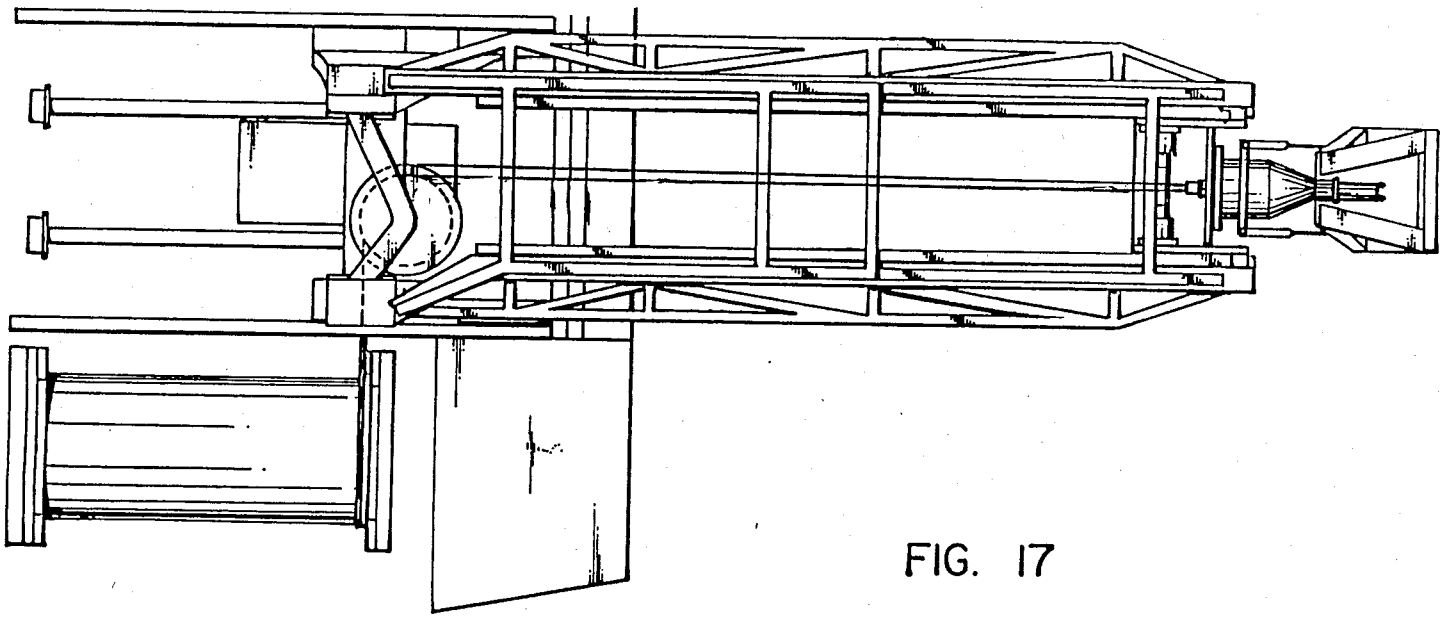
Figure 18:
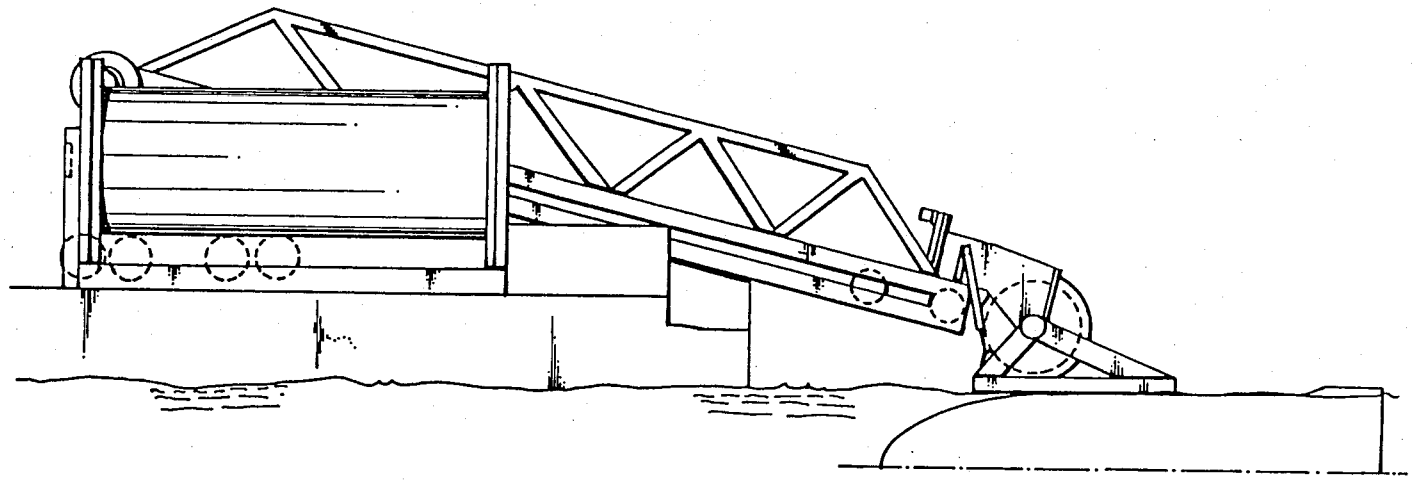
Figure 19:
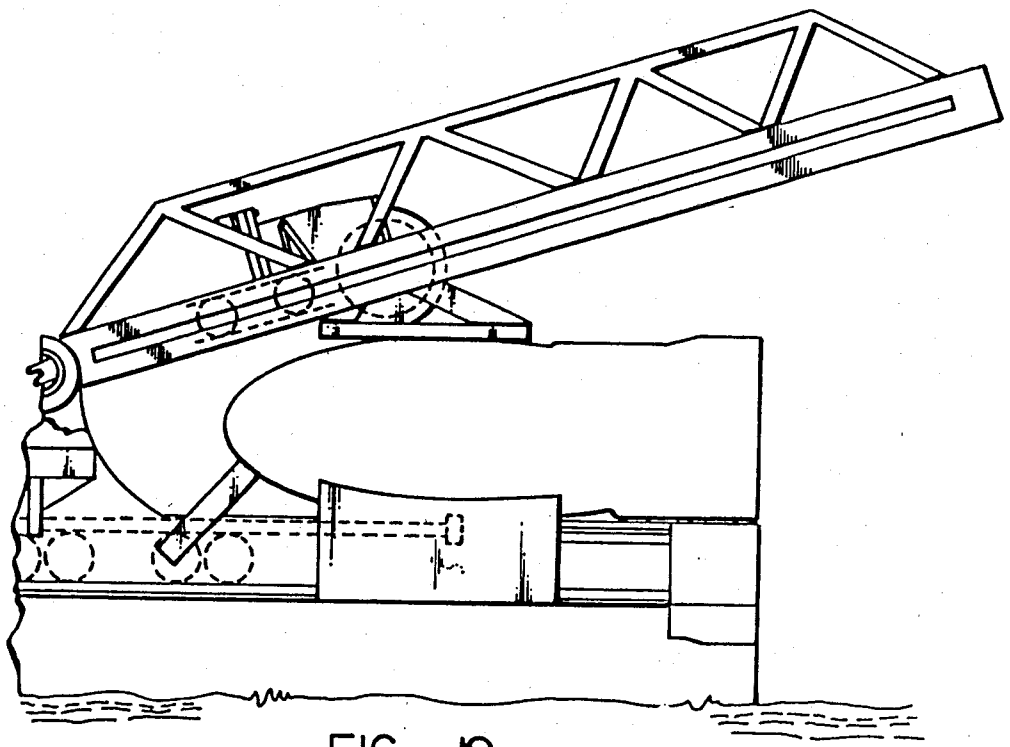
Figure 20:
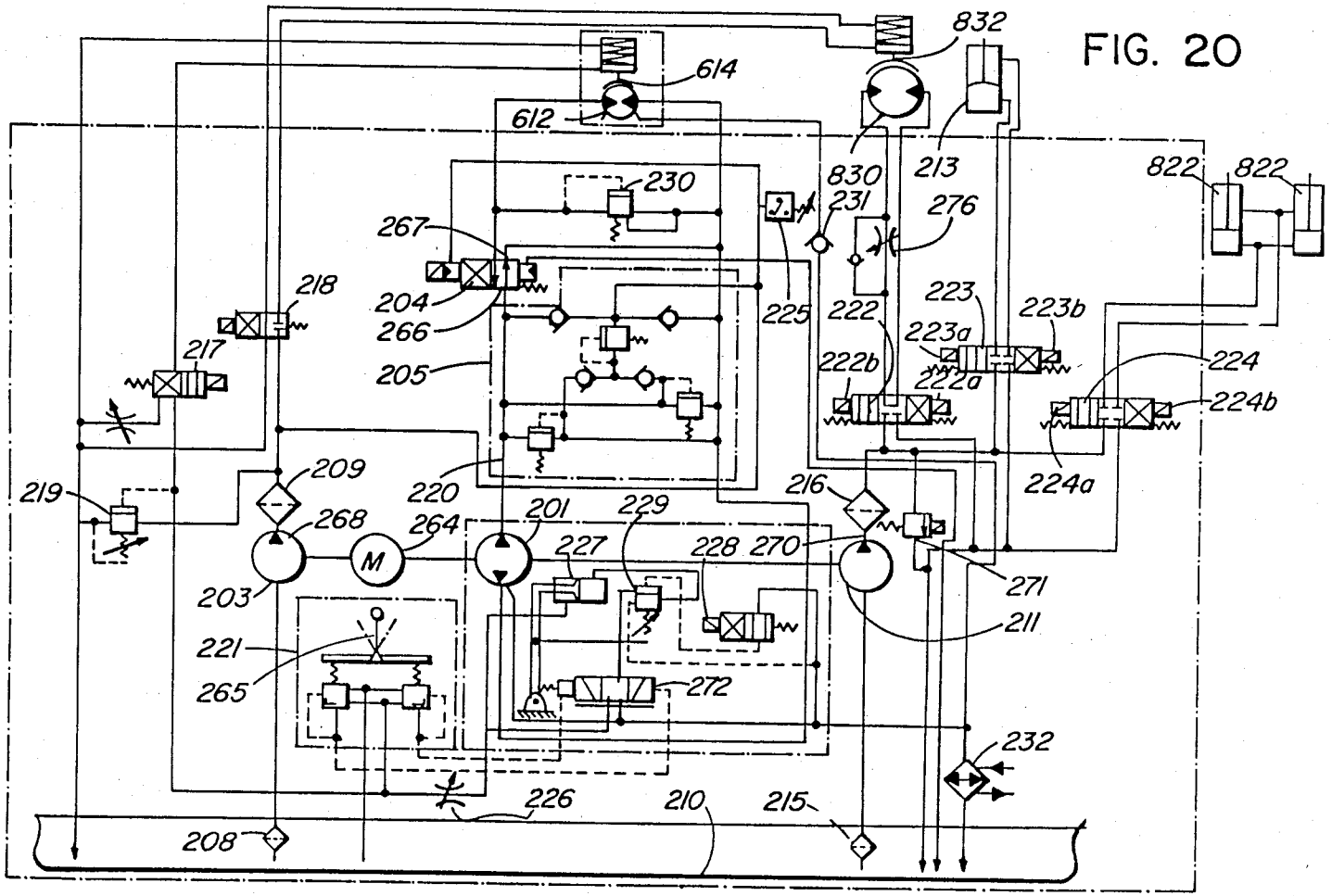
Figure 21:
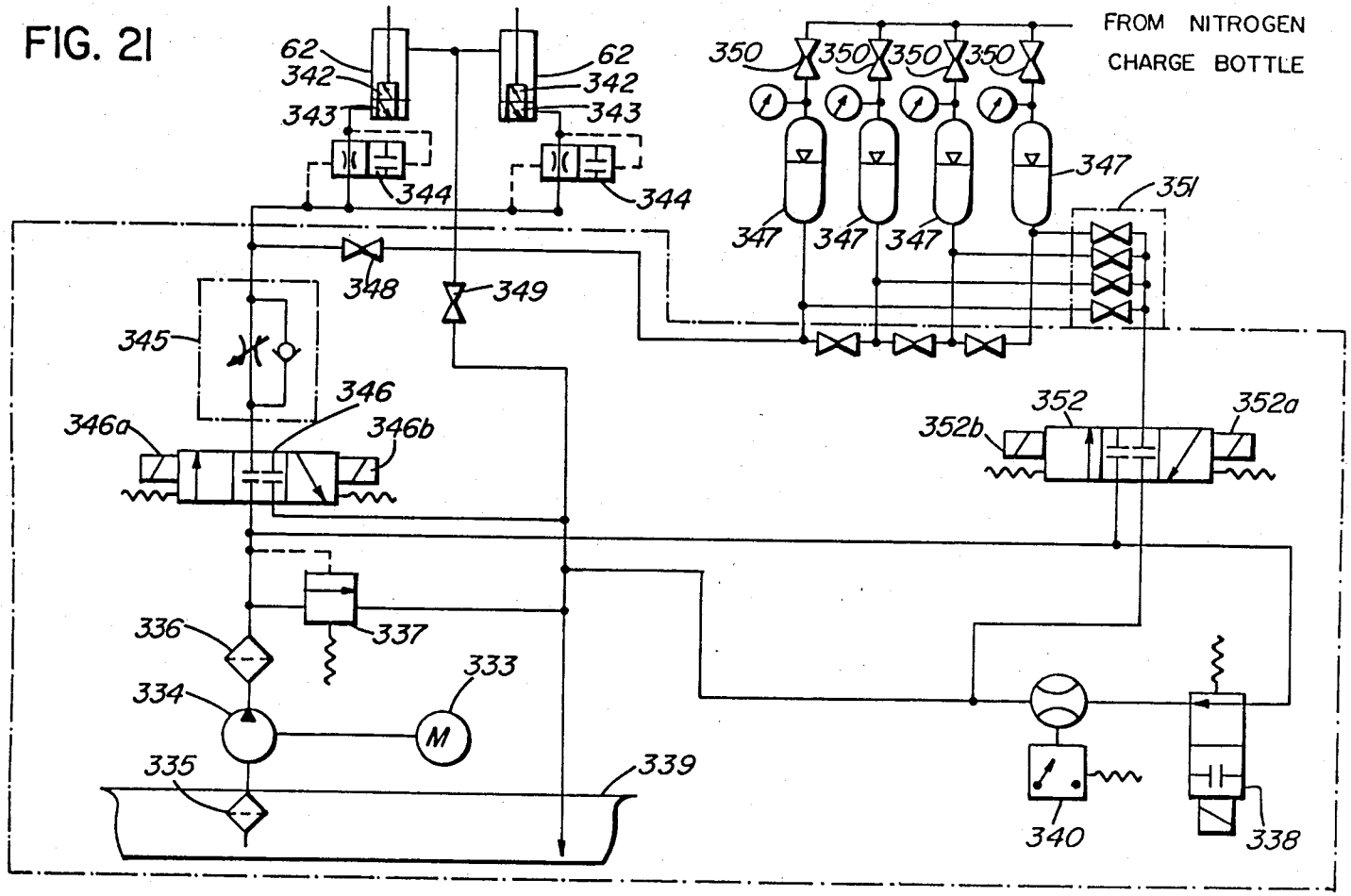
Figure 22:
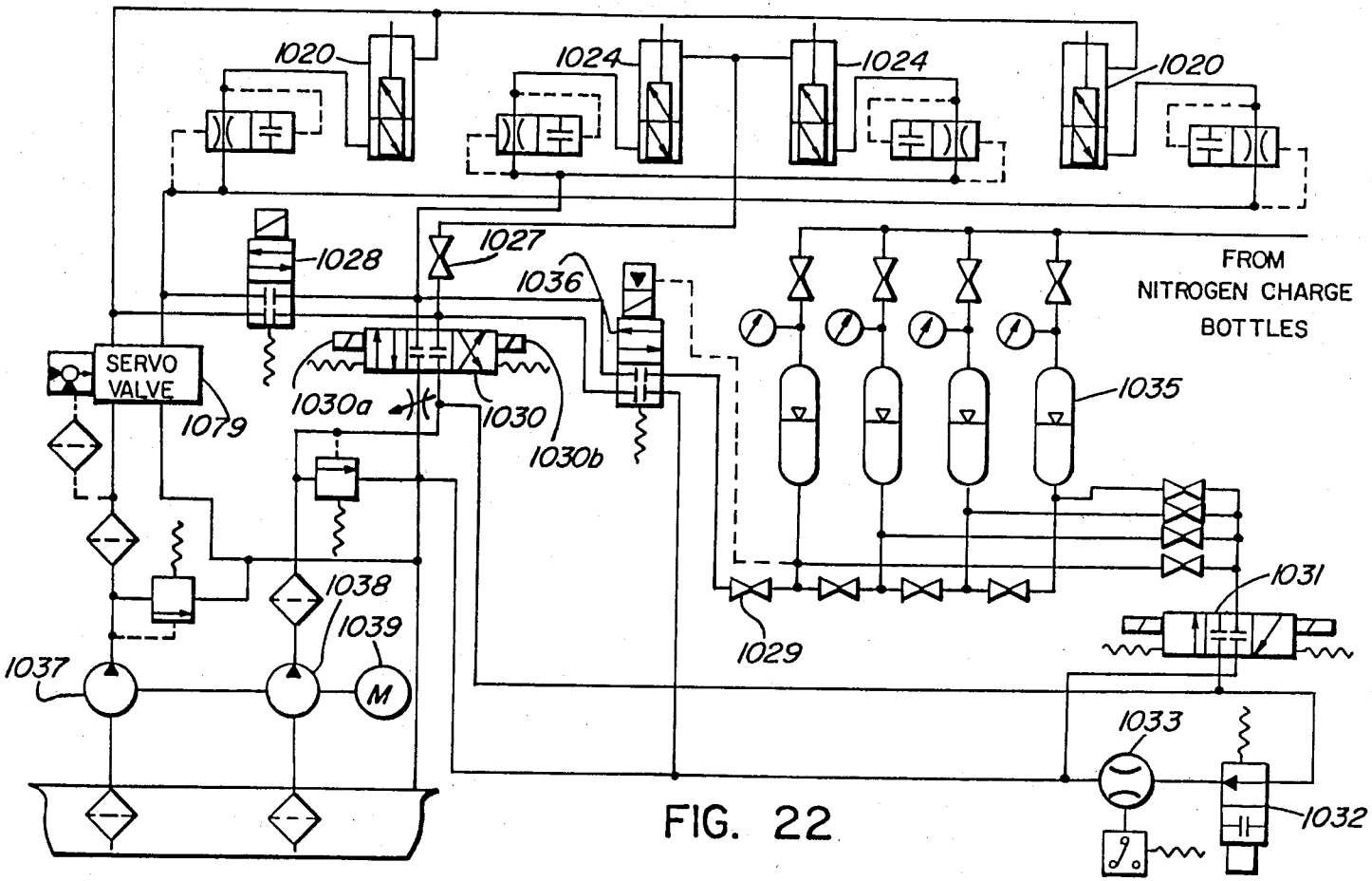
Figure 23:
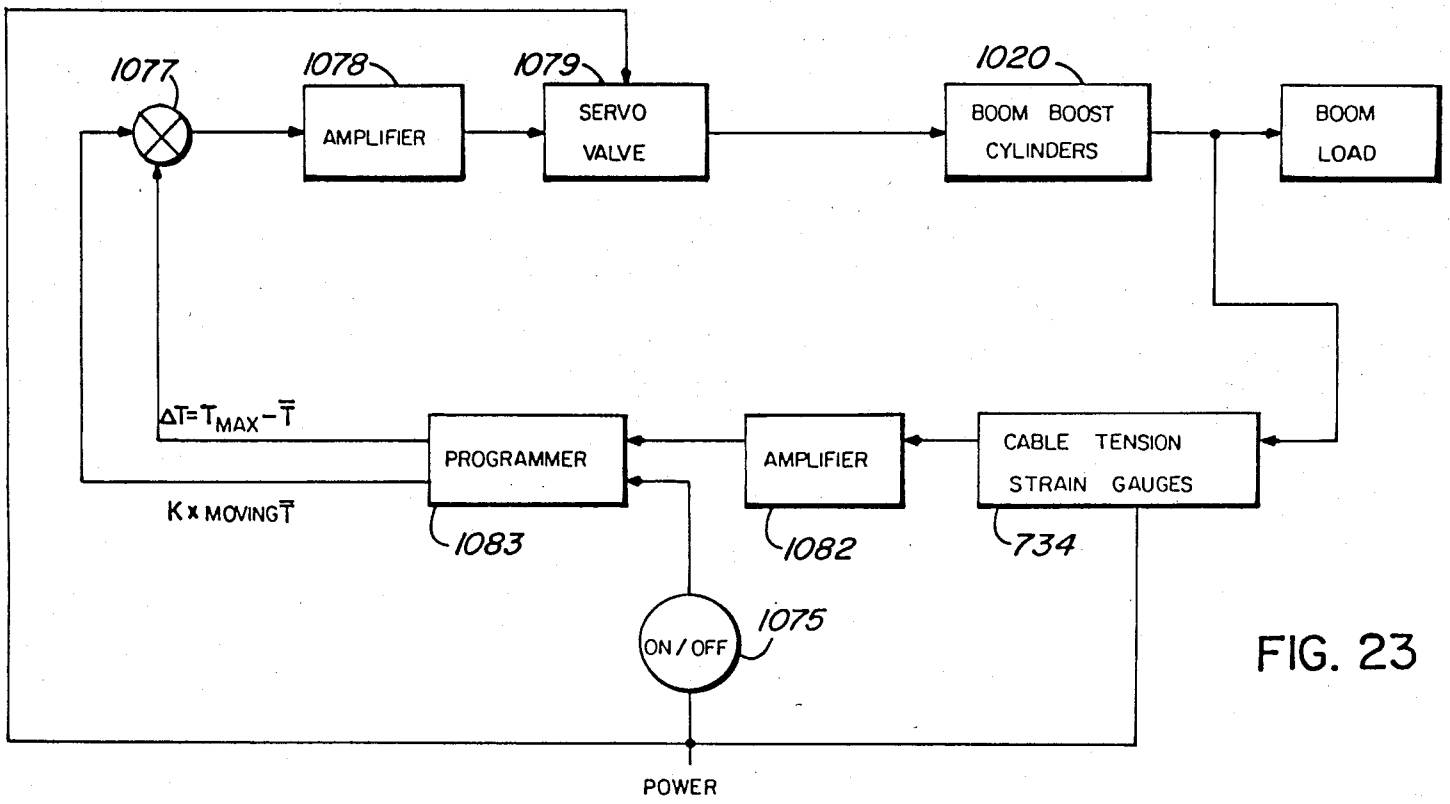
Figure 24:
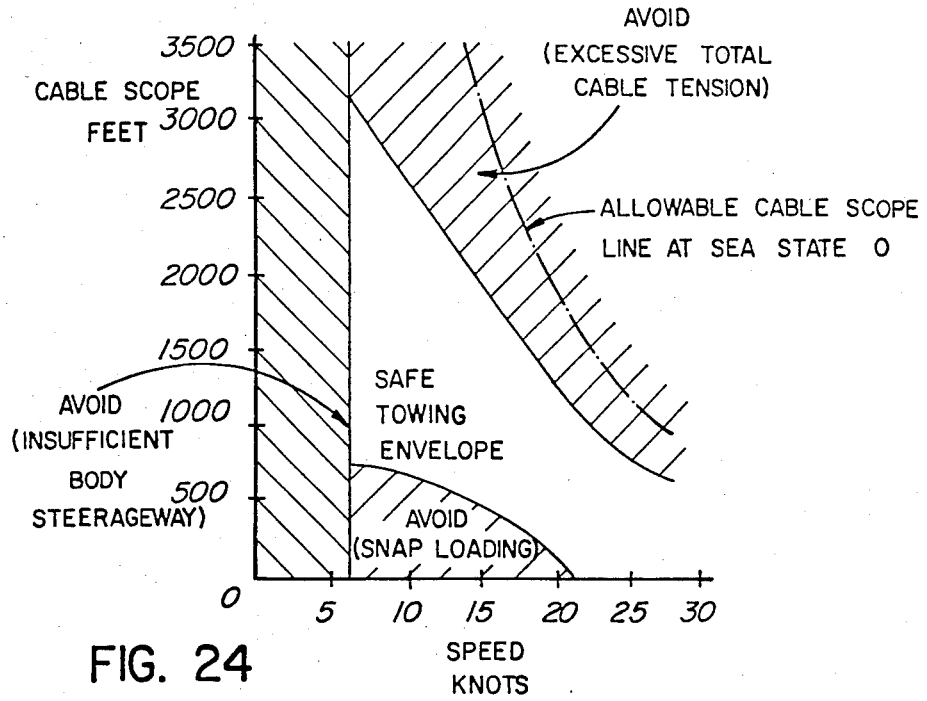
Figure 25:
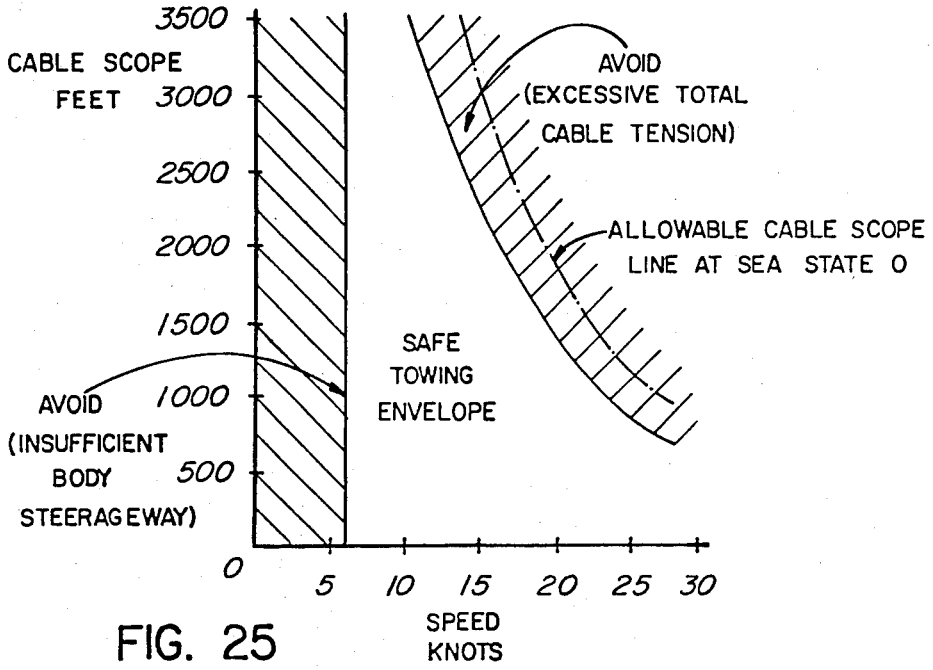

FIG. 1 is an elevational view of the apparatus of one embodiment of the present invention in its towing mode;

FIG. 2 is a plan view of the apparatus of one embodiment of the present invention;

FIG. 3 is an elevational view, looking along the line 3—3 of FIG. 2, showing the present invention in its launch and recovery mode;

FIG. 4 is an elevational view, looking along the line II—II of FIG. 1, showing the present invention in its stow mode;

FIG. 5 is a side elevational view of the trucked gantry;

FIG. 6 is an elevational view, partly in section, from forward looking aft of the trucked gantry of FIG. 5;

FIG. 7 is a section along the line VII—VII of FIG. 5;

FIG. 8 is an end elevational view of a winch drum assembly used in a compact towing system according to aspects of the invention;

FIG. 9A is a section, through line IX—IX of FIG. 8 of a winch drum assembly used in a compact towing system according to aspects of this invention; and FIG. 9B is a cross-section of the winch drum showing the face and spiral grooves;

FIG. 10 is a section through one variant of a boom pivot used in a compact towing system of aspects of this invention, showing, in addition, a link-mounted, strain gauged, deflection sheave;

FIG. 11 is a section through one variant of a boom used in a compact towing system of aspects of this invention, looking aft towards the fairlead sheave and saddle assembly, with the saddle down in the body capture position;

FIG. 12 is a plan view of a fairlead sheave and carriage assembly used in a compact towing system of aspects of this invention;

FIG. 13 is a side elevational view, partly in section, of the assembly of FIG. 11;

FIG. 14 is an end elevational view of a fairlead sheave used in the assembly of FIG. 11, viewed from aft looking forward;

FIG. 15 is a partial perspective view of a gantry drive system used in a compact towing system according to aspects of this invention;

FIG. 16 is a side elevational view of a compact towing system according to a second embodiment of this invention, in its towing mode;

FIG. 17 is a plan view of the compact towing system of FIG. 16, in its towing mode;

FIG. 18 is a side elevational view of the compact towing system of FIG. 16 in its launch and recovery mode;

FIG. 19 is a side elevational view of the compact towing system of FIG. 16, in its stow mode;

FIG. 20 is a schematic drawing of one variant of a main power unit;

FIG. 21 is a schematic drawing of one variant of an auxiliary power unit to be used in a system designed for passive shock absorption;

FIG. 22 is a schematic drawing of one variant of an auxiliary power unit to be used in a system designed for active assist to passive shock absorption;

FIG. 23 is a schematic logic diagram of means for controlling the servo pump of FIG. 22;

FIG. 24 is a graph of towing capabilities of cable scope in feet as ordinate and speed in knots as abscissa, without shock absorbing;

FIG. 25 is a graph siilar to that of FIG. 25, with passive shock absorbing; and

Figure 26:
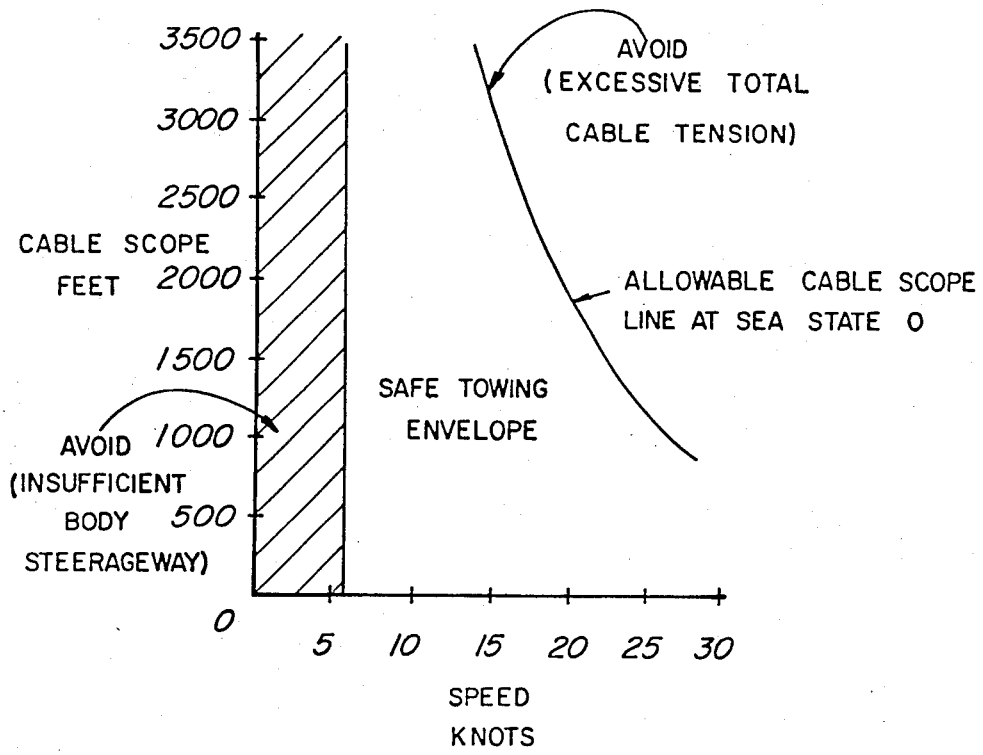

FIG. 26 is a graph similar to that of FIG. 25, with an active assist type of shock absorbing.

DESCRIPTION OF THE PRIOR ART (i) Description of FIGS. A–F

A shock absorber to be described hereinafter provides shock absorbing springiness to the boom. With reference to FIGS. A and B, the angular position of the boom may be changed by actuation of a hydraulic cylinder A34 causing the boom A30 to pivot about the pin A31. The hydraulic cylinder A34 consists of a cylinder assembly A34*a* and a piston rod assembly A34*b* movable relative to one another. The piston rod A34*b* is pivotally connected to the boom A30 by a pin A34*e* and the cylinder A34*a* is pivotally connected by a pin A34*d* to a frame assembly A60 or some other suitable support fixed or adapted to be fixed to the vessel. A piston A34*e* is connected to the piston rod A34*b* for movement in the cylinder assembly A34*a* dividing the latter into a pair of chambers A34*f* and A34*g*, located respectively one on each side of the piston. The hydraulic cylinder chambers A34*f* and A34*g* are connected respectively by conduits A34*h* and A34*i* respectively to free floating piston accumulator assemblies A35 and A36. The accumulator A35 is divided into a pair of chambers A35*a* and A35*b* by a free floating piston A35*c*. The chamber A35*b* is connected to the hydraulic cylinder chamber A34*f* by the conduit A34*h*. The accumulator A36 is divided into a pair of chambers A36*a* and A36*b* by a free floating piston A36*c* and the chamber A36*a* is connected to the hydraulic cylinder assembly A34 by the conduit A34*i*. Each of the chambers A34*a* and A36*b* of the accumulators is filled with a compressible fluid having selected characteristics, e.g., air, while the other chambers A35*b* and A36*a* are filled with a fluid, e.g., oil located in the chambers A34*b* and A34*g* of the hydraulic cylinders. It is evident from the arrangement illustrated that any load on the tow line causing the boom to want to move downward is restrained from doing so by a buildup of pressure in chamber A34*f* which acts on the underside of the piston A34*e*. Variations in a load on the tow line thus cause variations in the pressure in chamber A34*f*.

By having the accumulator A35 connected to the chamber A34*f* (high pressure chamber) of cylinder A34, a state of equilibrium can be established by matching a given oil pressure in chamber A34*f* with the gas pressure in chamber A35*a* of accumulator A35.

An increase in the load will upset the state of equilibrium causing the boom A30 to swing downward and cause piston A34*e* to drive oil from cylinder chamber A34*f* into chamber A35*b* of accumulator A35. The piston A35*c* within the accumulator A35 accordingly will move to compress the gas in chamber A35*a*. The resulting rise in gas pressure will be reflected by a balancing rise in oil pressure which will restrain the boom movement from further motion.

A reduction in the load on the tow line will cause the gas pressure in chamber A35*a* to drive piston A35*c* to the left (as viewed in FIG. A) which will cause oil to be driven back into cylinder A34*f*, thus causing the boom A30 to rise. This motion will prevent slack cable from developing.

Relative movement of the towed body and the towing vessel, for example caused by the vessel moving up and down in rough water, will result in compensating motion in the boom A30 by the accumulators tending to maintain stable tension in the tow cable A40.

The accumulator A36 (low pressure) connected to chamber A34*g* has oil on one side of its piston A36*a* and gas on the other side in chamber A36*b*. The oil/gas relationship within accumulators A35 and A36 should be so selected that neither pistons A35*c* nor A36*c* can bottom-out during actuating cycles. That is to say, at the bottom of a boom movement, the gas in chamber A35*a* will rise sufficiently to reverse the motion before the oil in a chamber A36*a* has been exhausted. Conversely, at the top of a boom movement, the gas in chamber A36*b* will have risen sufficiently to reverse the boom movement before the oil in chamber A35B has been exhausted.

Another feature of the described system concerns the geometric relationship of relative positions of the boom A30 and the actuating cylinder A34. Referring to FIG. B, the boom A30 pivots about the axis of pivot pin A31, cylinder A34 pivots about the axis of pivot pin A34*d* and the pivotal connection between the cylinder rod A34*b* and the boom A30 by pivot pin A34*c* provides a further pivot axis. The pivot pins A31, A34*d* and A34*c* are so positioned that the pivot axes cause a selected loading in the hydraulic cylinder A34 relative to predetermined arcuate movement of the boom A30 about the pivot axis of pin A31. The pivot axes are so located that as the boom swings downward from an upper position A1 to a lower position A2 (illustrated in phantom in FIG. B), the moment arm of the load about the pin A31 increases gradually from dimension A31*a* to A31*b*. At the same time the restraining force of the cylinder A34 (represented by oil pressure in chamber A34*f*) which initially acts about a dimension C1-C2 for boom position A1, comes to act about a reduced dimension C3-C4 for boom position A2.

Whereas there is some reduction in the resultant boom force at position A2 over position A1 due to the reduced wrap over the sheave, the net result is an increase of oil pressure in chamber A34*f* of cylinder A34 for position A2 compared with that of position A1 for the same cable tension.

Thus to maintain stability for a given load, a higher pressure in the cylinder is required at low boom angles than is required for higher boom angles. A relationship between cylinder pressure and boom angle for a constant load is represented in FIG. C by curve 1.

It is this variable pressure for constant load at varying boom angle that makes the accumulator system practical. This is due to the fact that the gas space A35*a* in accumulator A35 can be so dimensioned that its compression curve will closely match the curve 1 of FIG. C. That is to say, as the boom moves down to compensate for a rise of the ship's stern, the displaced oil from cylinder A34*f* (FIG. A) entering chamber A35*b* causes a rise in gas pressure in chamber A35*a* which reflects in a rising oil pressure in chamber A34*f* of a magnitude that will balance the cable pull at the lower boom angle. In this manner, a constant tension condition can be achieved.

In practice, the ship's vertical stern excursions may well exceed the same limits of boom excursions and therefore a gas space A35*a* must be selected that will be a compromise between a constant tension condition and one that will over-compensate the pressure sufficiently to arrest the boom motion to maintain it within a safe arc. The smaller the gas space A35*a*, the greater is the degree of over-compensation.

A gas compression curve represented by line 2 in FIG. C illustrates a typical result that meets the condition discussed. Where this curve falls below curve 1 namely between points 3 and 4, an accelerating force is exerted on the boom to move it outboard. This is provided by the gas cushion in chamber A36*b* (FIG. A) which rapidly falls off as the boom starts to move outboard. As the boom continues to move outboard, the gas pressure in chamber A35*a* rises slightly faster than the pressure required to maintain constant tension in the tow cable, namely between points 3 and 5. The difference between this pressure curve 2 and the theoretical constant tension pressure curve 1 provides an increasing deceleration force on the boom to limit its arc of swing to within safe limits.

The shock absorbing characteristics are such that the boom responds in opposition to vertical forces acting on the towed body. The forces are represented by the load on the tow line and are generated by the wave action upon the ship. The method of sheaving the cable greatly influences the effectiveness of the boom's compensating response. In accordance with a feature of the present apparatus, the arrangement of the boom and tow cable and sheaving of the cable may be such that there is provided a selected interrelationship of arcuate movement of the boom and vertical excursions of the free end of the tow line relative to the ship's deck.

Referring to FIG. D, the boom is shown in various pivot positions, namely P1, P2, P3 and P4. The length of cable between point X adjacent the winch assembly A100 and some other fixed point, for example beyond sheave A33 is the same for all boom positions. The length of cable for example between X and Ya equals the length between X and Yb, X and Yc and X and Yd, the positions Ya, Yb, Yc and Yd being the position of a fixed point on the cable for respective boom positions P1, P2, P3 and P4.

The vertical distances between Yd and Ya, Yb or Yc, i.e., the vertical distance above datum line H is a measure of the effectiveness of the compensating movement of the boom in response to wave motion upon the ship.

Referring to FIG. E which is a graph showing the relationship between the vertical excursion of the cable (relative to the ship) against variations in boom angle, curve J is illustrative of an arrangement of boom position. Typical boom angles are within the limits of 5° below to 60° above the horizontal plane. The preferred towing angles are normally between 30° and 60°.

It will be apparent that a reasonable vertical excursion of the cable occurs at the lower boom angles. However, between 30° and 60°, not only does the vertical excursion cease, but the arrangement may be such that it reverses. That is to say, when it is intended that the cable be elevated relative to the ship as the ship enters a trough between waves, it would in fact accentuate the hazard of slack cable by letting slightly more cable out when the boom is in between 30° and 60° of elevation. To overcome this problem, the deflection roller A55 may be used, for example, as illustrated in FIG. D to engage to the cable and be positioned so as to provide selected relative characteristics of boom arcuate movement versus excursions of the free end of the cable relative to the ship's deck. The length of cable between point X adjacent the winch and some other fixed point on the cable is the same for all boom angles. That is to say, the distance between X and Ya equals the distance between X and Yb, X and Yc and X and Yd. As in the previous case, Ya, Yb, Yc and Yd represent a common fixed point on the cable for respective boom positions P1, P2, P3 and P4.

With the arrangement illustrated in FIG. D, the vertical distance between Yd and Ya, Yb and Yc is plotted on FIG. E relative to the boom arcuate movement and is illustrated by curve K.

It will be immediately apparent that the introduction of the deflection roller A55 results in an almost linear relationship between the vertical excursion and the boom angle of elevation.

With respect to the tuning means for the shock absorber, the foregoing description makes it apparent that a means of varying the characteristics of the shock absorber system to suit the prevailing circumstances is required.

FIG. F shows the basic elements for effecting such a control. This comprises a gas control panel A200 with five shut-off valves A232, A233, A234, A235 and A236 interconnected by lines or conduits as shown. A high pressure gas supply A237 is connected at port A238 to one side of each valve A233, A234 and A235.

The high pressure accumulator A235 is connected to valve A233 in the gas panel by line A239 and the low pressure accumulator A236 is connected to valve A235 of the gas panel by line A240. A shuttle accumulator A241 is connected to valves A232, A234 and A236 in the gas panel by line A242.

Oil lines A250, A251 and A252 capable of supplying high pressure oil or draining oil by means of a pump and suitable valving (not shown) are connected to accumulators A35, A241 and A36 respectively.

Initial gas pressure may be set up in accumulator A35 by opening gas valve A233 and allowing gas in supply bottle A237 to expand into chamber A35*a* until the desired pressure is achieved.

The volume of chambers A35*a*, which indicates the slope of the gas compression curve (FIG. C) may be increased by opening line A250 to an oil reservoir thus allowing oil to drain from chamber A35*b*. Conversely, the valve of chamber A35*a* may be reduced by applying oil pressure to line A250 and forcing oil into chamber A35*b*, it being assumed that at this time, accumulator A36 is full of oil preventing the cylinder piston A34*e* from moving rather than piston A35*e*.

Gas pressure in chamber A35*a* can be reduced by opening gas valve A232 and oil line A251 to the oil reservoir. By this means, gas in chamber A35*a* expands into chamber A243 of accumulator A241 which drives piston A244 in the same and ejects oil from chamber A245.

Gas in chamber A243 may be returned to the supply bottle A237 by closing valve A232, opening valve A234 and supplying oil under pressure to oil line A251.

A gas cushion may be injected into chamber A36*b* of accumulator A36 by opening valve A235.

Excessive gas in chamber A36*b* may be reduced by opening valve A236 and drawing oil from shuttle accumulator chamber A245 via oil line A251.

The foregoing procedure illustrates how a wide range of adjustments can be made to tune the shock absorber characteristics to meet prevailing conditions.

In the course of operation, some loss of oil will occur in the high pressure accumulators A35, i.e., from the chamber A35*b*. The result of such leakage will be a gradual lowering of the mean boom angle. Compensation for this leaking may simply be provided by an electrical system comprising essentially of a limit switch which will close at some minimum boom angle causing a pump (not shown) to switch on for a brief period via a timing relay. This pump will deliver oil to chamber A353 for a brief period controlled by the relay setting thus replenishing the loss of oil through leakage.

The operative range of the boom, that is the inclination of the same to the vertical, may be kept within selected limits automatically by switches actuated in response to preselected upper and lower limits of the boom movement. Actuation of such switches may be utilized to control fluid to the hydraulic cylinder assemblies A35 and A36 to appropriately modify the position of the boom. Such an arrangement is illustrated in FIG. F where a rotatable cam A300 is, for example, operatively connected to the boom by a shaft A301 which moves the cam in response to pivotal movement of the boom about its pivotal connection A31 to the vessel. The cam A300 includes a lobe A303 for engagement to actuate respectively an upper limit switch US1 and a lower limit switch LS2. The switches US1 and LS2 control respective pumps P10 and P20 which supply fluid through lines A252 and A251 to the respective hydraulic cylinder assemblies A36 and A35. In operation, pivotal movement of the boom to its lower limit would cause actuation of switch LS2 which, in turn, would actuate pump P20 supplying more fluid to the hydraulic cylinder assembly A35, thus moving piston A34*e* to the right as viewed in FIG. F, causing the boom to pivot clockwise about its pivotal connection A31 to the vessel. It is obvious that any type of switch for effecting actuation of the pumps P10 and P20 may be utilized which is responsive to preselected or designated positions of the boom. Stops may be provided (not illustrated) which limit the movement of the boom to the designated upper and lower limits, A hydraulic stop, for example, may be provided which limits the lower position where the boom is substantially horizontal. This would be the normal operative lowermost position; however, the stop may have a further lower limit, for example, having the boom dipping downwardly at approximately ten degrees. This further permitted movement facilitates placing the tow cable A40 below the guide sheave A55 and the second lower limit of the boom which is above that position ensures that the cable will not become disengaged from the sheave A55 during normal operation. Further assurance against such disengagement may be provided by a lock or finger member which, during operation, would be disposed adjacent the sheave preventing removal of the cable and movable from such position away from the sheave permitting placing the cable onto the sheave and removing it therefrom. Removal of the cable from the opposite direction of the sheave permitting placing the cable onto the sheave and removing it therefrom. Removal of the cable from the opposite direction of the sheave may be prevented by appropriately positioning an arm to which the sheave A55 is pivotally attached. The locking finger member may be movable manually or alternatively, if desired, hydraulic motor assemblies may be provided for effecting appropriate movement. The sheave A55 may also be pivotally attached to the arm as illustrated, which in turn, is freely movable, or alternatively, the arm may be controllably moved as, for example, by a hydraulic cylinder or motor assembly. In the case of utilizing a hydraulic cylinder which is extendible and retractable on one end, may be attached to the sheave arm and the other end anchored with respect to the vessel.

With respect to the problems of de-activating the shock absorber, the shock absorber described above is highly beneficial during towing operations. It may, however, be highly undesirable during launching and recovery operations of the towed body. Means, therefore, for de-activating or removing the "spring" from the system is provided.

Due to the high pressures involved the size of the oil lines and the probability that a plurality of cylinders rather than a single cylinder A34 may be employed in the system, manual or servo operated shut-off valves are impractical.

One method for de-activating the shock absorber comprises filling both the high pressure accumulator A35 and the low pressure accumulator A36 completely with oil. This is simply done by supplying oil pressure to lines A250 and A252 and opening gas valves A233 and A235. Oil will therefore fill chambers A35*b* and A36*a* driving pistons A35*c* and A36*c* to their extremities and driving the gas in chambers A35*a* and A36*b* back to the supply bottle A237 which has a relatively large volume compared to the accumulator gas chambers A35*a* and A36*b*.

With respect to the conservation of gas in the system, it is seen that means are available not only for injecting gas volume, but also for extracting gas volume from the system. From a practical point of view, it is important that the gas supply be preserved and not be lost to atmosphere.

The primary function of the shuttle accumulator A241 is to allow gas to be reduced from accumulator A35 or A36 and the gas then to be driven back to the gas supply bottle A237 as previously described.

Over a period of time, however, the gas supply A237 will gradually become depleted. If this supply is in a single bottle it must be discarded while the pressure within may be still quite high through not high enough to meet the system changing conditions. For this reason, it is preferred to split the supply into a plurality of bottles and in this regard, reference is made to FIG. G. As seen therein, the supply of gas is provided by supply bottles A237*a*, A237*b*, and A237*c*. It will be seen that each supply bottle A237*a*, A237*b* and A237*c* has a shut-off valve respectively identified as A246*a*, A246*b* and A246*c* and that all bottles are connected by a common line through valve A234 to the shuttle accumulator A241.

Normally in operation, valves A246*a*, A246*b* and A246*c* would all be open and thusbottles A237*a*, A237*b* and A237*c* would gradually become depleted at the same rate. When an unacceptably low supply pressure is recorded, the remaining gas in one bottle may be pumped into the other two bottles, then discarded and replaced with a fully charged bottle. The procedure for doing so is as follows:

(a) Close valves A246*b* and A246*c* but leave open valve A246*a* and open valve A234;

(b) Drain oil from accumulator A241 through line A251;

(c) When gas flow stops, close valve A246*a* and open valve A246*b* and A246*c;*

(d) Inject oil into accumulator A241 via line A251 which will drive gas in chamber A243 into bottles A237*b* and A237*c;*

(e) Repeat steps (a) through (d) two or three times until the gauge gas pressure reading in bottle A237*a* is substantially reduced to zero;

(f) Discard bottle A237*a* and replace with fully charged bottle;

(g) Close valve A234 and open valves A246*a*, A246*b* and A256*c* to stabilize the pressure in all bottles.

The result of these procedural steps will be a boosted gas supply and the discarding of an empty gas bottle. The conservation or maximum utilization of gas accordingly is an important function of the shuttle accumulator A241.

(ii) Description of FIGS. H–M

The saddle B12 is open ended at the forward end and consists of the usual side members B13, B14 with an aft cross member B15, which may or may not be filled with heavy ballasting material (B16, as shown), as required, to obtain an exact counterbalance when tilted as shown in FIG. J. The saddle B12 is shown suspended from the towing sheave shaft B17, but may instead be supported from a separate shaft on pins (not shown). The saddle B12 is also connected to the fairlead housing D18 by a hydraulic cylinder or clinders B19. The towing sheave B20 is mounted on bearings B21 on its shaft, or the shaft itself may be mounted on bearings (not shown) in the fairlead housing. The tow cable B22 extends through the throat B23 and B50 of the assembly B10 and over the towing sheave B25. The fairlead housing B18 is mounted on a bearing or bearings B26 which allow the housing B18 to pivot or twist about the axis B27 through the throat B23 and B50 of the assembly B10. The bearing or bearings B26 are in turn mounted on a quill B28, the flange B28 of which is bolted to the structure B11. A set of external brake shoes B29 is supported on a pin B30 attached to the quill flange B28. These shoes B29 bear on the flange B31 of the fairlead housing B18, and are caused to release or apply by a double ended hydraulic brake cylinder B32, also arrangement may be used in lieu of external shoe brakes.

The operation of this device is as follows:

During launch and recovery saddle B12 is held in a horizontal position approximately as shown in FIGS. H and I, which are correct if boom structure B11 is horizontal, but which are somewhat different if boom structure B11 is tilted down towards the water or up into the air by hydraulic cylinder(s) B19. It is to be observed that saddle B12 itself is controlled and held horizontal during launch and recovery. Brake shoes B29 are applied to fairlead housing B18 to hold the bottom surface B13 of the saddle B12 level in the athwartships, direction, i.e., substantially to prevent the fairlead B24 from pivoting. When the body is released and normal towing conditions prevail, hydraulic cylinder(s) B19 tilts the saddle B12 up into position shown in FIG. J, at which point the combined center of gravity of fairlead housing B18, cylinder(s) B19, sheave B20, bearing(s) B21, sheave shaft B17 and saddle B12 lie along the pivot axis B27 of the fairlead housing B18. The brake shoes are then released by brake cylinder B32 and the entire assembly of fairhead housing B18, cylinder(s) B19, sheave B20, bearing(s) B21, shaft B17 and saddle B12 is free to pivot effortlessly about the axis B27 in response to changes in direction of tow cable loading. By virtue of the counterbalance feature, it will automatically assume any pivotal position in response to the direction of two cable loading and remain effortlessly in that pivoted position with the sheave shaft B17 perpendicular to the tow cable B22 as shown in FIGS. K, L and M until the direction of tow cable loading changes once again.

The hood B24 of fairlead housing B18 will also prevent the tow cable B22 from jumping off sheave B20 under snap loading of the tow cable.

(iii) Description of FIGS. N–P

The boom C6 consists of a pair of beam members disposed in horizontal spaced relation and interconnected adjacent the pivotal connection C8. The spacing between the members is such as to receive therebetween the tow body C2. The saddle C10 is pivotally connected to the boom C6 by a shaft C12 extending from one boom member to the other. The sheave C5 is also pivotally mounted on the pin or shaft C12 and the frame of the saddle C10 is such that the two line C4 can extend therebelow. The saddle adjacent the rear end thereof, as illustrated in FIG. O, is generally U-shaped so as to receive the cable C4 permitting the body, when launched, to extend rearwardly from the launching mechanism. The two cable C4 is illustrated in phantom extending rearwardly and in such position the maximum angle of the cable with respect to the horizontal, and which is likely to occur, is approximately 30 degrees. The lower face C11 of the saddle C10 is disposed generally horizontal and remains in such position during pivotal movement of the boom C6 about the pivot pin C8. Such orientation of the saddle is maintained by a link member C13 pivotally connected at opposed ends by pins C14 and C15 respectively to the saddle and the vessel.

The saddle consists of a frame or base plate C16 having a plurality of posts C17 directed therefrom and each terminating in an end member C18 having an outer arcuate face C19. The first row of posts is located one on each of the longitudiinal axis of the base C16, that is an axis extending parallel to the length of the body when such body is in engagement therewith, having the arcuate surfaces directed inwardly toward one another and generally toward the center of curvature of the arcuate outer surface of the towed body to which is in engagement therewith during launch and recovery operations. A further row of posts C17 is located outwardly therefrom, and as noted in FIGS. O and P, the posts, instead of being substantially perpendicular to the arcuate surface of the towed body as is the case with the innermost row, are located at a smaller angle thereto, that is, smaller than 90 as is the case with the innermost row. It will be evident from such arrangement, the arcuate outer surface of the head C18 will strike the towed body at a different angle and, in actual operation, it has been found that this facilitates aligning the body with the contour in the saddle simplifying retrieval operations and minimizing damage to the body during retrieval.

The members C18 are preferably made of a resilient material, for example plastic, and as illustrated in FIG. 9, they are attached to their respective posts by a nut and stud assembly C19. The cap C18 is supported by an annular shell C20. The cap members C18 may be coated with silicone or some other friction-reducing material, or alternatively, they may be made from a material having a relatively low co-efficient of friction, particularly when wet. The combination of the feature of being resilient and also a relatively low co-efficient of friction when wet reduces damage to the towed body during retrieval operations.

It is possible that the hoist described in this invention may be used with one of the fibre-optic cables newly being introduced to underwater mooring and towing service. Such a cable would be an "optic-mechanical" cable rather than an "electromechanical" cable. If so, there are two means of transferring optical signals to and from the tow cable from and to the ship's cable, namely:

(a) a fibre-optic connector to be disconnected before rotating the winch and reconnected after the winch has stopped; or (b) a fibre-optic collector.

Should an electromechanical cable continue to be used as in the past, there are three means of transferring electrical signals to and from the tow cable to the ship's cable, namely:

(a) an electrical connector to be disconnected before rotating the winch and reconnected after the winch has stopped;

(b) a cable winder, as taught in Canadian Pat. No. 856,639 issued Nov. 24, 1970 to A. Kemeny, assigned to Her Majesty the Queen in right of Canada; or (c) a cable winder as taught in U.S. Pat. No. 3,822,834 issued July 9, 1974 to R. L. I. Fjarlie assigned to Fathom Oceanology Limited.

(iv) Description of FIGS. Q and R

The drawings show a cable winder D10 disposed adjacent and used in combination with a winch assembly D50. For the purpose of clarity and facilitating description, only the winch drum D51 of the winch assembly D50 is illustrated in the drawings.

The cable winder D10 consists of a winder mechanism D20 having a winding arm portion D21 disposed intermediate a pair of storage drums D30 and D40. The winch drums D51 and the storage drums D30 and D40 are disposed in co-axial alignment and drum D30 is attached to the winch drum D51 to rotate in unison therewith while the storage drum D40 is stationary and secured to a suitable base.

The winder mechanism D10 includes a housing D11 of, for example, sheet metal which may be suitably secured or fastened to a supporting structure as for example, a ship's deck D60. The housing D11 includes a pair of spaced substantially parallel side walls D12 and D13 serving as an enclosure for the storage drums D30 and D40 and the winder mechanism D20.

The winch drum D51 of the winch assembly D50 is secured to a shaft D52 mounted to rotate with the winch drum and is journalled in a bearing D53 secured to the casing side wall D12 and by other bearings (not shown) which are suitably located. The shaft D52 projects into the interior of the casing D11 and secured to said projecting end portion is the storage drum D30 consisting of a hub portion D31 and a pair of spaced parallel flanges D32 and D33.

The storage drum D40 consists of a hollow sleeve D41 rigidly secured to the casing side wall D11 and projects therefrom towards the interior of the casing. The sleeve D41 provides a hub for the storage D41 provides a hub for the storage drum and secured to the free end thereof is a flange D42. A flange at the other end of the sleeve D41 is provided by the casing side wall D13.

The winder mechanism D20 consists of an arm D21 attached intermediate the ends thereof to a shaft D22 journalled for rotation in the sleeve D41 and has a portion projecting beyond the casing side wall D13 for the purpose which will become apparent hereinafter. The arm D21 terminated at one end in a bifurcated portion D23 having a sheave D24 pivotally secured to the opposite end of the arm D11 as, for example, by a stud D27 threaded into the end of the arm D21. The arm D21, accordingly, rotates about the axis of shaft D22 which, in turn, is coincident with the axis of the shaft D52. The sheave D24 is freely rotatable about the pin D25 with the axis thereof being perpendicular to the axis of the arm D21.

The winch drum D51 of the winch assembly D50 is secured to a shaft D52 mounted to rotate with the winch drum and is journalled in a bearing D53 secured to the casing side wall D12 and by other bearings (not shown) which are suitably located. The shaft D52 projects into the interior of the casing D11 and secured to each projecting end portion is the storage drum D30 consisting of a hub portion D31 and a pair of spaced parallel flanges D32 and D33.

The storage drum D40 consists of a hollow sleeve D41 rigidly secured to the casing side wall D11 and projects therfrom towards the interior of the casing. The sleeve D41 provides a hub for the storage drum and secured to the free end thereof is a flange D42. A flange at the other end of the sleeve D41 is provided by the casing side wall D13.

The winder mechanism D20 consists of an arm D21 attached intersleeve D41 and has a portion projecting beyond the casing side wall D13 for the purpose which will become apparent hereinafter. The arm D21 terminates at one end in a bifurcated portion D23 having a sheave D24 pivotally secured thereto, for example, by a pin D25. A plurality of counterweights are detachably secured to the opposite end of the arm D31 as, for example, by a stud D27 threaded into the end of the arm D21. The arm D21, accordingly, rotates about the axis of shaft D22 which, in turn, is coincident with the axis of the shaft D52. The sheave D24 is freely rotatable about the pin D25 with the axis thereof being perpendicular to the axis of the arm D21.

The winder mechanism D20 is attached to a biasing mechanism D70 which consists of the drum D21 secured to a portion of the shaft D22 which projects through the casing side wall D13, a ribbon spiral spring D72 and an anchor for the spring. The drum D71 is secured to the shaft and wound on the outside thereof is the spiral spring D72 anchored at one end to the drum D71 and the other end is wound around the stem portion of a stub shaft D73 secured to the casing side wall D13. The spiral spring D72 has a selected length spirally wound onto the stub shaft D73 providing a storage and the stored spiral is biased to wind up in a clockwise direction as indicated by arrow D74 in FIG. Q. This results in biasing the drum D71 to rotate in an anti-clockwise direction as illustrated by arrow D75. Since the drum D71 is secured to the shaft D72, the winder bar D21 is accordingly, spring-biased in an anti-clockwise direction. The spiral spring D72 has preferably substantially constant torque characteristics. The winder biasing mechanism is enclosed by a cover plate D76 secured as by bolts, welding, or the like, to the casing side wall D13.

In the mechanism illustrated in FIGS. Q and R, a tow cable D80 is illustrated partially wound onto the winch drum D51 and extends outwardly therefrom. The tow cable D80 may, for example, be utilized in a ship sonar system having the free end thereof attached to a sonar body being towed below the water's surface. The tow cable D80 consists of an outer strain sheath D81 enclosing a multi-conductor cable D62. The tow cable D80 passes through an aperture D54 in the winch drum and the strain sheath portion is anchored to the shaft D52 by a clamp mechanism D65. The multi-conductor cable D82 extends beyond the strain sheath through the stationary portion of journal D53 and has a portion thereof wound on the storage drum D30. The multi-conductor cable further extends from the drum D30 over the sheave D24 and is wound on the stationary storage drum D40 and continues through the ship's deck D60 where it is anchored thereto by a clamp mechanism D61. The terminal end of the multi-core conductor is connected to electronic equipment disposed below the ship's deck and such equipment is not illustrated in the drawings.

FIG. Q is a diagrammatic illustration of the mechanism in question with the multi-conductor cable wound on the storage drums D30 and D40 respectively in an anti-clockwise and clockwise direction, and the intervening portion between the drums is engaged by the sheave D24 journalled on the bar D21 as previously described.

In operation, the winch drum D51 may be appropriately rotated to wind in and pay out cable D80. When the tow cable D80 is stored on the winch drum D51, that is, in a wound-in position, the majority of the multi-conductor cable D82 extending beyond the winch drum is stored on the fixed drum D40. As the winch drum D51 is rotated clockwise to pay out the cable, storage drum D30 rotates in unison with the drum D51 causing the cable D82 to be wrapped, turn by turn, on the storage drum D30. Since the supply of the cable is on the non-rotatable storage drum D40, the resulting pull on the cable causes a turning movement to act on the winder bar mechanism D21. This turning force in consequence causes the bar D21 to rotate in the same direction as the winch drum D51 against the bias of spring D72. As the winder bar D21 rotates, it pulls the cable off the stationary drum D40 and thus effectively transfers the cable from the stationary drum D40 to the rotary storage drum D30. The bias of spring D72 prevents slack cable from developing and thus the cable removed from the storage drum D40 will travel over the sheave D24 and will wrap onto the drum D30 because of the bar D21 rotating at a slower speed than the drum D30. The speed of rotation of the winder bar should be just sufficient as to maintain tension in the continuity cable and it will find its own speed since it will be dragged around by the pull on the multicore conductor cable D82.

The action of the cable winder mechanism D20 can be best visualized by contemplating FIG. Q and first considering the winder bar D21 rotating one turn at the same speed as the winch drum D51. Since drum D40 is fixed, this action would result in slack cable developing equivalent to one turn length on drum D40. Now to take up the slack, consider holding all drums stationary and rotating the winder bar D21 back in the opposite direction. The slack will be deposited partly on drum D40, the ratio of distribution being dependent on the diameter of the hub D31 of drum D30 as compared with the diameter of drum D40. If both were equal the winder bar D21 would have to be wound back half a turn. When the effective diameter of drum 30 is considerably larger than that of drum D40, such as in the case illustrated in FIG. R, the slack cable is quite small and the majority of the conductor cable is taken up on drum D30 by a very small backward turn of the winder bar D21. In other words, when most of the cable is on drum D30, the cable winder D21 will rotate almost as fast as drum D30. When the cable is evenly distributed between drums D30 and D40, the cable winder will rotate at half the speed of the winch drum D51 and when most of the cable is on drum D40, the cable winder will rotate very slowly compared with the winch drum D31.

Expressed mathematically, the winch bar D21 will rotate $D/(D+d)$ revolutions per revolution of the winch drum D51 where D is the diameter of drum D30 and d is the diameter of drum D40.

The above operating description is based on the case of the winch paying out cable. When the winch is reeling cable in, the conductor winder performs the same function except that it takes up the slack of cable removed from drum D30 and transfers it to drum D60.

In the foregoing description and from FIG. R, it will be noted that sheave D24 overlaps the drum members D30 and D40. In order to facilitate winding operation and avoid damage to the cable, the plane of the sheave perpendicular to the axis on which it rotates is disposed at an angle to the winder arm D21 such that the cable enters and leaves the drums D30 and D40 at substantially a tangent.

Drums D30, D40 and D50 are disposed end to end in axial alignment. The winder mechanism also revolves about an axis common to that of the aligned drums. In an alternative embodiment, the drums D30 and D40 may be offset such that they rotate about a common axis different from the axis about which the winder mechanism rotates. In a still further alternative embodiment, each of the drums D30 and D40 and the winder mechanism D20 may revolve about their respective axes offset from one another.

The cable winder, as taught in the above-identified U.S. Pat. No. 3,822,834 issued July 9, 1974 to R. L. I. Fjarlie, assigned to Fathom Oceanology Limited, may be described as follows:

A cable transfer apparatus for transferring cable from a driven rotatable drum to a static drum includes a rotatably arm mounted on the same shaft with the rotatable and static drums, and with a transfer sheave at the outer end of the arm. The transfer sheave is mounted so as to accommodate cable being transferred between the rotatable and static drums. The arm is arranged with driving means therefor so that when the rotatable drum is driven in a first direction, the arm tends to not rotate; and when the rotatable drum is driven in the second direction, the arm tends also to rotate in that second direction at the same rotational speed. Friction means co-act between the arm and the rotatable drum so that when the drum is driven in the first direction and cable is being transferred between the driven and static drums, the friction means acts to maintain tension in the cable and to drive the arm and sheave to rotate about the shaft in the first direction; and when the rotatable drum is driven in the second direction, the friction means acts together with the tension in the cable being transferred between the drums to retard the speed of rotation of the arm and sheave about the shaft.

Three embodiments are described in that patent. In the first embodiment, a place is provided with clutches between the plate and the rotatable drum and between the plate and the shaft; and the rotatable arm is frictionally coupled to the plate by friction pads. In the second embodiment, a bearing sleeve is provided, together with ratchet and pawl means between the bearing sleeve and each of the rotatable and static drums. The rotatable arm is frictionally coupled to the bearing sleeve. In the third embodiment, a pair of opposed clutch assemblies is provided, each having a friction clutch and an overrunning clutch; and having a toothed belt extending from one of the rotatable or static drums to one of the clutch assemblies so that it overruns in one direction and drives against the friction clutch in the other direction of rotation of the rotatable drum and vice versa.

DESCRIPTION OF PREFERRED EMBODIMENTS (i) Description of FIGS. 1–4

The compact towing system of aspects of the invention includes a trucked gantry, a lower saddle, a winch drum, a boom, a pivotable deflection sheave, a fairlead sheave and saddle assembly, a fairing training device and suitable driving means.

As seen generally in FIGS. 1–4, the compact towing system 10 includes a trucked gantry 12 disposed parallel to the central longitudinal axis of the ship (not shown) and mounted on tracks 14 to be driven in a fore-and-aft direction in a manner to be described hereinafter. Disposed between the tracks 14 and adapted to be within the confines of the trucked gantry 12 is a lower saddle 16. Disposed alongside the trucked gantry 12 in a semi-dry compartment 18 in the ship is an internally driven winch drum 20, which will be described in greater detail hereinafter. The winch drum 20 has fixed foundations 22 and its centreline 24 extends approximately fore and aft along the ship.

The forward end 26 of the trucked gantry 12 is provided with spaced-apart upright arms 28 provided with aligned apertures 30 to accommodate boom pivot stub shafts 32 to enable the boom assembly 34 to pivot with respect to the trucked gantry 12. Details of the trucked gantry and the boom pivots will be given hereinafter.

The boom assembly 34 shown is a folding boom including an inner boom 36 and an outer boom 38. The inner boom 36 is composed of a rectangular parallelepiped open framework, including a pair of spaced-apart main frames 40, reinforced by upper longitudinal trusswork 46, and side trusswork 44. The upper longitudinal trussworks 46 are interconnected to one another by transverse interconnecting arms 48. Gear racks 52*a* are set into main frames 40.

The outer boom 38 is composed by a pair of transversely spaced-apart, longitudinally extending lower ways 50 providing a pair of spaced-apart gear tracks 52*b* which are continuations of racks 52*a*. The ways are interconnected to a longitudinal bracing assembly 54 and a transverse bracing arm 56. The outer boom 38 is pivoted to the inner boom 36 at pivot point 58. The ways 50 are spanned by a fairlead carriage drive 60, which will be described in greater detail hereinafter.

A pair of boom assembly actuating cylinders 62 are connected between a pivot assembly 64 on the trucked gantry 12, to which the cylinder end 66 is pivotally connected, and a depending ear 68 on the inner boom 36, to which the cylinder piston rod 70 is pivotally connected. The inner boom 36 and the outer boom 38 are moved pivotally by means of a pair of boom folding cylinders 72 connected at the cylinder end 74 to an ear 76 on the inner boom 36 and at its piston rod 78 to an ear 80 on the outer boom 38.

A fairlead towing sheave assembly 82 is mounted on a carriage 84 which is driven by the fairlead carriage drive 60. The fairlead towing sheave assembly 82 includes a fairlead towing sheave 86 and a ballasted saddle 88. These will be described in greater detail hereinafter.

(ii) Description of FIGS. 5–7

Turning now to FIGS. 5–7, the gantry 12 consists of a chassis 502 in the form of a rectangular platform 504 having depending side skirts 506 within which are pivotally mounted, on a bogey pivot 501, a fore and an aft wheel bogey arm 503. Each bogey arm 503 is provided with fore and aft free-wheeling wheels 508, each provided with bearings 505 and a stub axle 507. Wheels 508 run on upper an lower hardened inserts 510 which preferably are of precipitation hardened stainless steel within tracks 14. The fore and aft portions of the side skirts 506 are each provided, at each corner, with bumper wheels 512, free-wheelingly pivoted thereto on axle 513 in suitable bearings. The trucked gantry 12 is provided with a respective pair of boom cylinder pivots 64 [as shown in detail in FIG. 7].

The gantry 12 is driven by a jackscrew drive comprising threads 518 for the gantry drive screws 518 [see FIG. 15]. The gantry 12 thus is driven to run along a pair of spaced-apart fixed tracks on the deck of the ship.

The gantry 12 is adapted to be driven fore and aft as the cable winds and unwinds from the winch drum 20 to obtain and maintain a zero degree fleet angle between the tow cable and the flanges of the winch drum. The tracks 14 of the gantry 12 are disposed on either side of the lower saddle 16, so that the gantry 12 sits astride the lower saddle 16 when the maximum scope of cable is paid out. The lower saddle 16 [as seen in FIG. 4] has, in side elevation, an arcuate shape 520 to accommodate the towed body 522 and has, in cross section, a lower surface 521 [as seen in FIG. 15] which is curved to conform to, and hold, the towed body 522 [see FIG. 4].

The trucked gantry 12 also includes a pair of transversely spaced-apart upright arms 28 so that, with the chassis 502, it is generally in the shape, in side elevational view, of a tall, L-shaped structure. At the top of each upright arm 28 are a respective pair of aligned apertures, within which are placed hollow boom pivot stub shafts 32, located within pivot bushings 528.

The chassis 502 of the gantry 12 is thus supported on fore and aft load-equalling trucks or bogey assemblies 514, each having two steel wheels 508. The wheels 508 are captured above and below between ways 510 in the steel tracks 14, locked to the well deck of the ship on either side of the lower saddle 16. The trucked gantry 12, and thus the boom 34 and gantry 12 assembly, is traversed from a forward stow position to an aft full cable-out position by means of a pair of heavy steel threaded screws 518 driven by a roller chain 904 [see FIG. 15] from the winch drum 20. The aft ends 530 of the screws 518 are supported on bearing pillow blocks 922 attached to the sides of the lower saddle 16 [see FIG. 15]. The forward ends 920 of the screws 518 are supported in heavy roller bearing pillow blocks 1000 bolted to the deck [see FIG. 15].

Alongside the trucked gantry 12 is a fixed, internally driven winch drum 20, whose axis is parallel to the longitudinal axis of the ship, and which is shown in greater detail in FIGS. 8 and 9. The winch drum 20 includes a single, long hollow drum 602. The drum 602 is preferably supported in rollers 604 on the end flanges 606 and is driven at one end (the drive end) 608 by an internal gear drive 610 using a hydraulic drive motor 612 and brake assembly 614. Alternatively, an external drive (not shown) may be used. The drum 602 is provided with a storage drum magazine 616 at the opposite end 618 for extra dead cable turns. No conductor is used with this embodiment.

The winch drum 20 is made of steel with a multiplicity of internal stiffening rings 620 to prevent buckling. The steel face 622 is provided with spiral groovings 624. The end cheeks 628 are flanged 606 with shrunk-on high strength abrasion resistant steel hoops 630. The winch drum 20 is supported on a minimum of six, and preferably eight alloy steel rollers 604, a minimum of three and preferably four at each end, bearing on the hardened steel hoops 630 shrunk onto hooped cheek flanges 628. The entire central core 634 of the winch drum 12 up to the drive end 608 is free for cable access.

(iii) Description of FIGS. 8 and 9

As shown in FIGS. 8 and 9 at the drive end 608, i.e., at the end opposite to the spare cable magazine 616, the drive 610 includes an internal spur gear 636 which is bolted to one of the stiffening rings 620. A hydraulic drive motor 612 and brake assembly 614 with spur pinion 638 protrudes into the central drum core to drive the internal spur gear 636. The rollers 604 and the hydraulic drive motor 612 and brake assembly 614 are mounted on, or in, a stiff fabricated structure 634 surrounding the winch drum 20.

In one embodiment, the capacity of the winch drum 20 is:

(a) faired cable: 3500 feet wetted length plus 50 feet for total unwind plus 2 turns for stretch allowance;

(b) unfaired, stored cable: 500 feet stored in a divided internal drum 616 at the non-drive end of the winch.

Extra cable is provided so that synchronization between the positions of the winch drum and trucked gantry 12 in the body stowed mode is not to be lost after shortenings and reterminations. Loss of synchronization cannot be compensated for by manually turning the lead screws of the trucked gantry to relocate boom and gantry position, as this would put the towed body out of position in the lower saddle on recovery. Loss of synchronization will result in a pronounced fleet angle at the winch drum with all the usual resulting problems.

As described hereinbefore, the boom assembly 34 includes an inner boom 36, pivotally mounted to the upper end of the upright members 28 of the trucked gantry 21 through the pair of spaced-apart hollow boom pivot stub shafts 32 and an outer folding boom assembly 38. The boom preferably comprises a pair of laterally spaced-apart main frames 40 reinforced by upper longitudinal trussworks 46 and side trussworks 44. Another variant of this is a boom (not shown) of twin, heavy, spaced-apart box sections held apart in fixed relationship to one another with an overhead framework. The laterally spaced-apart frameworks or box beams provide spaced-apart gear racks **52*a* and [referring to FIG. 11] tracks 50 with hardened inserts 68 for the movement therealong of the carriage 84 upon which is mounted the fairlead towing sheave 86 and the saddle 88**.

A pair of spaced-apart boom actuation hydraulic cylinders 62 span the space between the aft end of the gantry 12 and the boom assembly 34. Because of the manner of mounting such cylinders, the restoring moment arm is almost constant regardless of boom angular position.

The inboard end of the boom assembly 34 is mounted to the upper end of the trucked gantry 12 by means of large low-friction bushings 528 mounted on large diameter hollow stub shafts 32 to provide the pivoting boom [see FIG. 10]. The tilting carriage 90 of a deflection sheave 700 [see FIG. 2] is also mounted on the stub shafts 32 to accommodate any position of the fairlead saddle 88, sheave 86 and carriage assembly 84 on the boom assembly 34 without imposing any fleet angle in the deflection sheave. Thus, the target to the pitch diameter of the deflection sheave (i.e., the cable centreline) will always pass through the centreline of the hollow boom pivot 32 to the winch drum 20. Consequently, regardless of boom angle, cable translation through the sheave is always zero as long as the winch drum 20 is not turning and the fleet angle to the sheave is zero under all conditions.

In the case of the variant using a folding boom as shown in FIGS. 1–4, the aft end of the outer folding boom 38 is pivotally secured at laterally spaced-apart locations to the aft end of the inner boom 36. A pair of boom folding hydraulic cylinders 72 are disposed between the aft end of the inner boom 36 and the fore end of the outer folding boom 38 with the cylinder end 74 secured to the inner boom 36 and the rod 78 secured to the outer folding boom 38, so that, upon actuation, the folding outer boom 38 is drawn upwardly into a folded stowed position.

(iv) Description of FIG. 10

FIG. 10 shows a section through the trucked gantry boom pivot 32. As seen, the boom frame 40 is provided with a bearing, i.e., a low friction boom pivot bearing 528 provided with end seals 708 and the hollow boom pivot shaft 32. Hollow, freely rotatable boom pivot shaft 32 passes through aperture 30 in the upper end 442 of vertical arm 28 of the trucked gantry 12, and which is held in place with a thrust nut 714. On the side opposite the winch, boom frame 40 is provided with a bearing 528 and end seals 708, and a boom pivot stub shaft (which may be solid or hollow and which passes through aperture 30 in the upper end 442 of vertical arm 28 of the trucked gantry 12), pivot bearings 710, a thrust bearing 712 and a thrust nut 714. The deflection sheave 700 is mounted on a tilting carriage 90, the main parts of which are pivoting clevis 722 and links 726. Clevis 722 is mounted on boom pivot stub shaft 527. Carriage assembly 90 supports sheave 700, which guides the faired cable 718 from the winch drum 20 to the fairlead sheave 80.

Associated with the deflection sheave 700 is a strain gauged carriage assembly 90. This assembly includes a pivoting clevis 722 with bearing housing 724 mounted on the stub shaft 527. A pair of links 726 straddle the deflection sheave 700 and are each pivoted at one end to the pivoting clevis 722 through pin 726 at link bearing 728 and, at the other end by pin 730 to the deflection sheave bearing 732. A strain gauge 734 is associated with each link 726 so that, as the links 726 pivot with respect to bearing 732, an indication of the strain on deflection sheave 700 is given.

(v) Description of FIGS. 11–14

Referring now to FIGS. 11–14, the towing sheave 72 is partially housed within a hood 802, the forward end 808 of which is circular to form a throat 806 for passage of the faired cable 718. This hood acts an an anti-jump device. The circular forward end 808 of the hood 802 is mounted on sealed rolling element bearings 819. The tow sheave 72 may thus freely pivot in the plane of the stern of the ship to accommodate high-speed turns or tow-off without binding, interference or concomitant cable damage. The pivoting hood 802 is mounted on a hollow tubular extension 812 of the carriage frame 84 which contains a hydraulically-actuated fairlead locking pin 814 to prevent swivelling during launch and recovery. The faired cable 718 thus passes through the throat 806 of the pivoting hood 802 and the throat 816 of the mounting tube 812 of the carriage frame 84.

A welded, hydraulically-pivoted, open forethroat saddle 88 is used. The aft and only cross-member 820 of this saddle 88 is ballasted with high density materials. It is shown in FIGS. 12 and 13 as being tilted in its normal towing position. The aft member 820 is ballasted, e.g., with lead, for fairlead balance. During free fairleading, the saddle 88 will be tilted up and back via hydraulic cylinders 822 until its raised centre of gravity reaches the point that weight distribution about the fore-and-aft throat 806 of the hood 802 is such that perfectly balanced, almost frictionless fairleading will ensue purely in response to cable tow-off angle.

The carriage 84 of the assembly is mounted on four flanged wheels 826 running in the boom members 36, 38. The two forward wheels are paired with drive gears 824 meshing with racks **52*a* and 52*b* of corrosion-resistant steel bolted to the boom members 36, 38. Drive to these gears 824 is from a carriage-mounted, constant-speed hydraulic motor 830 and brake assembly 832 driving through two speed reducers 834 to the gears 824 on the forward wheel 826. The carriage 84** is only traversed along the boom during launch and recovery.

(vi) Description of FIG. 15

FIG. 15 shows, in schematic form, one embodiment of a drive means. The drive means includes a pair of spaced-apart, parallel screws 518 extending along the longitudinal axis of the trucked gantry 12. Screw threads 520 on the gantry 12 are threaded on such screws 518. The screws are driven by a chain drive 904 from a large sprocket 906 bolted to the end face 908 of the winch drum 20 to a drive sprocket 910 on one screw 518, and an auxiliary chain drive 912 between auxiliary sprockets 914 on each of the screws 518. Roller bearing pillow blocks 1000 mounted on the deck 918 support the forward end 920 of the screws 518. The aft ends 530 of the screws 518 are supported on pillow blocks 922 bolted to the sides 924 of the lower saddle 16.

(vii) Description of FIGS. 16–19

FIGS. 16–19 show an alternative embodiment of this invention in which the boom assembly 34 is a single, unitary boom. In all other respects, the compact towing system is the same as described for FIGS. 1–4. However, boom folding cylinder 72 is omitted and is replaced by an extension of the boom frames to provide a one-piece boom. Since in all other respects, the system is the same, no further detailed description will be given. However, it is to be noted that, in its stow mode, there is no folded-in outer boom member 38.

(viii) Description of FIG. 20

Turning now to FIG. 20, one possible form of the main power unit depicted therein includes a variable displacement, axial piston pump 201, with manual and pressure compensation controls. During manual control, this pump drives winch motor 612 at variable speed and in both directions. During launch and recover, it maintains constant pressures, regardless of oil flow, on the haul-in side of winch motor 612. These constant pressures during recovery are usually greater than the constant pressure during launch, as in the former case the towed body may be heavier due to entrapped water. The replenishing pump 203 provides pilot pressure to operate directional control valve 204 in the winch circuit, make-up oil to the replenishment block 205, and pressure to release winch motor brake 614 and brake 832 on the fairlead sheave and saddle carriage drive. The system also includes an oil strainer 208 and a filter 209 (e.g., of 10 micron size) to protect replenishing pump 203 from contamination from the reservoir 210 and to filter oil from the replenishing pump 203.

The system also includes a fixed displacement pump 211, supplying oil to the fairlead sheave and saddle drive motor 830, the fairlead sheave lock hydraulic cylinder 213, and the saddle tilting cylinders 822. This fixed displacement pump 211 is also protected via a strainer 215 and a filter 216 (e.g., of 10 micron size).

Situated between pump 203 and winch motor brake 614 is two-position, solenoid-operated spring-return direction control valve 217; and between pump 203 and fairlead carriage brake 832, two-position, solenoid-operated, spring-return direction control valve 218. Also disposed in the system is a pilot-operated relief valve 219 to limit the pressure in the brake circuits and controls.

Disposed in the winch circuit is a solenoid-controlled, pilot-operated direction control valve 204. When de-energized, it hydraulically locks the winch motor 612 and directs oil from pump 201 to by-pass the motor 612 completely. When energized, it completes the closed loop of pump 201 and winch motor 612. A remote controller 221 is placed into the system and pressurized by pump 203. This controls the oil volume output of pump 201.

Solenoid-operated, spring-centered, four-way, three-position direction control valves 222, 223 and 224, respectively, are interposed between pump 211 and fairlead carriage drive motor 830, pump 211 and fairlead sheave lock hydraulic cylinder 213, and pump 211 and saddle tilting cylinders 822.

Disposed in the replenishment circuit from pump 203 is a pressure switch 225. If the switch opens, it is warning that the boost pressure for the winch circuit is low, i.e., below 150 p.s.i. This will automatically stop the winch and set motor brake 614 through the deenergization of solenoid valve 217. The throttle valve 226 which is disposed in the pressure circuit from pump 203 restricts flow of oil to the swash controls 227, thereby maintaining a constant pressure to the remote controller 211.

The variable displacement pump system includes a solenoid-operated, directional control valv 228. during launch and recovery, it is deenergized and connects a sensing line from the haul-in side of the winch closed loop circuit 220 to the pressure compensator 229 of pump 201. The compensator 229 then automatically adjusts the output of pump 201 to a is energized and disconnects the sensing line from compensator 229, thereby allowing pump 201 to operate at varying speeds as is demanded by the operator.

The winch closed loop circuit 220 includes a low speed, high torque radial piston winch motor 612 and brake 614. A pilot-operated relief valve 230 is provided to prevent high pressure shocks in the haul-in side of the winch circuit caused by high transient cable loads. In addition, a transmission block 205 is provided comprising crossline relief valves and check valves. The crossline relief valve limit pressure on each side of the winch closed loop. A check valve 231 is provided to ensure the casing of winch motor 612 is full of oil at all times. A heat exchanger 232 is provided in the system to cool case drain oil from pump 201 and motor 612, thereby removing most of the heat losses from the system.

(ix) Description of FIG. 21

Turning now to FIG. 21, one possible form of the auxiliary power unit as used in a system designed for passive shock absorption is depicted therein includes motor 333 which drives a positive displacement, constant volume pump 334. A strainer 335 and filter 336 (e.g., 10 micron) are used to protect the system from contamination, and a relief valve 337 is used to limit system pressure. This is an open-loop system, and contains three direction control valves. Unlike the main power unit, the auxiliary power unit is designed to run constantly during normal towing. During idling periods, solenoid-operated, spring-offset, three-way, two-position direction control valve 338 allows oil to bypass from pump 334 to reservoir 339 through flow switch 340 at low pressure to prevent heat build-up.

The boom is raised or lowered by means of a single acting hydraulic cylinders 62, which in the embodiment under consideration would be of 10-inch bore each. Each cylinder is provided with cushions 342 and 343 to prevent hard impacts from damaging the system in both the extended and retracted positions respectively. Each cylinder is provided with a hydraulic fuse 344 to prevent catastrophic collapse in the event of hose breakage and the boom circuit also contains a pressure-compensated flow control valve with bypass check valve 345 to limit rate of retraction the boom cylinders. Movement of the boom cylinders is controlled via a solenoid-operated, spring-centered, three-position direction control valve 346 with blocked center position. Controls are provided to prevent this valve being shifted from the center position as long as valve 338 is open and as long as flow switch 340 shows there is an open circuit to reservoir 339.

Shock absorption in the passive mode is provided by a bank of gas-oil accumulators 347 when they are connected into the boom circuit through throttling ball valve 348. Ball valve 349 can also be used to provide additional throttling. The accumulators are gas charged individually normally from ship's nitrogen bottles through valves 350; and oil charged from the pump circuit through valve block 351 and through solenoid-operated spring-centered, three-position direction control valve 352 with blocked center position. As before, controls are provided to prevent this valve being shifted from the center position as long as valve 338 is open and as long as flow switch 340 shows there is an open circuit to reservoir 339.

(x) Description of FIG. 22

Turning now to FIG. 22, one possible form of the auxiliary power unit as used in a system designed for active assist to passive shock absorption and as shown in FIG. 20 is one in which the single cylinders 62 of 10-inch bore in FIG. 21 are now replaced with double acting cylinders 1024 of 8-inch bore which are powered by the passive portion of the system and boost cylinders 1020 of 6-inch bore, powered by the active portion of the system. The passive portion is otherwise somewhat similar to the totally passive system shown in FIG. 21. Motor 1039 drives fixed displacement pump 1038, which discharges oil to blocked-centre solenoid valve 1030 or blocked-centre solenoid valve 1031, or through solenoid valve 1032 through flow switch 1033 to reservoir. As in FIG. 23, valve 1031 is used to oil charge accumulator bank 1035. Valve 1030 is used to raise or lower the boom with cylinders 1024, and via valve 1028, with cylinders 1020. The active portion is powered by pump 1037 discharging through servo valve 1079 to slave cylinders 1020 only. When the servo system is active, valve 1028 blocks flow to the boost cylinders from all other sources but the servo valve. Valves 1027, 1029 and 1036 connect the passive system to cylinders 1024.

(xi) Description of FIG. 23

A logic diagram for controlling servo pump 1037 is shown in FIG. 23. The object in all shock abosrbing is to control cable tension by effectively smothering variations from mean tension as much as possible. It is best then that tension itself be the quantity sensed and used to control the system. As stated previously, this can be accomplished by strain gauging the deflection sheave mounts at the boom pivot point. Thus, the logic diagram FIG. 23 shows strain gauges 734 as the means of sensing tension. The strain gauges yield an analog signal which is fed three amplifier 1082 to programmer 1083. The programmer 1083 calculates the moving average mean tension and multiplies it by a constant equal to the desired ratio of variable to average tension. This is tension is also outputted as as modified feedback signal. The control and feedback signals are compared at the double potentiometer 1077, and any difference between the two is processed at amplifier 1078 as an error signal to servo valve 1079 which attempts to minimize the differences between control and output signals by forcing motion in boost cylinders 1020. The result is again picked up by cable tension strain gauges and the process repeats ad infinitum.

The compact towing system of aspects of this invention may be in the neutral mode, in the launch and recovery mode, in the winch control mode and/or in the shock absorbing mode. The following descriptions relate to the operation of the hydraulic system in these various modes.

In respect to the neutral mode, reference is made to FIG. 20 in which solenoid-operated valves 204, 217, 218, 222 through 224 and 228 are de-energized and remote controller 221 is in the spring-centered, neutral position. Motor 264 is running.

As remote controller 221 is in the spring-centered position, variable displacement pump 201 has zero displacement. If such pump is swashed by moving handle 265 of controller 221 in either direction, oil will flow through the winch closed loop 220 through ports 266 and 267 of valve 204, by passing the winch motor completely. The pump 201 circulates the oil in the closed loop circuit 220 by passing the oil through direction control valve 204.

Outlet 268 of pump 203 displaces oil through relief valve back to reservoir 210. It also supplies oil to remote controller 221 and swash controls 227 and 272 of pump 201. Outlet 270 of pump 211 displaces oil through solenoid-operated valve 271 back to reservoir 210.

SUMMARY AND OPERATION OF PREFERRED EMBODIMENTS

In summary, the compact towing system of aspects of this invention includes a fixed winch and a movable trucked gantry and boom assembly with a driven carriage upon which is mounted the fairlead towing sheave. The gantry is driven from the winch so that, as the cable winds and unwinds, an almost perfect zero degree fleet angle is obtained between two cable and drum flanges. No additional space is required, as the boom gantry with full cable scope overboard is simply driven into the space normally occupied by the stowed tow body, i.e., astride the lower saddle. In essence, the more cable is overboard, the further the boom tip projects beyond the stern. In addition, using this system, the winch, situated with the drum axis of revolution sited longitudinally on one side of the ship, is located in a semi-dry space more convenient for maintenance. The cable is simply directed through a long horizontal opening in the fore-and-aft bulkhead. This opening need be no more than a slit because, as viewed fore and aft, there is no cable movement out of a horizontal plane in marked contrast to other designs (see, e.g., Canadian Pat. No. 879,530). This slit can have a combined fairing-training device and sliding curtains mounted on it to keep out all but the heaviest spray.

In operation, from the winch drum, the cable passes through the hollow boom pivot to a deflection sheave on a pivoting mount, then out along the boom to the towing sheave mounted on a travelling, balanced fairlead and saddle assembly. The travelling fairlead is mounted on a carriage, and is self-propelled, via a carriage-mounted hydraulic drive to geared wheels meshing with racks mounted on the boom. A fully-passive boom bobbing system is provided. Such boom bobbing may be accomplished by connecting four gas accumulators in parallel to the head ends of the boom actuators through a single large throttling valve. Cushions in the boom cylinders, or a deceleration valve which may be cam-actuated from the boom pivot, provide progressive additional throttling above the plus 14 degree, and below the minus 10 degree boom positions. The gas accumulators may be charged from nitrogen gas bottles and from the auxiliary power unit, as will be described hereinafter.

A main hydraulic power unit is provided to operate the winch and fairlead sheave and saddle assembly portions of the system. Such power unit preferably includes a variable displacement axial piston pump system having both manual and pressure compensation controls. A closed loop, including a double shaft electric motor and pump, provides a hydrostatic drive system that drives the winch motor at variable speed and in both directions. Also preferably included in the hydraulic power unit is a fixed displacement tandem gear pump. One outlet of the pump supplies oil, filtered through a filter to the travelling fairlead and saddle circuit; the other outlet supplies oil, filtered through a filter, for release of the winch and travelling fairlead and saddle carriage devide brakes, and for the swash controls of the variable displacement pump.

The above components, together with several valves, are mounted on a reservoir. The reservoir, in one of its embodiments, is a welded aluminum structure provided with the usual gear, e.g., clean-out covers, a filler-breather cap, an oil level gauge and a drain valve. It is also provided with oil strainers to protect the pump from contamination.

An auxiliary power unit, which may be separate from the main power unit, is provided to operate the boom portion of the system. It includes a fixed displacement pump to power three open loop circuits: the boom cylinders; the oil-charging circuit of the passive shock absorbing system; and, in the case of the variant with the folding boom, the boom tip folding cylinders. A spring-powered reel is also provided to feed lines to the translating fairlead and sheave assembly carriage.

In the launch and recovery mode, reference is made to FIGS. 20 and 21 in which solenoid-operated valve 228 is de-energized, and solenoid operated valves 204 and 217 are energized. The winch closed loop system 220 is completed by the energizing of valve 204. The winch system pressure line 220 on the haul-in side is connected through de-energized valve 228 to the pressure compensator 229 of pump 201.

While the handle 265 of remote controller 221 is moved fully over to the winch-in direction, the pressure compensator 229 regulates the pressure of oil from variable displacement pump 201 to a near constant valve sufficient to produce enough tow cable tension to hold the towed body firmly against the saddle.

Solenoid 346*a* of valve 346 and solenoid of valve 338 are both energized, forcing pump 334 to pressurize the heads of cylinders 62 to raise the boom into the fully elevated position. This raises the body clear of the lower saddle. Solenoid valve 218 and solenoid 222*b* of valve 222 are both energized releasing brake 832 and causing motor 830 to power the fairlead carriage from the extreme inboard to the extreme outboard position. This causes pump 201 to swash via swash controls 272 and 227 under the influence of pressure compensator 229 sufficient to cause the winch motor 612 to pay out cable as the fairlead carriage moves along the boom while still maintaining sufficient cable tension to hold the body captured in the saddle.

At the end of the carriage travel, solenoid 222*b* of valve 222 and solenoid valve 218 are both de-energized to stop the fairlead carriage and set the carriage drive brake 832. Solenoid 346*b* of valve 346 is then energized allowing boom cylinders 62 to drain down to reservoir 339. This lowers the boom tip and saddle to the waterline. If it is necessary to trim the saddle position to keep the towed body horizontal during boom lowering, this can be done by energizing one of the solenoids on valve 224 to cause cylinders 62 to tilt the saddle.

The body is released from the saddle by energizing solenoid valve 228 (removing the influence of pressure compensator 229 from the winch closed loop 220) and by moving handle 265 of control block 221 in a direction to swash pump 201 so as to cause motor 612 to pay out cable. As cable is payed out, solenoid 346*a* of valve 346 is energized to cause cylinders 62 to lift the boom to a mean towing position. Solenoid 224*a* is energized to cause cylindes 822 to tilt the saddle upwards for full balanced fairleading, then de-energized to lock the saddle in the tilted position. Solenoid 223*b* is energized to withdraw lock pin 814 via cylinder 213, then de-energized to permit free fairleading.

For recovery, solenoid 224*b* is energized to return the saddle to a near horizontal position, and solenoid 223*a* is then energized to insert the lock pin via cylinder 213 and lock out the fairleading mechanism. With the fairleading locked out, solenoid 223*a* is then de-energized. The boom is again lowered by energizing solenoid 246*b* of valve 346. Once the body is in contact with the saddle, solenoid-operated valve 228 is de-energized, the handle 265 of remote controller 221 is moved fully over to the winch-in direction, and pressure compensator 229 again regulates the pressure of oil from variable displacement pump 201 to a near constant value sufficient to hold the towed body firmly against the saddle.

Solenoid 346*a* of valve 346 is now energized to raise the boom via cylinders 62 and lift the body clear of the water. When the boom is fully raised, it is locked in this position by de-energizing solenoid 346*a*. Saddle attitude can be adjusted via valve 224.

Solenoid valv 218 and solenoid 222*a* of valve 222 are now energized to allow the fairlead carriage drive motor 830 to power the carriage to the full inboard position. As the carriage at this stage is moving downhill, pressure-compensated flow control valve 276 limits carriage speed, while the winch is winding in under pressure compensation to maintain firm body contact with the saddle.

In the inboard position, solenoid valve 218 and solenoid 222*a* of valve 222 are both de-energized, bringing fairlead carriage drive motor 830 to a stop and applying carriage drive brake 832. Solenoid 346*b* of valve 346 is now energized, allowing the boom to lower and place the towed body firmly in the lower saddle.

In the winch control mode, reference is made to FIG. 20 in which solenoid valve 204 is energized completing the winch closed loop system 220. Solenoid valve 217 is energized, releasing winch brake 614.

The pressure compensation 229 on pump 201 is disconnected by energizing solenoid valve 228. When the handle 265 of remote controller 221 is moved in either direction, a pressure signal is sent from controller 221 to the swash control pilot valve 272 which controls the swash actuator 227 of pump 201. Oil then flows in the winch closed loop 220 in direction and volume depending on the direction and extent that handle 265 of controller 221 is moved.

In the stock absorbing mode, (passive system), reference is made to FIG. 21, where, with the body being towed, solenoid 346*a* of valve 346 is energized to raise the boom to a mean towing position. This position will vary from minus 5° at low speed to dead horizontal at high speeds. The boom is locked in this position by de-energizing solenoid 346*a* and shutting valve 349 in high sea states. The accumulators 347 will have been previously oil charged partially full by energizing solenoid 352*b* and opening valves in bank 351 for a timed period; and gas charged through valves 350 to a pressure of between 1000 and 1200 p.s.i. Valves 348 and 349 are now opened, and the boom will bob in response to fluctuating cable tensions and pressures set up in accumulators 347 in reaction to those tensions. This provides the necessary shock absorbing to smooth out the tension fluctuations. Valves 348 and 349 may be partially closed to provide any amount of hydraulic damping necessary.

In the shock absorbing mode (active assist to passive system), reference to made to FIGS. 22 and 23 where, with the body being towed, solenoid 1030*b* of blocked centre valve 1030 and the solenoids of valves 1028 and 1032 are energized to direct oil to the head ends of cylinders 1024 and boost cylinders 1020 from pump 1038 until the boom is raised to a mean towing position. At the mean towing position, the solenoids of valves 1028, 1030 and 1032 are de-energized, locking the boom. The accumulators 1035 will have previously been oil and gas charged as in the purely passive system. Valve 1029 is now opened, valve 1036 is energized and the closed loop feedback servo system switch 1075 is turned ON. The boom will now bob in shock absorbing mode, not merely passively in response to fluctuating cable tensions as reflected in the varying pressures imposed on accumulator 1035, but also actively as forced upon slave cylinders 1020 by servo valve 1079 acting in response to error signal commands which are a function of the difference between actual tension variations $\Delta T = T_{max} - T$ and desired maximum tension variations, kx moving $\overline{T}$. The servo valve 1079 will allow pump 1037 to boost flows either to the head or the rod ends of slave cylinders 1020, depending on whether feedback shows that $T_{max}$ must be smoothed or $T_{min}$ boosted.

The hydraulic servo pump circuit shown in FIG. 22 is only one example of such a circuit. It is not necessarily the best nor the only one possible.

FIG. 24 shows towing capabilities of one embodiment of this invention in Beaufort wind force 7 without shock absorbing; FIG. 25 with passive shock absorbing; and FIG. 26 shows expected towing capabilities with another embodiment using an active assist type of shock absorbing system. It is seen that the safe towing envelope is greater when passive shock absorbing is provided than when no shock absorbing is provided, but that optimum performance is achieved when an active assist type of shock absorbing system is provided.

In one embodiment of this invention, the main power unit consists of a 125 HP, 1200 RPM no load 3/60/440 VAC induction motor driving a 122 USGPM variable volume pump, and includes brake and boost pump, compensator controls, charge lines, charge line reliefs, main closed loop bypass valve, reversible full-flow high pressure filters in the main closed loop, drain line heat exchanger (if required) and all power unit piping and manifolding mounted atop a 125 U.S. Gallon reservoir.

The auxiliary power unit consists of a 40 HP, 3/60/440 VAC induction motor driving a main 24 USGPM pump mounted with all the usual accessories atop a 100 U.S. Gallon reservoir. The pump powers several open-loop systems; charging the boom-bobbing accumulators, driving the boom actuators; and in the case of a folding boom, boom folding cylinders.

SUMMARY OF THE INVENTION

Other advantages and features of the compact towing system of aspects of the present invention include:

(a) Arrangement of the long face of the drum is in the direction where there is the greatest space to accommodate it (i.e., fore and aft), rather than athwartships (where space is limited).

(b) Mounting the boom on the trucked gantry and driving the trucked gantry in synchronism from the winch allows virtually perfect zero fleet angle spooling from the winch, which substantially eliminates cable scuffing, jumping of grooves, and which also helps to eliminate clashing of fairing tailpieces. This is achieved by driving the trucked gantry aft along the drum face into the body storage space left vacant during towing.

(c) Keeping the cable pitch diameter tangent to the hollow pivot of the boom on the boom gantry means that the cable always first contacts the drum on a fixed line drawn from one end of the drum to the other. This makes the design and installation of fairing training devices to prevent clashing of fairing tailpieces a much more simple affair. It also makes possible the mounting of the winch in a semi-dry space, as cable entry to the drum can be through a narrow fore and aft slot in the wall of the semi-dry space, in conjunction with a curtain for sealing out all but the worst deluge of water in high sea states. This aids maintenance at sea.

(d) Keeping the cable pitch diameter of the pivoting sheave tangent to the hollow pivot point of the boom on the trucked gantry means that if shock absorbing in high sea states is used there is no cable excursion through any of the sheaves during shock absorbing. This extends fatigue life of the cable many times over that of a system which permits such cable excursions, and (e) Keeping the cable pitch diameter of the pivoting sheave tangent to the hollow pivot point of the boom on the trucked gantry means that, unlike other prior art sonar towing systems, the angle of cable wrap over one of the sheaves is always constant regardless of cable trail angle at the sea surface. This means total load on the sheave is always a fixed constant (1.414 for 90 degree wrap angle) times cable load. This fact, for the first time, allows simple and accurate strain gauging of sheave mounting. This allows anything from simple readout of cable load to use of the strain gauges as a primary feedback device should it be desired to use a closed-loop feedback hydraulic servo assist to the boom bobbing.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably and "intended" to be, within the full range of equivalence of the following claims.

I claim:

1. A compact towing system adapted to be mounted on a ship for towing an underwater towed body using faired tow cable, comprising:

(a) a trucked gantry adapted to be driven in a fore and aft direction;

(b) a lower saddle adapted to be disposed inside the confines of said trucked gantry when said gantry is driven aft;

(c) a winch drum with fixed foundations and with the centreline thereof extending approximately fore and aft along said ship;

(d) a boom having an inner end and an outer end, said inner end being hinged on a hollow pivot on said trucked gantry;

(e) a pivotable deflection sheave mounted inside said boom, the pitch radius of said sheave being tangent to the centerline of said hollow pivot;

(f) a fairlead sheave and saddle assembly, said assembly being mounted on a carriage which is adapted to be driven along said boom;

(g) means for driving said trucked gantry in synchronism with said winch drum, (b) that, as said trucked gantry traverses between a forward stow position and an aft full cable-out position, a zero degree fleet angle is obtained between said tow cable and said winch drum;

(h) means for driving said drum carriage to traverse said carriage along said boom only during launch and recovery in synchronism with said winch drum so that, as said cable unwinds, said carriage is driven towards the outer end of said boom, so that said fairlead sheave and saddle assembly overhangs said outer end of said boom, and as said cable winds, said carriage is driven towards the inner end of said boom, so that said fairlead sheave and saddle assembly lies along said boom; whereby (i) in operation, said cable passes from said winch drum, through a fairing training device, through said hollow boom pivot, around said deflection sheave, along said boom, though said fairlead sheave which is mounted on said driven carriage and thence to said towed body.

2. The compact towing system of claim 1 wherein said trucked gantry (a) comprises a rectangular chassis having means on which wheels are mounted, and a pair of upright, spaced-apart arms, said arms having aligned apertures therethrough.

3. The compact towing system of claim 2 wherein said means on which said wheels are mounted is provided with a pair of fore and rear pivotally mounted bogey arms, each bogey arm having a fore and an aft free-wheeling wheel mounted thereon.

4. The compact towing system of claim 3 wherein said trucked gantry has a fore end and an aft end, and wherein said aft end of said gantry is provided with aligned pivot apertures.

5. The compact towing system of claim 2 wherein said trucked gantry has a fore portion and an aft portion at each side thereof, and wherein said fore and aft portions at each side of said trucked gantry are provided with free wheeling bumper wheels.

6. The compact towing system of claim 2 wherein said upright space-apart arms are provided, within each aperture, with hollow pivot stub shafts, located within pivot bushings disposed within said hollow pivot on said trucked gantry.

7. The compact towing system of claim 2 wherein said trucked gantry (a) runs on tracks mounted on a deck of said ship on either side of said lower saddle.

8. The compact towing system of claim 7 wherein said wheels are captured above and below on hardened inserts within said tracks.

9. The compact towing system of claim 7 wherein said trucked gantry is driven by driven longitudinally extending, paralle, spaced-apart threaded screws engaging associated threads on said trucked gantry.

10. The compact towing system of claim 9 wherein said screws are driven by a roller chain entraining toothed wheels on one said screw and on said winch drum, said other said screw being driven by an auxiliary roller chain entraining respective toothed wheels on said screws.

11. The compact towing system of claim 9 wherein one end of each of said screws is supported on bearing pillow blocks, and the other end of each of said screws is supported in roller bearing pillow blocks.

12. The compact towing system of claim 11 wherein said bearing pillow blocks are attached to the sides of said lower saddle, and wherein said roller bearing pillow blocks are on a deck of said ship.

13. The compact towing system of claim 1 wherein said lower saddle (b) has an arcuate shape in side elevation, and has a curved lower surface in cross section.

14. The compact towing system of claim 1 wherein said winch drum (c) comprises a hollow drum provided with a plurality of internal stiffening rings to prevent buckling.

15. The compact towing system of claim 14 wherein said winch drum (e) is supported on rollers and is driven by an internal gear drive or by an external gear drive.

16. The compact towing system of claim 15 wherein said internal gear drive includes an internal spur gear secured to one said stiffening ring, a hydraulic drive motor driving a spur pinion meshing with said internal spur gear, and a brake assembly.

17. The compact towing system of claim 14 wherein said winch drum (e) includes an internal storage drum magazine.

18. The compact towing system of claim 1 wherein said boom (d) comprises an inner boom and an outer folding boom assembly.

19. The compact towing system of claim 18 wherein said inner boom comprises a pair of spaced-apart main frames, reinforced by an upper longitudinal trussworks interconnected to one another by transverse interconnecting arms.

20. The compact towing system of claim 18 wherein said outer boom comprises a pair of transversely spaced apart, longitudinally extending ways, said ways being interconnected to a longitudinal bracing assembly and to a transverse bracing arm, said ways being spanned by a fairlead carriage drive.

21. The compact towing system of claim 19 wherein spaced-apart aligned gear racks are set into said main frames and said ways respectively.

22. The compact towing system of claim 18 wherein said inner boom is pivotally mounted to said trucked gantry through a pair of spaced-apart boom pivot stub shafts associated with said trucked gantry, at least the shaft closest to said drum being hollow.

23. The compact towing system of claim 22 wherein said pivot stub shafts are located within pivot bushings in aligned pivot apertures in upright spaced-apart arms on said trucked gantry.

24. The compact towing system of claim 22 wherein said inner boom is driven to pivot about said boom pivot stub shaft by means of a pair of boom actuation hydraulic cylinders spanning the space between the aft end of said trucked gantry and said inner boom.

25. The compact towing system of claim 18 wherein said outer boom is driven to fold with respect to said inner boom means of at least one boom folding hydraulic cylinder disposed between the aft end of said inner boom and the fore end of said outer folding boom.

26. The compact towing system of claim 1 wherein said boom comprises a single, unitary boom, the inboard end thereof being pivotally mounted to said trucked gantry through a pair of spaced-apart boom pivot stub shafts, associated with said trucked gantry, at least the shaft closest to said drum being hollow.

27. The compact towing system of claim 26 wherein said stub shafts are located with pivot bushings in aligned pivot apertures in upright spaced-apart arms on said trucked gantry.

28. The compact towing system of claim 26 wherein both the inboard section of said boom and the outboard section of said boom comprise a pair of spaced-apart main frames, reinforced by an upper longitudinal trussworks interconnected to one another by transverse interconnecting arms and wherein the outboard section of said boom also includes a pair of transversely spaced-apart, longitudinally extending ways, said ways being interconnected to a longitudinal bracing assembly and to a transverse bracing arm, said ways being spanned by a fairlead carriage drive.

29. The compact towing system of claim 28 wherein spaced-apart aligned gear racks are set into said main frames.

30. The compact towing system of claim 27 wherein said boom is driven to pivot about said pivot stub shaft by means of a pair of boom actuation hydraulic cylinders spanning the space between the aft end of said trucked gantry and said inboard section of said boom.

31. The compact towing system of claim 1 wherein said pivotable deflection sheave (e) is supported by tilting carriage assembly, said assembly being mounted on said boom pivot and being disposed transverse to said boom pivot.

32. The compact towing system of claim 31 wherein said deflection sheave (e) includes a strain gauge assembly associated therewith.

33. The compact towing system of claim 32 wherein said tilting carriage assembly comprises a pair of pivoting clevises mounted on said boom pivot stub shaft, a pair of links straddling said deflection sheave and pivoted at one end each to an associated pivoting clevis and at the other end to said deflecting sheave shaft or bearing, and a strain gauge associated with each link.

34. The compact towing system of claim 1 wherein said towing sheave of said sheave and saddle assembly comprises a hood partially housed free-wheeling sheave, thereby to provide a circular throat for the passage of faired cable therethrough, and means mounting the forward end of said hood on the frame of said carriage.

35. The compact towing system of claim 34 including a hydraulically-actuated fairlead locking pin for selective prevention of swivelling of said hood.

36. The compact towing system of claim 1 wherein said saddle of said sheave and saddle assembly comprises a hydraulically pivoted, open forethroat saddle having an aft cross-member ballasted with high density material.

37. The compact towing system of claim 1 wherein said towing sheave of said sheave and saddle assembly comprises a hood partially housed free-wheeling sheave, thereby to provide a throat for the passage of faired cable therethrough, and means mounting the forward end of said hood on the frame of said carriage, including a hydraulically-actuated fairlead locking pin for selective prevention of swivelling of said hood; said saddle assembly of said towing sheave and saddle assembly comprising a hydraulically pivoted, open forethroat saddle having an aft cross-member ballasted with high density material.

38. The compact towing system of claim 31 wherein said hood acts as an anti-jump device; wherein said towing sheave is adapted freely to pivot in the plane of the stern of said ship; wherein said pivoting hood is locked to prevent swivelling during launch and recovery; wherein said faired cable passes through a mounting tube on the frame of said carriage and through said throat of said pivoting hood; and wherein, during free fairleading, said saddle is tilted up until its raised centre of gravity reaches the point that weight distribution about the fore and aft throat of said hood is balanced.

39. The compact towing system of claim 1 wherein said carriage of said sheave and saddle assembly has a frame, on which is mounted free running wheels paired with drive gears meshing with spaced-apart gear racks on said boom.

40. The compact towing system of claim 39 wherein said gears are driven by a carriage-mounted hydraulic motor and brake assembly.

41. The compact towing system of claim 40 wherein said drive from said hydraulic motor is from a constant speed hydraulic motor through speed reducers.

42. The compact towing system of claim 1 wherein said towing sheave of said sheave and saddle assembly comprises a hood partially housed free-wheeling sheave, thereby to provide a circular throat for the passage of faired cable therethrough, and means mounting the forward end of said hood on the frame of said carriage, including a hydraulically-actuated fairlead locking pin for selected prevention of swivelling said hood; wherein said saddle assembly comprises a hydraulically pivoted, open forethroat saddle having an aft cross-member ballasted with high density material; wherein said carriage has a frame, on which is mounted free running wheels and drive wheels secured to driven gears meshing with spaced-apart racks on said boom; and wherein said gears are driven by a carriage-mounted hydraulic motor and brake assembly.

43. The compact towing system of claim 1 wherein said cable is directed through a horizontal opening in the fore-and-aft bulkhead of the ship the opening including a sliding curtain and a fairing training device comprising a scroll tube to catch tilted fairings and to hold them upright until they are captured against the grooves on said drum, said scroll tube being mounted on a framework, held and sliding within a fixed frame attached preferably to the fore on a aft bulkhead openings of the ship, said curtain each having one end anchored to the ends of the slit opening and the other end attached to the sliding training device, whereby as the training device moved to one end of the slit the curtains at that end convolute into folds while the other curtain pulls out straight, and vice versa.

44. The compact towing system of claim 1 wherein said boom (d) is provided with a fully passive boom bobbing system.

45. The compact towing system of claim 44 wherein said boom bobbing system comprises gas accumulators in parallel to the head ends of boom actuators through a throttling valve, and throttling means for providing progressive additional throttles above the plus 14 degree and below the minus 10 degree boom position.

46. The compact towing system of claim 45, wherein said throttling means comprises cushions in boom cylinders.

47. The compact towing system of claim 45 wherein said throttling means comprises a deceleration valve which is cam-actuated from said boom pivot.

48. The compact towing system of claim 1 including a main hydraulic system to operate said winch and said fairlead sheave and saddle assembly.

49. The compact towing system of claim 48 including an auxiliary power unit to operate said boom.

50. The compact towing system of claim 49 wherein said auxiliary power unit is used in a system for passive shock absorption.

51. The compact towing system of claim 49 wherein said auxiliary power unit is used in a system for active assist to passive shock absorption.

52. The compact towing system of claim 1 wherein: said trucked gantry comprises a rectangular chassis having means on which wheels are mounted, and a pair of upright, spaced-apart arms, said arms having aligned apertures therethrough; and wherein said boom comprises an inner boom and an outer boom assembly.

53. The compact towing system of claim 1 wherein: said gantry comprises a rectangular chassis having means on which wheels are mounted, and a pair of upright, spaced-apart arms, said arms having aligned apertures therethrough; and wherein said boom comprises a single, unitary boom.

54. The compacting towing system of claim 52 wherein said means is provided with a pair of fore and rear pivotally mounted bogey arms, each bogey arm having said wheels consisting of a fore and an aft free-wheeling wheel mounted thereon.

55. The compact towing system of claim 52 wherein said means is provided with a pair of fore and rear pivotally mounted bogey arms, each bogey arm having said wheels consisting of a fore and an aft free-wheeling wheel mounted thereon.

56. The compact towing system of claim 52 wherein said means is provided with a pair of fore and rear pivotally mounted bogey arms, each bogey arm having said wheels consisting of a fore and an aft free-wheeling wheel mounted thereon, and wherein an aft end of said trucked gantry is provided with aligned pivot apertures.

57. The compact towing system of claim 53 wherein said means is provided with a pair of fore and rear pivotally mounted bogey arms, each bogey arm having said wheels consisting of a fore and aft free-wheeling wheel mounted thereon, and wherein the aft end of said trucked gantry is provided with aligned pivot apertures.

58. The compact towing system of claim 52 wherein fore and aft portions at each side of said trucked gantry are provided with free-wheeling bumper wheels.

59. The compact towing system of claim 53 wherein fore and aft portions at each side of said trucked gantry are provided with free-wheeling bumper wheels.

60. The compact towing system of claim 52 wherein said upright spaced-apart arms are provided, in each aperture, with pivot stub shafts, located within pivot bushings, at least one said pivot stub shaft being hollow.

61. The compact towing system of claim 53 wherein said upright spaced-apart arms are provided, in each aperture, with pivot stub shafts, located within pivot bushings, at least the shaft closest to said drum being hollow.

62. The compact towing system of claim 52 wherein said trucked gantry runs on a pair of spaced-apart, parallel tracks mounted on a deck of said ship.

63. The compact towing system of claim 53 wherein said trucked gantry runs on a pair of spaced-apart, parallel tracks mounted on a deck of said ship.

64. The compact towing system of claim 52 wherein said trucked gantry runs on a pair of spaced-apart, parallel tracks mounted on a deck of said ship; and wherein said wheels are captured above and below on hardened inserts within said tracks.

65. The compact towing system of claim 53 wherein said trucked gantry runs on a pair of spaced-apart, parallel tracks mounted on a deck of said ship; and wherein said wheels are captured above and below on hardened inserts within said tracks.

66. The compact towing system of claim 52 wherein said trucked gantry runs on a pair of spaced-apart, parallel tracks mounted on a deck of said ship; and wherein said trucked gantry is driven by driven, longitudinally-extending, parallel, spaced-apart threaded screws engaging associated threads on said trucked gantry.

67. The compact towing system of claim 53 wherein said trucked gantry runs on a pair of spaced-apart, parallel tracks mounted on a deck of said ship; and wherein said trucked gantry is driven by driven, longitudinally-extending, parallel, spaced-apart threaded screws engaging associated threads on said trucked gantry.

68. The compact towing system of claim 52 wherein said trucked gantry runs on a pair of spaced-apart, parallel tracks mounted on a deck of said ship; wherein said trucked gantry is driven by driven, longitudinally extending, parallel, spaced-apart threaded screws engaging associated threads on said trucked gantry; and wherein said screws are driven by a roller chain entraining toothed wheels on one said screw, said other said screw being driven by an auxiliary roller chain entraining respective toothed wheels on said screws.

69. The compact towing system of claim 53 wherein said trucked gantry runs on a pair of spaced-apart, parallel tracks mounted on a deck of said ship; wherein said trucked gantry is driven by driven, longitudinally extending, parallel, spaced-apart threaded screws engaging associated threads on said trucked gantry; and wherein said screws are driven by a roller chain entraining toothed wheels on said screw, said other said screws being driven by an auxiliary roller chain entraining respective toothed wheels on said screws.

70. The compact towing system of claim 52 wherein said trucked gantry runs on a pair of spaced-apart, parallel tracks mounted on a deck of said ship; wherein said trucked gantry is driven by driven, longitudinally extending, parallel, spaced-apart threaded screws engaging associated threads on said trucked gantry; and wherein one end of each of said screws is supported on bearing pillow blocks and the other end of each of said screws is supported in roller bearing pillow blocks.

71. The compact towing system of claim 53 wherein said trucked gantry runs on a pair of spaced-apart, parallel tracks mounted on a deck of said ship; wherein said trucked gantry is driven by driven, longitudinally extending, parallel, spaced-apart threaded screws engaging associated threads on said trucked gantry; and wherein one end of each of said screws is supported on bearing pillow blocks and the other end of each of said screws is supported in roller bearing pillow blocks.

72. The compact towing system of claim 52 wherein said inner boom is pivotally mounted to said trucked gantry through a pair of spaced-apart boom pivot stub shafts associated with said trucked gantry, at least the one said pivot stub shaft being hollow.

73. The compact towing system of claim 52 wherein said pivot stub shafts are located within pivot bushings in aligned pivot apertuers in upright spaced-apart arms on said trucked gantry.

74. The compact towing system of claim 52 wherein said inner boom comprises a pair of spaced-apart main frames, reinforced by an upper longitudinal trussworks interconnected to one another by transverse interconnecting arms.

75. The compact towing system of claim 52 wherein said outer boom comprises a pair of transversely spaced-apart, longitudinally extending ways, said ways being interconnected to a longitudinal bracing assembly and to a transverse bracing arm, said ways being spanned by a fairlead carriage drive.

76. The compact towing system of claim 75 wherein spaced-apart aligned gear racks are set into said main frames and said ways respectively.

77. The compact towing system of claim 75 wherein spaced-apart aligned gear racks are set into said main frames and said ways respectively.

78. The compact towing system of claim 52 wherein said inner boom is driven to pivot about said boom pivot stub shaft by means of at least a pair of boom actuation hydraulic cylinders spanning a space between the aft end of said trucked gantry and said inner boom.

79. The compact towing system of claim 52 wherein said outer boom is driven to fold with respect to said inner boom by means of at least one boom folding hydraulic cylinder disposed between an aft end of said inner boom and a fore end of said outer folding boom.

80. The compact towing system of claim 53 wherein both the inboard section of said boom and the outboard section of said boom comprises a pair of spaced-apart main frames, reinforced by an upper longitudinal trussworks being interconnected to one another by transverse interconnecting arms and wherein the outboard section of said boom also includes a pair of transversely spaced-apart, longitudinally extending ways, said ways being interconnected to a longitudinally bracing assembly and to a transverse bracing arm, said ways being spanned by a fairlead carriage drive.

81. The compact towing system of claim 53 wherein spaced-apart aligned gear racks are set into said main frames.

82. The compact towing system of claim 72 wherein said boom is driven to pivot about said boom pivot stub shafts by means of at least one boom actuating hydraulic cylinder spanning the space between the aft end of said trucked gantry and said inboard section of said boom.

83. The compact towing system of claim 1 wherein said boom has an inner end and an outer end, said inner end being hinged on a hollow pivot, and including a fairlead sheave and saddle assembly, said assembly being mounted on a carriage which is adapted to be driven along said boom.

84. The compact towing system of claim 83 wherein said boom comprises an inner boom and an outer folding boom assembly.

85. The compact towing system of claim 84, wherein said inner boom comprises a pair of spaced-apart main frame, reinforced by an upper longitudinal trussworks interconnected to one another by transverse interconnecting arms.

86. The compact towing system of claim 84 wherein said outer boom comprises a pair of transversely spaced-apart, longitudinally extending ways, said ways being interconnected to a longitudinal bracing assembly and to a transverse bracing arm, said ways being spanned by a fairlead carriage drive.

87. The compact towing system of claim 86 wherein spaced-apart aligned gear racks are set into said main frames and said ways respectively.

88. The compact towing system of claim 86 wherein spaced-apart aligned gear racks are set into said main frames and said ways respectively.

89. The compact towing system of claim 83 wherein said boom comprises a single, unitary boom, the inboard end thereof being pivotally mounted to said trucked gantry through a pair of spaced-apart boom pivot stub shafts, at least the shaft closest to said drum being hollow.

90. The compact towing system of claim 89 wherein both the inboard section of said boom and the outboard section of said boom comprise a pair of spaced-apart main frames, reinforced by an upper longitudinal trussworks, interconnected to one another by transverse interconnecting arms and wherein the outboard section of said boom also includes a pair of transversely spaced-apart, longitudinally extending ways, said ways being interconnected to a longitudinal bracing assembly and to a transverse bracing arm, said ways being spanned by a fairlead carriage drive.

91. The compact towing system of claim 90 wherein spaced-apart aligned gear racks are set into said main frames and said ways respectively.

92. The compact towing system of claim 83 wherein a towing sheave of said sheave and saddle assembly comprises a hood partially housed free-wheeling sheave, thereby to provide a circular throat for the passage of faired cable therethrough; and means mounting a forward end of said hood on a frame of said carriage.

93. The compact towing system of claim 83 wherein a towing sheave of said sheave and saddle assembly comprises a hood partially housed free-wheeling sheave, thereby to provide a circular throat for the passage of faired cable therethrough; and means mounting a forward end of said hood on a frame of said carriage; and further including a hydraulically-actuated fairlead locking pin for selective prevention of swivelling of said hood.

94. The compact towing sheave of claim 83 wherein a saddle of said sheave and saddle assembly comprises a hydraulically pivoted, open forethroat saddle having an aft cross-member ballasted with high density material.

95. The compact towing system of claim 83 wherein a towing sheave of said sheave and saddle assembly comprises a hood partially housed free-wheeling sheave, thereby to provide a circular throat for the passage of faired cable therethrough, and means mounting a forward end of said hood on a frame of said carriage, wherein a saddle of said sheave and saddle assembly comprises a hydraulically pivoted, open forethroat saddle having an aft cross-member ballasted with high density material; and further including a hydraulically-actuated fairlead locking pin for selective prevention prevention of swivelling of said hood.

96. The compact towing system of claim 83 wherein a towing sheave of said sheave and saddle assembly comprises a hood partially housed free-wheeling sheave, thereby to provide a circular throat for the passage of faired cable therethrough, and means mounting a forward end of said hood on a frame of said carriage; wherein a saddle of said sheave and saddle assembly comprises a hydraulically pivoted, open forethroat saddle having an aft cross-member ballasted with high density material and further including a hydraulically-actuated fairlead locking pin for selected prevention of swivelling of said hood, said hood acting as an anti-jump device; wherein said towing sheave is adapted freely to pivot in the plane of the stern of said ship; wherein said pivoting hood is locked to prevent swivelling during launch and recovery; wherein said faired cable passes through a mounting tube on the frame of said carriage and through said throat of said pivoting hood; and wherein, during free fairleading, said saddle is tilted up until its raised centre of gravity reaches the point that weight distribution about the fore and aft throat of said hood is balanced.

97. The compact towing system of claim 83 wherein said carriage of said sheave and saddle assembly has a frame, on which is mounted free running wheels paired with gears meshing with the spaced-apart gear racks on said boom.

98. The compact towing system of claim 83 wherein said carriage of said sheave and saddle assembly has a frame, on which is mounted free running wheels paired with gears meshing with the spaced-apart gear racks on said boom; and wherein said gears are driven by a carriage-mounted hydraulic motor and brake assembly.

99. The compact towing system of claim 76 wherein said carriage of said sheave and saddle assembly has a frame on which is mounted free running wheels paired with gears meshing with the spaced-apart gear racks on said boom; wherein said gears are driven by a carriage-mounted hydraulic motor and brake assembly; and further wherein a drive means from said hydraulic motor is from a constant speed hydraulic motor through speed reducers.

100. The compact towing system of claim 83 wherein said towing sheave of said sheave and saddle assembly comprises a hood partially housed free-wheeling sheave, thereby to provide a circular throat for the passage of faired cable therethrough, and means mounting a forward end of said hood on a frame of said carriage; wherein said saddle of said sheave and saddle assembly comprises a hydraulically pivoted, open forethroat saddle having an aft cross-member ballasted with high density material; further including a hydraulically-actuated fairlead locking pin for selected prevention of swivelling of said hood; wherein the carriage of the assembly has a frame, on which is mounted free running wheels paired with gears meshing with spaced-apart gear racks on said boom; and wherein said gears are driven by a carriage-mounted hydraulic motor and brake assembly.

101. The compact towing system of claim 83 wherein said towing sheave of said sheave and saddle assembly comprises a hood partially housed free-wheeling sheave, thereby to provide a circular throat for the passage of faired cable therethrough, and means mounting a forward end of said hood on a frame of said carriage; wherein said saddle of said sheave and saddle assembly comprises a hydraulically pivoted, open forethroat saddle having an aft cross-member ballasted with high density material, and further including a hydraulically-actuated fairlead locking pin for selected prevention of swivelling of said hood; wherein said carriage of said assembly has a frame, on which is mounted free running wheels paired with gears meshing with spaced-apart gear racks on said boom; wherein said gears are driven by a carriage-mounted hydraulic motor and brake assembly; and further including means to traverse said carriage along said boom only during launch and recovery.

102. The compact towing system of claim 1 wherein: said trucked gantry comprises a rectangular chassis having means on which wheels are mounted, and a pair of upright, spaced-apart arms, said arms having aligned apertures therethrough; wherein said lower saddle has an arcuate shape in side elevation, and a curved lower surface in cross section; and wherein said winch drum comprises a hollow drum provided with a plurality of internal stiffening rings to prevent buckling.

103. The compact towing system of claim 102 wherein said winch drum is supported on rollers and is driven by an internal gear drive.

104. The compact towing system of claim 102 wherein said winch drum is supported on rollers and is driven by an internal gear drive; wherein said internal gear drive includes an internal spur gear secured to one said stiffening ring, a hydraulic drive motor driving a spur pinion meshing with said internal spur gear, and a brake assembly.

105. The compact towing system of claim 102 wherein said winch drum is driven using an external gear drive.

106. The compact towing system of claim 102 wherein said winch drum includes an internal storage drum magazine.

107. The compact towing system of claim 102 wherein said means is provided with a pair of fore and rear pivotally mounted bogey arms, each bogey arm having a fore and an aft free-wheeling wheel mounted thereon.

108. The compact towing system of claim 102 wherein said means is provided with a pair of fore and rear pivotally mounted bogey arms, each bogey arm having a fore and an aft free-wheeling wheel mounted thereon; and wherein the fore and aft portions at each side of said trucked gantry are provided with free-wheeling bumper wheels.

109. The compact towing system of claim 102 wherein said trucked gantry runs on tracks mounted on a deck of said ship on either side of said lower saddle.

110.

The compact towing system of claim 102 wherein said trucked gantry runs on tracks mounted on a deck of said ship on either side of said lower saddle; and wherein said wheels are captured above and below on hardened inserts within said tracks.

111. The compact towing system of claim 102 wherein said trucked gantry runs on tracks mounted on a deck of said ship on either side of said lower saddle; and wherein said trucked gantry is driven by driven longitudinally extending, parallel, spaced-apart threaded screws engaging associated threads on said trucked gantry.

112. The compact towing system of claim 102 wherein said trucked gantry runs on tracks mounted on a deck of said ship on either side of said lower saddle; wherein said trucked gantry is driven by driven longitudinally extending, parallel, spaced-apart threaded screws engaging associated threads on said trucked gantry; and wherein said screws are driven by a roller chain entraining respective toothed wheels on one said screw and on said winch drum, said other said screw being driven by an auxiliary roller chain entraining respective toothed wheels on said screws.

113. The compact towing system of claim 102 wherein said trucked gantry runs on tracks mounted on a deck of said ship on either side of said lower saddle; wherein said trucked gantry is driven by driven longitudinally extending, parallel, spaced-apart threaded screws engaging aassociated threads on said trucked gantry; and wherein one end of each of said screws is supported on bearing pillow blocks, attached to the sides of said lower saddle, and the other end of each of said screws is supported in roller bearing pillow blocks, on a deck of said ship.

114. The compact towing system of claim 102 wherein the driving of said trucked gantry fore and aft is so related to the winding and unwinding of cable from said winch drum that, as said trucked gantry traverses between a forward stow position and an aft full cable-out position, a zero degree fleet angle is obtained and maintained between said tow cable and said winch drum.

115. The compact towing system of claim 1 wherein said pivotable deflection sheave is mounted on a tilting carriage, which itself is mounted on a tilting carriage, which itself is mounted on said boom pivot, said tilting carriage being disposed traverse to said boom pivot.

116. The compact towing system of claim 115 wherein said boom comprises an inner boom and an outer folding boom assembly.

117. The compact towing system of claim 116 wherein said inner boom comprises a pair of spaced-apart main frames, reinforced by an upper longitudinal trussworks interconnected to one another by transverse interconnecting arms.

118. The compact towing system of claim 116 wherein said outer boom comprises a pair of transversely spaced-apart, longitudinally extending ways, said ways being interconnected to a longitudinal bracing assembly and to a transverse bracing arm, said ways being spanned by a fairlead carriage drive.

119. The compact towing system of claim 116 wherein said inner boom is pivotally mounted to said trucked gantry through a pair of spaced-apart boom pivot stub shafts associated with said trucked gantry at least the shaft closest to said drum being hollow.

120. The compact towing system of claim 116 wherein said pivot stub shafts are located with pivot bushings in aligned pivot apertures in upright spaced-apart rams on said trucked gantry.

121. The compact towing system of claim 115 wherein said boom comprises a single, unitary boom, the inboard end thereof being pivotally mounted to said trucked gantry.

122. The compact towing system of claim 121 wherein both the inboard section of said boom and the outboard section of said boom comprises a pair of spaced-apart main frames, reinforced by an upper longitudinal trussworks interconnected to one another by transverse interconnecting arms and wherein the outboard section of said boom also includes a pair of transversely spaced-apart, longitudinally extending ways, said ways being interconnected to a longitudinal bracing assembly and to a transverse bracing arm, said ways being spanned by a fairlead carriage drive.

123. The compact towing system of claim 122 wherein said boom comprises a single, unitary boom, the inboard end thereof being pivotally mounted to said trucked gantry through a pair of spaced-apart boom pivot stub shafts, associated with said trucked gantry, at least the shaft closest to said drum being hollow.

124. The compact towing system of claim 123 wherein said stub shafts are located with pivot bushings in aligned pivot apertures in upright spaced-apart arms on said trucked gantry.

125. The compact towing system of claim 116 wherein said inner boom is driven to pivot about said boom pivot stub shaft by means of a pair of boom actuation hydraulic cylinders spanning the space between the aft end of said trucked gantry and said inner boom.

126. The compact towing system of claim 116 wherein said outer boom is driven to fold with respect to said inner boom means of at least one boom folding hydraulic cylinder disposed between the aft end of said inner boom and the fore end of said outer folding boom.

127. The compact towing system of claim 121 wherein said boom is driven to pivot about said pivot stub shaft by means of a pair of boom actuation hydraulic cylinders spanning the space between the aft end of said trucked gantry and said inboard section of said boom.

128. The compact towing system of claim 115 wherein said deflection sheave includes a strain gauge assembly associated therewith.

129. The compact towing system of claim 115 wherein said deflection sheave includes a strain gauge assembly associated therewith and wherein said tilting carriage assembly comprises a pair of pivoting clevises mounted on said boom pivot stub shaft, a pair of links straddling said deflection sheave and pivoted at one end each to an associated pivoting clevis and at the other end to the deflecting sheave shaft or bearing, and a strain gauge associated with each link.

130. The compact towing system of claim 83 wherein said boom is provided with a fully passive boom bobbing system.

131. The compact towing system of claim 83 wherein said boom is provided with a fully passive boom bobbing system.

132. The compact towing system of claim 102 wherein said boom is provided with a fully passive boom bobbing system.

133. The compact towing system of claim 102 wherein said boom is provided with a fully passive boom bobbing system; wherein said boom bobbing system comprises gas accumulators in parallel to the head ends of boom actuators through a throttling valve; and including throttling means for providing progressive additional throttles above the plus 14 degree and below the minus 10 degree boom position.

134. The compact towing system of claim 102 wherein said boom is provided with a fully passive boom bobbing system; wherein said boom bobbing system comprises gas accumulators in parallel to the head ends of boom actuators through a throttling valve; including throttling means comprising cushions in boom cylinders for providing progressive additional throttles above the plus 14 degree and below the minus 10 degree boom position.

135. The compact towing system of claim 52, wherein said boom is provided with a fully passive boom bobbing system; wherein said boom bobbing system comprises gas accumulators in parallel to head ends of boom actuators through a throttling valve; and including throttling means comprising a deceleration valve, cam-actuated from said boom pivot for providing progressive additional throttles above the plus 14 degree and below the minus 10 degree boom position.

136. The compact towing system of claim 52, including an auxiliary power unit to operate said boom.

137. The compact towing system of claim 52 including an auxiliary power unit to operate said boom and said auxiliary power unit is used in a system for passive shock absorption.

138. The compact towing system of claim 52, including an auxiliary power unit to operate said boom and wherein said auxiliary power unit is used in a system for active assist to passive shock absorption.

139. The compact towing system of claim 83 including a main hydraulic system to operate said fairlead sheave and saddle assembly.

140. The compact towing system of claim 102 including a main hydraulic system to operate said winch.

* * * * *

UNITED STATES PATENT AND TRADEMARK OFFICE

CERTIFICATE OF CORRECTION

PATENT NO. : 4,597,352

DATED : July 1, 1986

INVENTOR(S) : Robert S. NORMINTON

It is certified that error appears in the above-identified patent and that said Letters Patent is hereby corrected as shown below:

On the front page of the patent, Column 1, between items [22] and [51] insert:

--[30] Foreign Application Priority Data

July 15, 1983 [CA] CANADA ..... 432,535--.

Signed and Sealed this

Twenty-sixth Day of April, 1988

*Attest:*

DONALD J. QUIGG

*Attesting Officer*

*Commissioner of Patents and Trademarks*